US006263791B1

(12) United States Patent
Sato

(10) Patent No.: US 6,263,791 B1
(45) Date of Patent: Jul. 24, 2001

(54) STENCIL PRINTER

(75) Inventor: Makoto Sato, Sendai (JP)

(73) Assignee: Tohoku Ricoh Co., Ltd., Shibata-gun (JP)

( * ) Notice: Subject to any disclaimer, the term of this patent is extended or adjusted under 35 U.S.C. 154(b) by 0 days.

(21) Appl. No.: 09/255,696

(22) Filed: Feb. 23, 1999

(30) Foreign Application Priority Data

Mar. 20, 1998 (JP) ..... 10-072043
Dec. 8, 1998 (JP) ..... 10-348345

(51) Int. Cl.[7] ..... B41L 13/04
(52) U.S. Cl. ..... 101/116; 101/425
(58) Field of Search ..... 101/114, 115, 101/116, 119, 120, 129, 425, 155, 169; 15/256.51, 256.52

(56) References Cited

U.S. PATENT DOCUMENTS 3,693,547 * 9/1972 Morgan ..... 101/425
3,986,450 * 10/1976 Zimmer ..... 101/115
4,436,032 * 3/1984 Van Ouwerkerk ..... 101/120
4,540,997 * 9/1985 Biggs et al. ..... 346/140 R
5,152,220 * 10/1992 Lindner et al. ..... 101/155
5,309,837 * 5/1994 Nanzai ..... 101/425
5,900,889 * 5/1999 Tsukuka ..... 347/23

FOREIGN PATENT DOCUMENTS 6-40139 2/1994 (JP) .
6-71996 3/1994 (JP) .
6-135111 5/1994 (JP) .
7-257005 10/1995 (JP) .
8-025781 1/1996 (JP) .
8-142474 6/1996 (JP) .
10-95156 4/1998 (JP) .

* cited by examiner

*Primary Examiner*—Ren Yan
(74) *Attorney, Agent, or Firm*—Oblon, Spivak, McClelland, Maier & Neustadt, P.C.

(57) ABSTRACT

A stencil printer capable of printing an image on a paper or similar recording medium by causing ink to ooze out via the perforations of a master is disclosed. The printer includes an ink collecting device for collecting the ink from the circumference of an ink drum. The printer therefore maintains the circumference of the ink drum in a desirable condition and thereby reduces the number of waste papers as far as possible so as to reduced a printing cost.

27 Claims, 37 Drawing Sheets

OPERATION PANEL
TIMER
153
267
IMAGE READ SECTION
2
SENSOR
152
INK SENSORS
170,171
TEMPERATURE SENSOR
393
PHOTO SENSORS
409,419
FEED PUMPS
265,266
SUCTION PUMPS
373,383
DISCHARGE PUMPS
402,412
CONTROL MEANS
404
PRINT SECTION
MOTORS
SOLENOIDS
146,147
98,120
9
1ST & 2ND MASTER MAKE SECTIONS
4,5
1ST & 2ND MASTER DISCHARGE SECTIONS
6,7
PAPER DISCHARGE SECTION
8
PAPER FEED SECTION
3
SOLENOIDS
SOLENOIDS
VALVES
400,410

STENCIL PRINTER

BACKGROUND OF THE INVENTION

The present invention relates to a printer and more particularly to a stencil printer for printing an image on a paper or similar recording medium by causing ink to ooze out via perforations formed in a master.

A digital thermal printer using a stencil is conventional and includes a rotatable ink drum. The ink drum is made up of a porous cylindrical base and one or more mesh screens wrapped around the base one above the other and formed of resin or metal. The stencil has a laminate structure consisting of a thermoplastic resin film (generally about 1 $\mu$m to 3 $\mu$m thick) and a porous support implemented by Japanese paper fibers or synthetic fibers or a mixture thereof. A thermal head selectively perforates the film surface of the stencil by heat in accordance with image data. After the perforated part of the stencil, i.e., a master has been wrapped around the ink drum, ink feeding means arranged in the ink drum feeds ink to the inner periphery of the ink drum. Then, a press roller or similar pressing means presses a paper against the ink drum. As a result, the ink oozes out via the porous portion of the ink drum and the perforations of the master, forming an image on the paper.

In the above conventional stencil printer, after a printing operation using a given master, the stencil is perforated in accordance with the next document in order to produce a new master. The new master is automatically wrapped around the ink drum for effecting the next printing. So long as printing is continuously effected with consecutive masters, a sufficient amount of ink is held between the base and the mesh screen of the ink drum and can be surely fed even to a new master, rendering even the first printing attractive.

On the other hand, assume that a new master is wrapped around the ink drum after the printer has been left unused over a long period of time. Then, the ink existing between the base and the mesh screen of the ink drum is short of water due to evaporation and small in volume. As a result, a substantial period of time is necessary for such ink to infiltrate into the porous support of the new master and ooze out via the perforations of the thermoplastic resin film of the master.

The above ink short of water is low in viscosity and sticky. Should such ink be transferred to a paper via the perforations of the thermoplastic resin film, it would blur an image or would be transferred to the rear of another paper (so-called offset). Particularly, in a duplex print mode for printing images on both sides of a paper, a desirable printing is not achievable until the undesirable ink has been fully consumed. Consequently, several papers to several tens of papers should be wasted before ink capable of forming a desirable image with a new master is fed to the ink drum.

The mesh screen layer is exposed to air and has a great area. The ink deposited on the mesh screen layer and the inner periphery of the ink drum, among others, noticeably decreases in viscosity when the printer is left unused over a long period of time.

Technologies relating to the present invention are disclosed in, e.g., Japanese Patent Laid-Open Publication Nos. 6-40139, 6-71996, 6-135111, 7-257005 and 10-95156 as well as in U.S. Pat. No. 5,782,178.

SUMMARY OF THE INVENTION

It is therefore an object of the present invention to provide a stencil printer capable of reducing the number of waste papers as far as possible and thereby reducing the printing cost.

In accordance with the present invention, a stencil printer for printing an image on a paper or similar recording medium by wrapping a perforated master around an ink drum, feeding ink to the ink drum, and causing the ink to ooze out via the ink drum and includes an ink collecting device for collecting the ink deposited on the circumference of the ink drum, and an ink storing device for temporarily storing the ink collected by the ink collecting device.

Also, in accordance with the present invention, a stencil printer for printing an image on a paper or similar recording medium by wrapping a perforated master around an ink drum, feeding ink to the ink drum, and causing the ink to ooze out via the ink drum and master includes a timer for counting a period of time elapsed since the end of the last printing, an ink collecting device for collecting, when the period of time counted by the timer is longer than a preselected period of time, the ink from the circumference of the ink drum, and an ink storing device for temporarily storing the ink collected by the ink collecting device.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
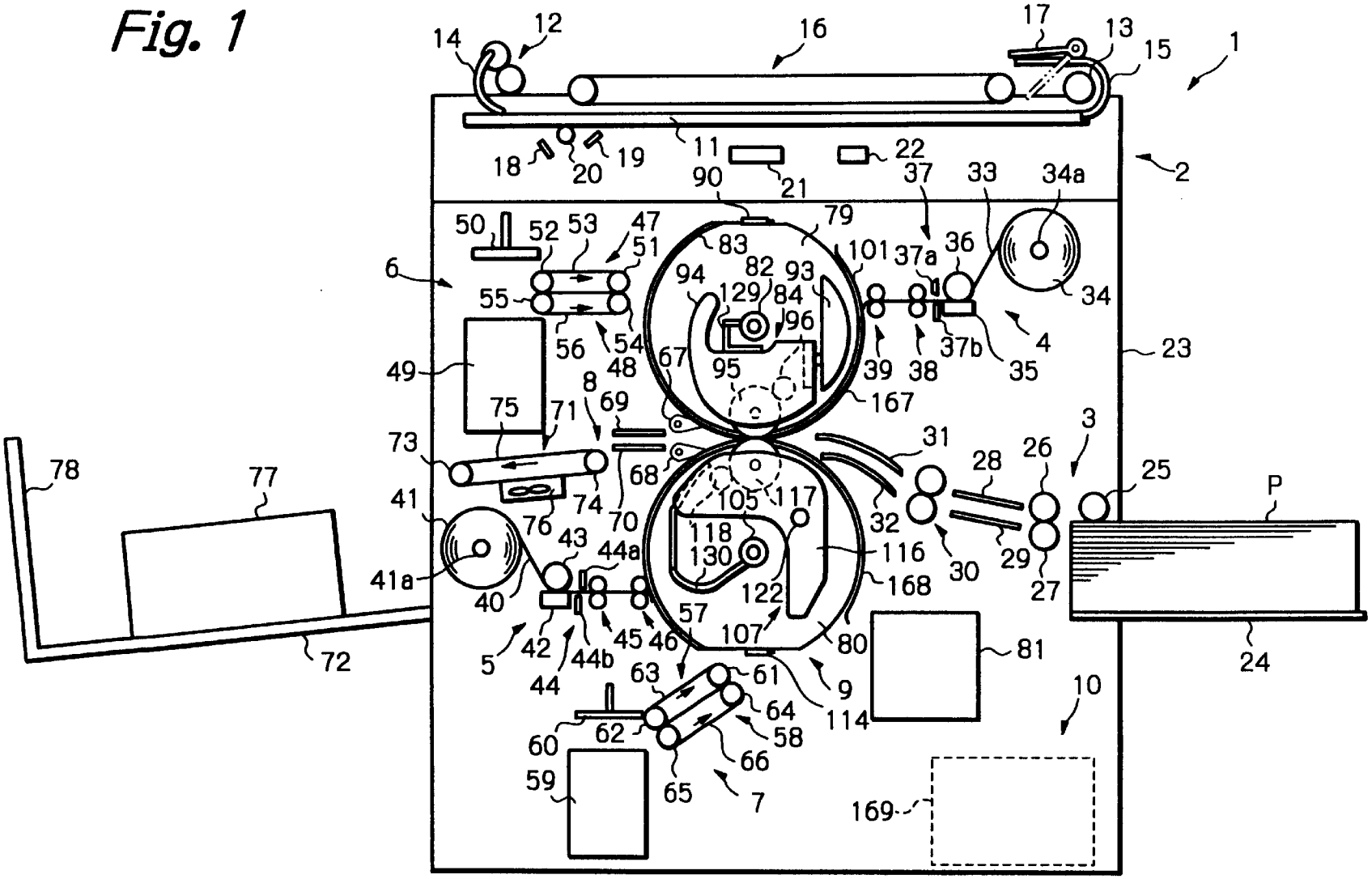
FIG. 1 is a side elevation showing a first embodiment of the stencil printer in accordance with the present invention.

Preferred embodiments of the stencil printer in accordance with the present invention will be described hereinafter.

First Embodiment

Referring to FIGS. 1–17, a stencil printer embodying the present invention is shown and generally designated by the reference numeral 1. As shown, the printer 1 is generally made up of an image reading section 2, a paper feeding section 3, a first and a second master making section 4 and 5, respectively, a first and a second master discharging section 6 and 7, respectively, a paper discharging section 8, a printing section 9, a control section 10, and first and second ink collecting means 250 and 270, respectively. The ink collecting means 250 and 270 are not shown in FIG. 1 for the sake of simplicity of illustration.

The printer 1 includes a casing or body 23. The image reading section 2 is arranged in the upper portion of the casing 23 and includes a glass platen 11 for laying a document thereon, a roller pair 12 and a roller 13 for conveying a document, guides 14 and 15 for guiding the document being conveyed, a belt 16 for conveying the document along the glass platen 11, and a path selector 17 for switching a direction in which the document read should be discharged. The image reading section further includes mirrors 18 and 19 and a 4 fluorescent lamp 20 for scanning the document, a lens 21 for focusing an imagewise reflection from the document, and a CCD (Charge Coupled Device) or similar image sensor 22 for processing the reflection or document image incident thereto. The image sensor 22 sends an image signal to control means 169 (see FIG. 15) included in the control section 10.

The paper feeding section 3 is positioned at the right middle portion of the casing 23. The paper feeding section 3 includes a paper tray 24 loaded with a stack of papers P, a pick-up roller 25 and separator rollers 26 and 27 cooperating to feed the papers P one by one, guides 28 and 29 for guiding the paper P being fed, a registration roller pair 30 for nipping the leading edge of the paper P and then driving it at a preselected timing, and guides 31 and 32 for guiding the paper being conveyed by the registration roller pair 30.

The first master making section 4 is positioned above the paper feeding section 3 and includes a stencil 33 implemented as a roll 34. A thermal head 35 perforates, or cuts, the stencil 33 by heating it. A platen roller 36 conveys the stencil 33 while pressing it against the thermal head 35 and constitutes first master making means together with the head 35. Cutting means 37 cuts off the perforated part of the stencil 33, i.e., a master at a preselected length. Roller pairs 38 and 39 convey the cut stencil or master 33 and constitute first master conveying means.

The roll 34 includes a core 34*a* rotatably supported by a support member not shown. A stepping motor, not shown, causes the platen roller 36 to rotate. The cutting means 37 is made up of a movable edge 37*a* and a stationary edge 37*b*. The movable edge 37*a* is rotatable or movable up and down relative to the stationary edge 37*b*.

The second master making section 5 is arranged at the left middle portion of the casing 23 and also includes a stencil 40 in the form of a roll 41. The roll 41 has its core 41*a* rotatably supported by a support member not shown. A thermal head 42 and a platen roller 43 constitute second master making means. A stepping motor, not shown, causes the platen roller 43 to rotate. Cutting means 44 is made up of a movable edge 44*a* and a stationary edge 44*b*. Roller pairs 45 and 46 constitute second master conveying means.

Disposed above the second master making section 5 are the first master discharging section 6 and first ink collecting means 250 (see FIG. 2) for collecting ink from the outer periphery of an ink drum 79. The first master discharging section 6 mainly consists of an upper and a lower discharge member 47 and 48, respectively, a box 49, and a compressor 50.

The upper discharge member 47 has a drive roller 51, a driven roller 52, and an endless belt 53 passed over the two rollers 51 and 52. The drive roller 51 is caused to rotate clockwise, as viewed in FIG. 1, causing the belt 53 to move in a direction indicated by an arrow in FIG. 1. The lower discharge member 48 also has a drive roller 54, a driven roller 55, and an endless belt 56 passed over the two rollers 54 and 55. The drive roller 54 is caused to rotate counterclockwise, as viewed in FIG. 1, causing the belt 56 to move in a direction indicated by an arrow in FIG. 1. Moving means, not shown, selectively moves the lower discharge member 48 to a position shown in FIG. 1 or a position where the circumference of the drive roller 54 contacts the outer periphery of the ink drum 79, as will be described specifically later. The box 49 is used to store used masters and removably mounted to the casing 23. The compressor 50 compresses a used master introduced into the box 49 and is moved up and down by elevating means not shown.

Figure 2:
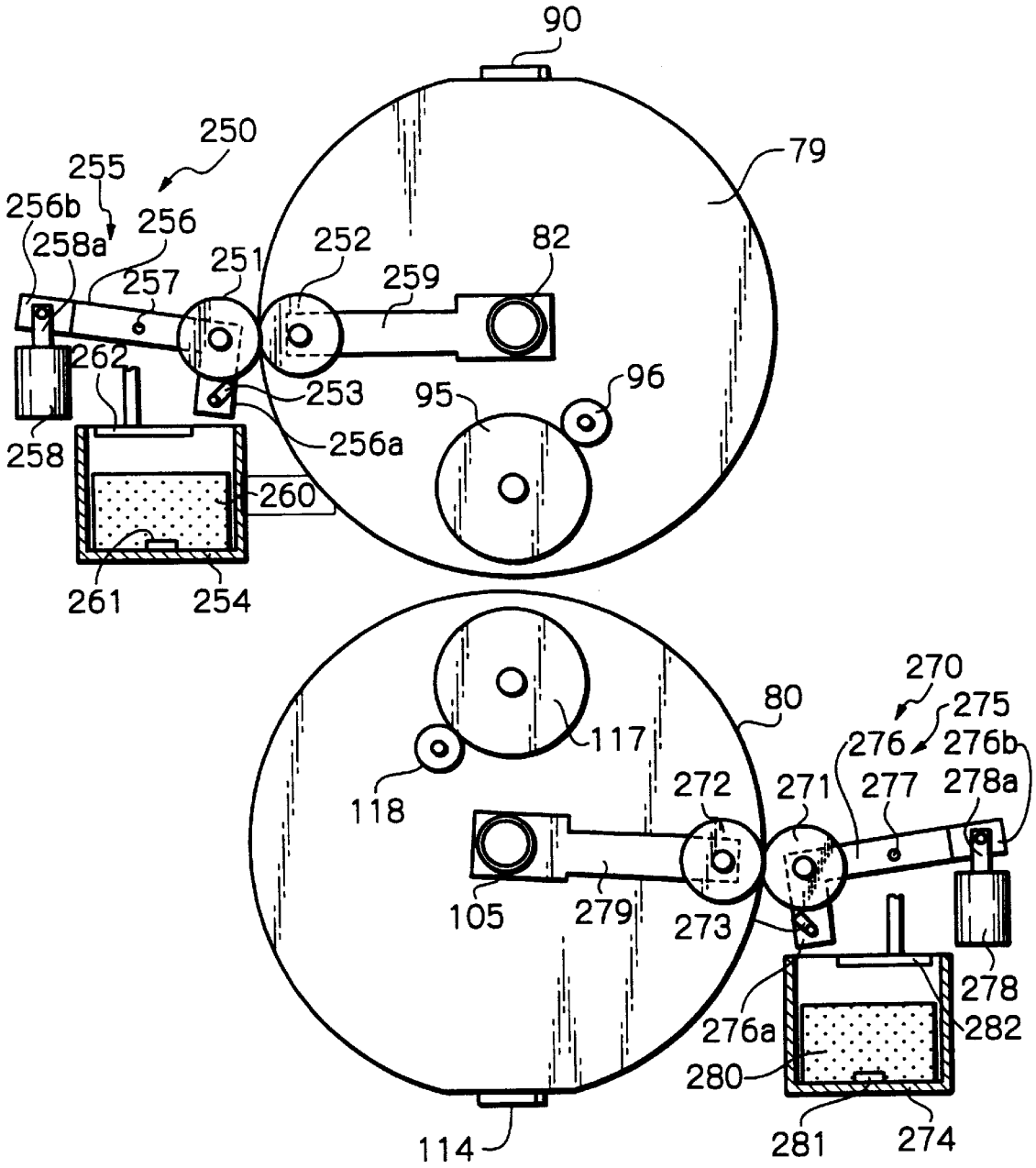
FIG. 2 shows first and second ink collecting means included in the first embodiment.
Figure 3:
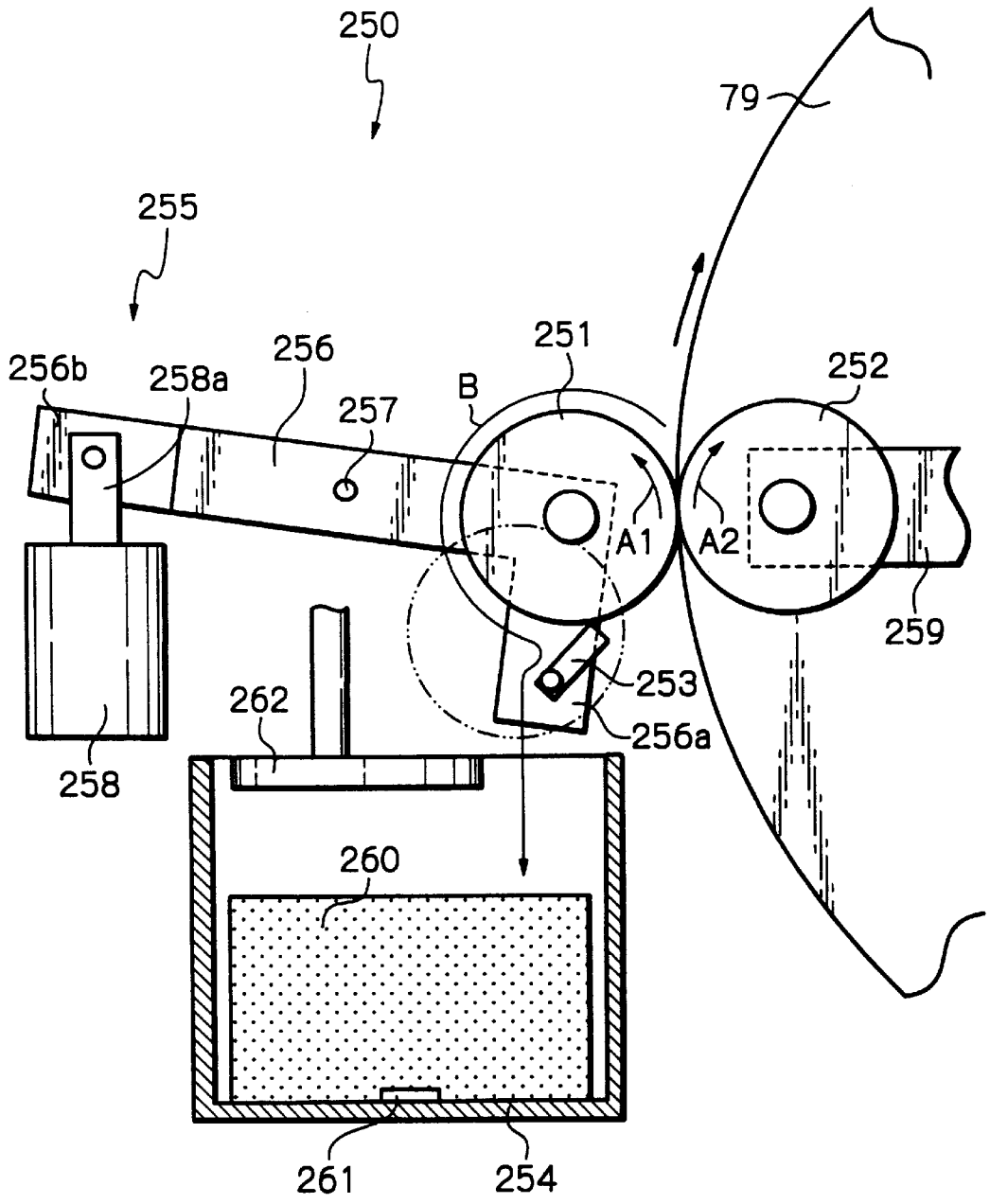
FIG. 3 is an enlarged view of the first ink collecting means shown in FIG. 2.

As shown in FIGS. 2 and 3, the first ink collecting means 250 includes a roller 251 movable into and out of contact with the outer periphery of the ink drum 79 for collecting ink. A backup roller 252 held in contact with the inner periphery of the ink drum 79 and faces the roller 251. A blade 253 scrapes off ink from the circumference of the roller 251. Roller moving means 255 moves the roller 251 into and out of contact with the outer periphery of the ink drum 79. The control means 169 mentioned earlier forms a part of the first ink collecting means 250.

The roller moving means 255 includes a pair of arms 256 supporting opposite axial ends of the roller 251. A solenoid 258 causes the arms 256 to rotate about a shaft 257. Specifically, each arm 256 is rotatably supported by the casing 23 via the shaft 257 at its intermediate portion. One end 256*a* of the arm 256 is generally L-shaped and supports the roller 251 and blade 253. The blade 253 is formed of rubber or similar elastic material and held in contact with the surface of the roller 251. The solenoid 258 has its plunger 258*a* connected to the other end 256*b* of the arm 256.

The control means 169 controls the operation of the solenoid 258. Specifically, when the control means 169 does not energize the solenoid 258, the solenoid 258 maintains the roller 251 spaced from the ink drum 79, as indicated by a dash-and-dots line in FIG. 3. When the control means 169 energizes the solenoid 258, the solenoid 258 presses the roller 251 against the ink drum 79, as indicated by a solid line in FIG. 3.

The roller 251 and backup roller 252 are formed of rubber or similar elastic material. A pair of brackets 259 are affixed to a shaft 82, which will be described later, and rotatably support opposite ends of the backup roller 252. The backup roller 252 is therefore rotated by the ink drum 79 when the ink drum 79 is in rotation. In FIGS. 2 and 3, only one of the arms 256 and only one of the brackets 259 are shown.

A waste ink box 254 is removably mounted to the casing 23 below the blade 253. A block 260 is formed of a highly ink-absorptive material and disposed in the waste ink box 254 for preventing collected ink from dropping when it is discarded. The block 260 is sponge-like and may be formed of polyurethane by way of example. A weight sensor 261 responsive to the weight of the block 260 is positioned on the bottom of the waste ink box 254. When the weight of the block 260 absorbed collected ink exceeds a preselected weight, the weight sensor 261 sends a signal to the control means 169 for informing it of such an occurrence.

A compressor 262 is positioned above the waste ink box 254 for causing the block 260 to positively absorb ink collected in the waste ink box 254. The compressor 262, like the compressor 50, is movable up and down by being driven by elevating means not shown.

The second ink collecting means 270 is positioned below and at the right-hand side of another ink drum 80 for collecting ink from the outer periphery of the drum 80. The second ink collecting means 270 is substantially identical in configuration with the first ink collecting means 250 and will not be described specifically in order to avoid redundancy. The control means 169 forms a part of the second ink collecting means 270 as well.

The second master discharging section 7 is arranged below and at the right-hand side of the second master making section 5, as viewed in FIG. 1. The second master discharging section 7, like the first master discharging section 6, has an upper and a lower discharge member 57 and 58, respectively, a box 59, and a compressor 60. The discharge members 57 and 58 are identical in configuration with the discharge members 47 and 48, respectively. Specifically, the discharge members 57 and 48 are respectively made up of a drive roller 61, a driven roller 62 and an endless belt 63 and a drive roller 64, a driven roller 65, and an endless belt 66. The drive rollers 61 and 64 respectively cause the belts 63 and 66 to move in directions indicated by arrows in FIG. 1. Moving means, not shown, selectively moves the lower discharge member 58 to a position shown in FIG. 1 and a position where the circumference of the drive roller 64 contacts the outer periphery of the ink drum 80. The box 59 is removably mounted to the casing 23 while the compressor 60 is movable up and down by being driven by elevating means not shown.

The paper discharging section 8 is positioned between the second master making section 5 and the first master discharging section 6. The paper discharging section 8 includes peelers 67 and 68, guides 69 and 70, a paper conveyor 71, and a tray 72.

The peeler 67 is PivotTable supported by opposite side walls, not shown, of the casing 23 such that its edge is movable toward and away from the outer periphery of the ink drum 79. The peeler 67 is used to separate the paper or printing P from the outer periphery of the ink drum 79. This is also true with the peeler 68 except that the edge of the peeler 68 is movable toward and away from the outer periphery of the ink drum 80. The guides 69 and 70 are supported by the side walls of the casing 23 and respectively guide the printings P removed by the peelers 67 and 68. The paper conveyor 71 is made up of a drive roller 73, a driven roller 74, an endless belt 75, and a suction fan 76. While the suction fan 76 retains the paper P on the belt 75 by suction, the belt 75 is caused to rotate by the driven roller 73 for conveying the paper P in a direction indicated by an arrow in FIG. 1. The tray 72 for stacking such papers or printings P includes an end fence 78 and a pair of side fences 77 movable toward and away from each other in the widthwise direction of the papers P (perpendicularly to the direction of paper transport). The tray 72 is foldable to be accommodated in the casing 23, as desired.

The printing section 9 is arranged at the center portion of the casing 23 and generally made up of the first and second ink drums 79 and 80, respectively, and drum drive means 81. The ink drum 79 has a shaft 82 at its center that plays the role of a main pipe for feeding ink at the same time. A porous support plate 83 is positioned on the outer periphery of the ink drum 79 as a first master support plate. First ink feeding means 84 and ink roller moving means 81 (see FIGS. 7 and 9) are arranged in the ink drum 79.

Figure 4:
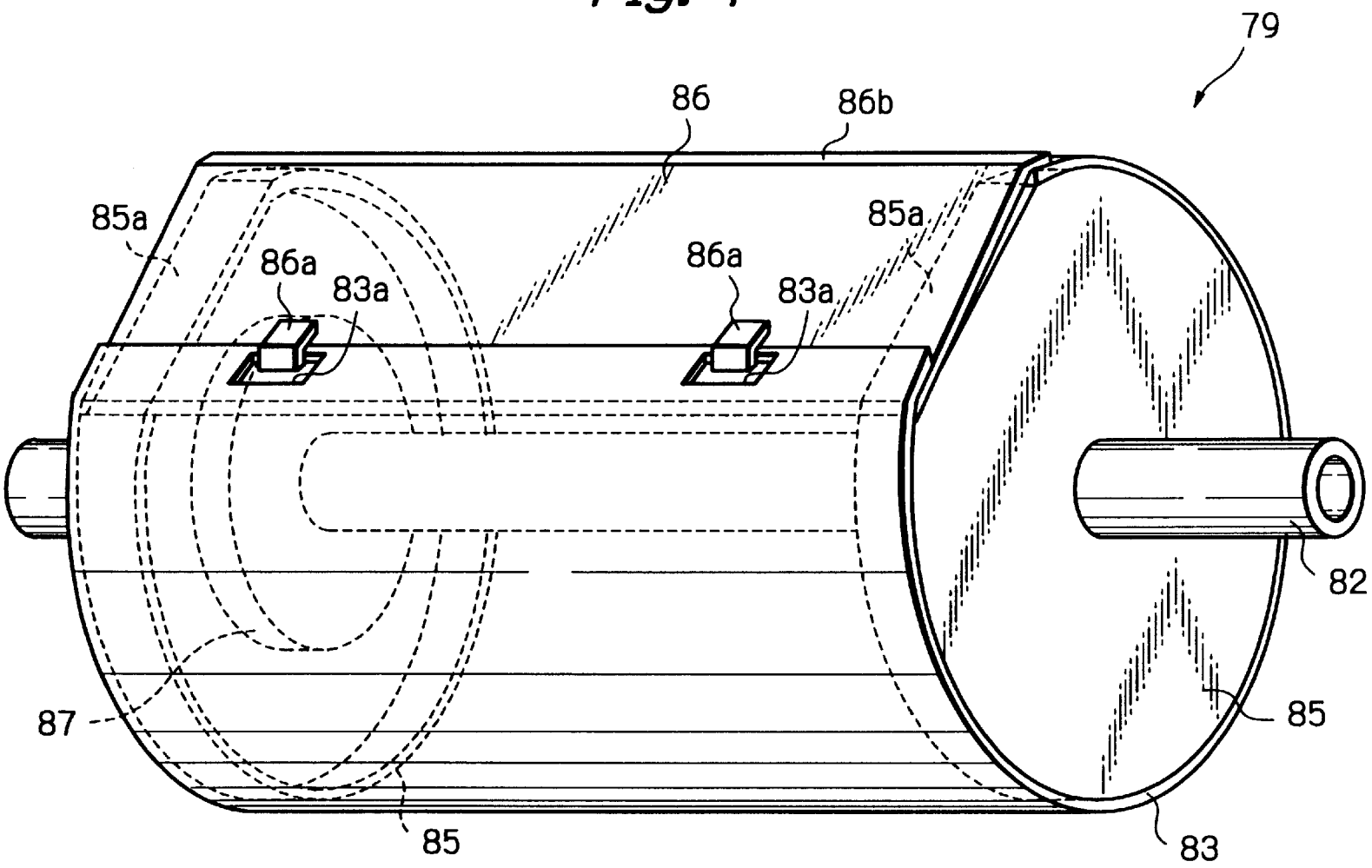
FIG. 4 is a perspective view of an ink drum included in the first embodiment.
Figure 5:
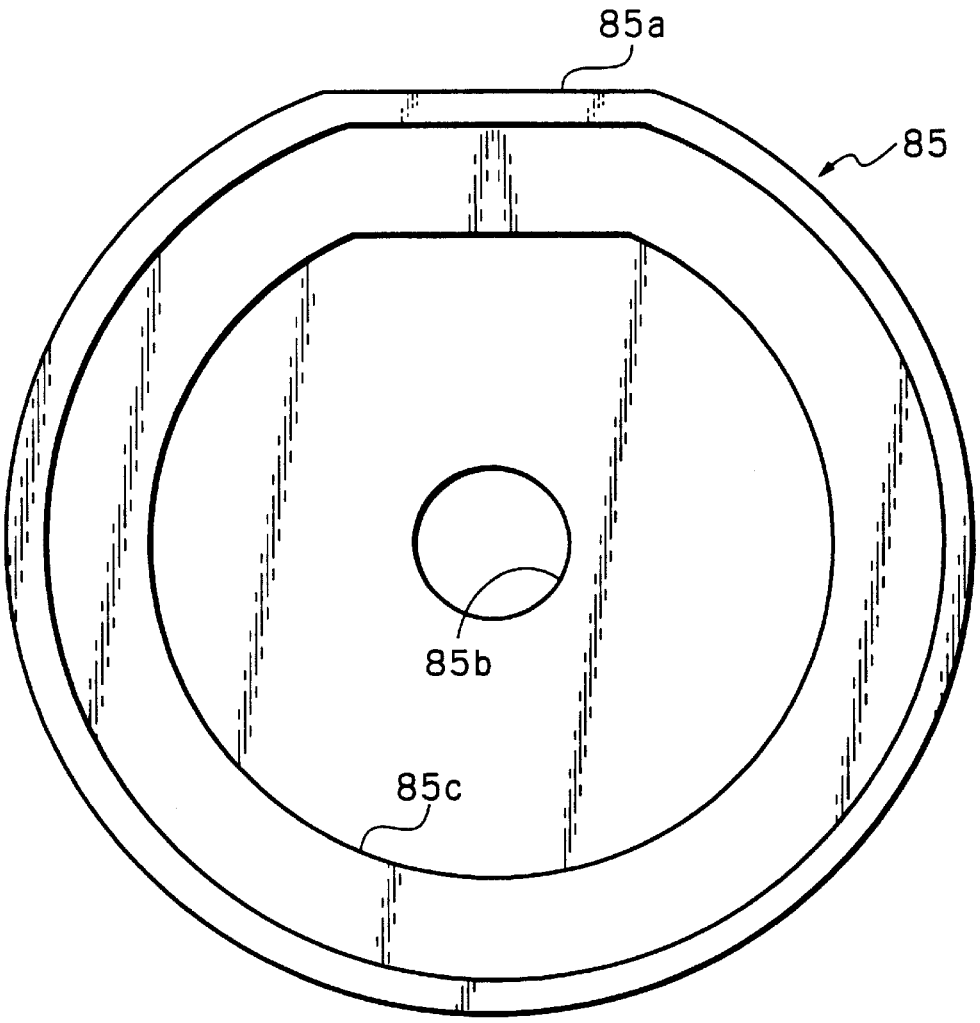
FIG. 5 is a front view of a flange forming a part of the ink drum.
Figure 6:
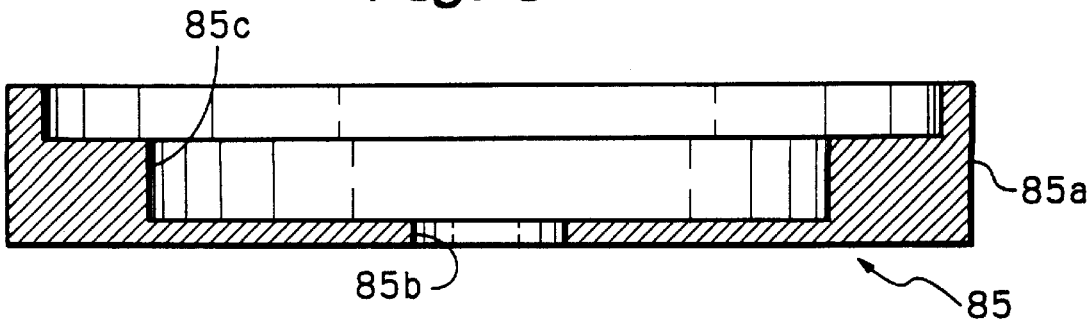
FIG. 6 is a vertical section of the flange.

Specifically, as shown in FIG. 4, two flanges 85 symmetrical in the right-and-left direction are rotatably mounted on opposite end portions of the shaft 82 via bearings that will be described. As shown in FIGS. 5 and 6, the flanges 85 each has a part of its circumference implemented as a flat portion 85*a*. A hole 85*b* greater than the contour of the shaft 82 is formed in the center of the flange 85. A cam portion 85*c* similar in configuration to the contour of the flange 85 is formed in the inner surface of the flange 85.

Figure 7:
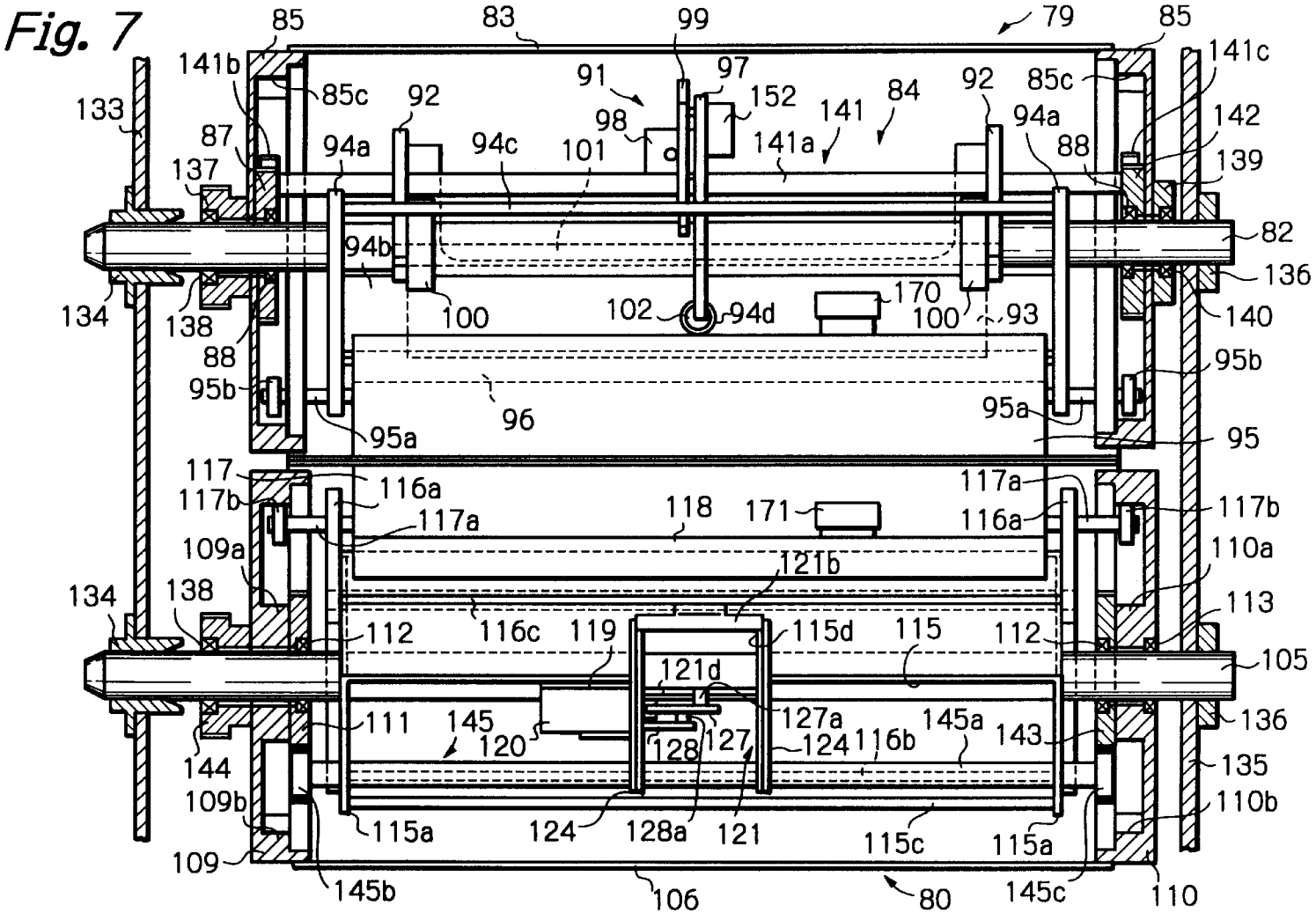
FIG. 7 is a fragmentary section showing a printing section included in the first embodiment.

As shown in FIG. 7, identical gears 87 and 142 are respectively mounted on the flanges 85 radially inward of the cam portions 85*c*. The flanges 85 are rotatably mounted on the shaft 82 via bearings 88 affixed to the gears 87 and 142 such that their flat portions 85*a* lie in the same plane. A stage 86 is affixed to the flat portions 85*a* by, e.g., screws and has a bent portion 86*b* at one end. Two hook-shaped pieces 86*a* are affixed to the stage 86 at a preselected distance from each other.

The porous support plate 83 is wrapped around the flanges 85 with opposite ends thereof contacting the flanges 85. The support plate 83 is implemented by a thin metal sheet formed with a great number of pores therein. Two holes 83*a* are formed in one end portion of the support plate 83 in positions corresponding to the pieces 86*a* and are respectively engaged with the pieces 86*a*. The other end of the support plate 83 is held between the circumferences of the flanges 85 and the bent portion 86*b* of the stage 86. In this configuration, when a stress tending to increase the radius of the support plate 83 acts from the inside of the ink drum 79, the support plate 83 is easily displaceable radially away from the circumferences of the flanges 85.

Figure 8:
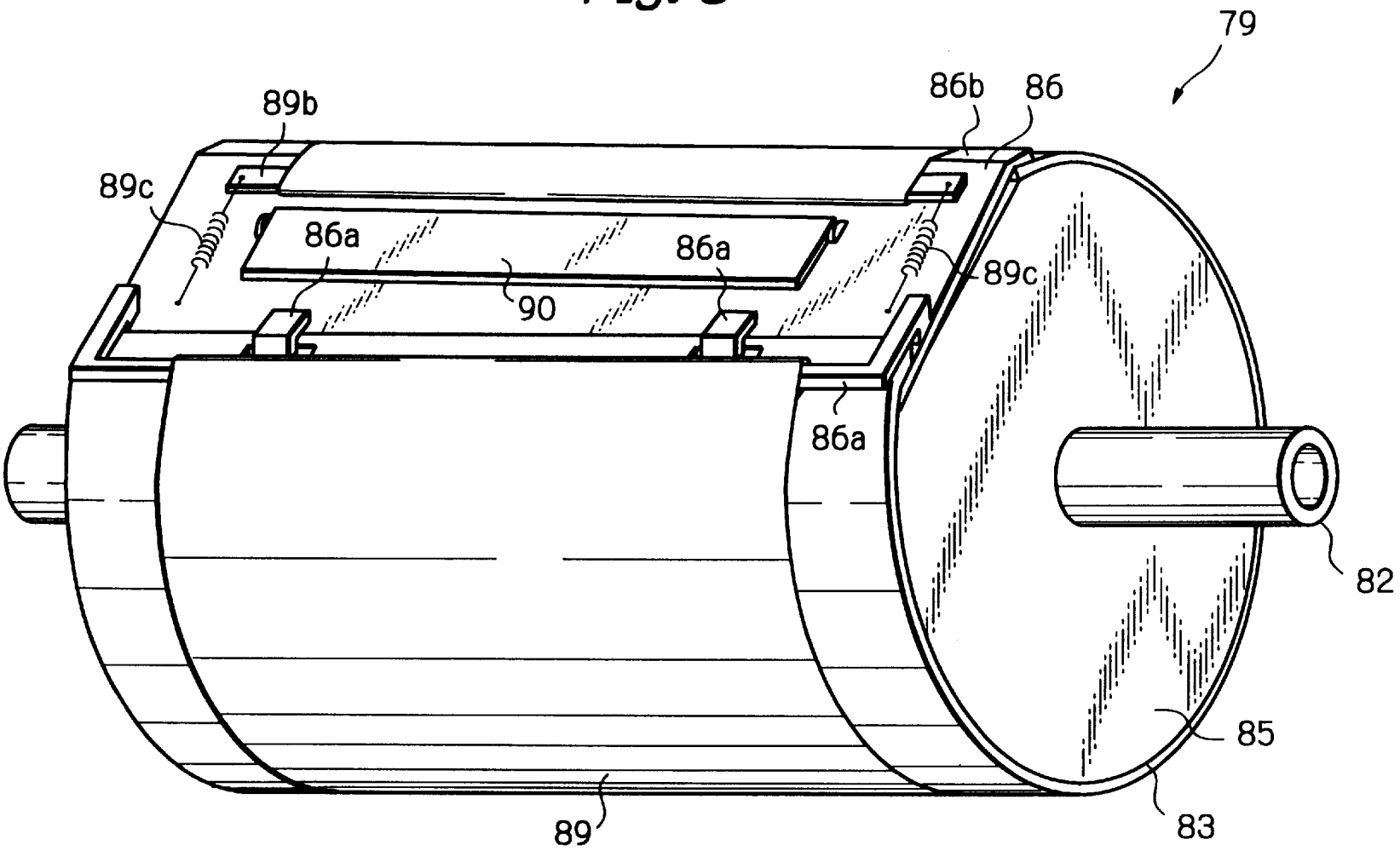
FIG. 8 is an external perspective view showing the ink drum of the first embodiment.

As shown in FIG. 8, a mesh screen 89 is wrapped around the above support plate 83 and formed of resin or metal. A thin mount plate 89*a* and a thin movable mount plate 89*b* are respectively affixed to opposite ends of the mesh screen 89, as illustrated. The mount plate 89*a* is affixed to the stage 86 by, e.g., screws while the movable mount plate 89*b* is movably retained by the stage 86 via two tension springs 89*c*. The mesh screen 89 is therefore displaceable radially away from the circumferences of the flanges 85 like the support plate 83.

A damper 90 for clamping the leading edge of the stencil or master 33 has its one end pivotally supported by the stage 86. A magnet, not shown, is fitted on the other or free end of the damper 90 and allows the damper 90 to magnetically contact the stage 86. When the ink drum 79 is set in the casing 23, the damper 90 is opened and closed at a preselected position by opening and closing means not shown.

Figure 9:
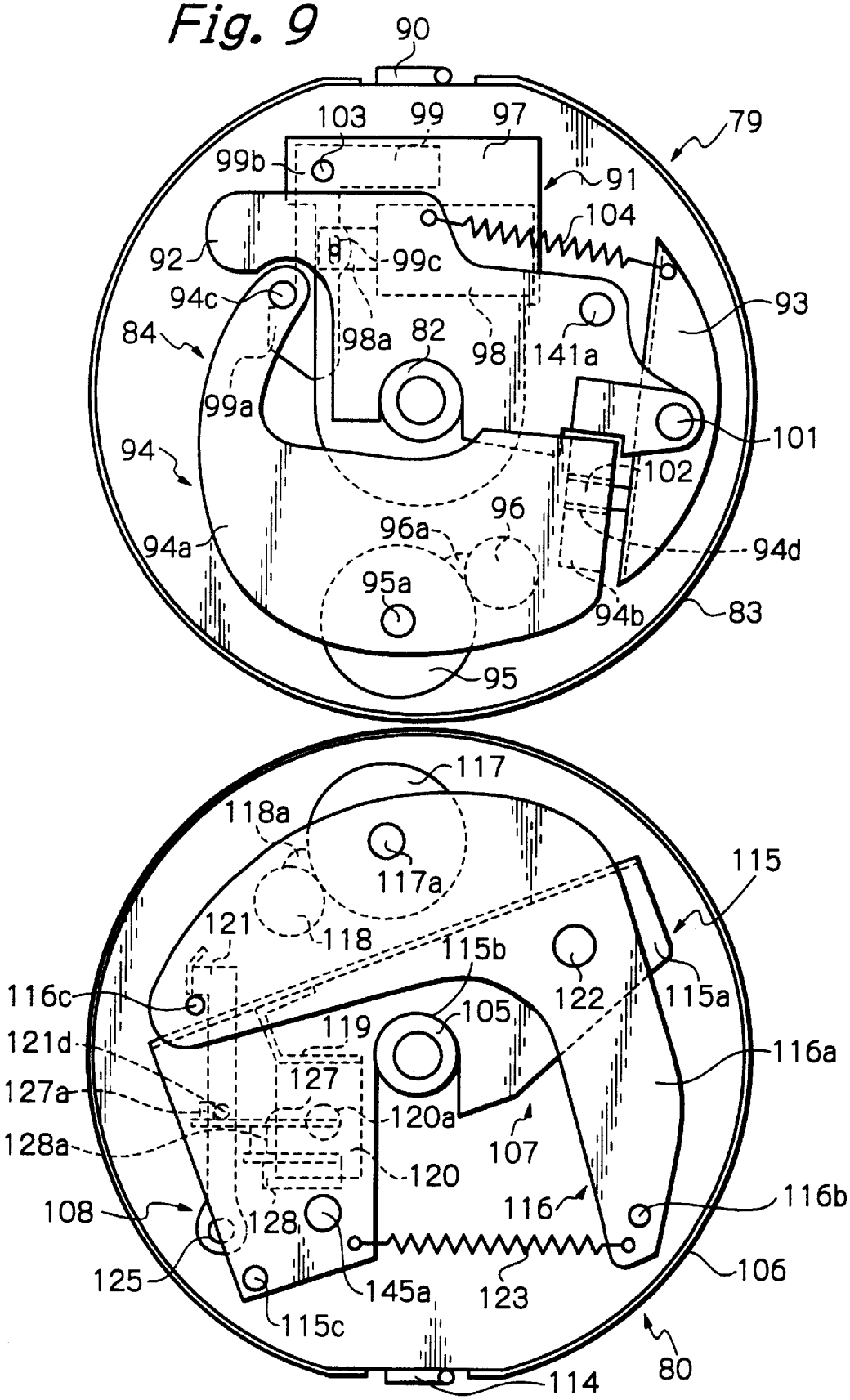
FIG. 9 is a fragmentary side elevation showing the printing section in an inoperative condition.

As shown in FIGS. 7 and 9, the ink feeding means 84 and ink roller moving means 91 are disposed in the ink drum 79. The ink feeding means 84 includes a pair of flat bases 92, a first support member 93, a second support member or ink roller support member 94, a first ink roller 95, and a doctor roller 96. The ink roller moving means 91 mainly consists of a support plate 97, a solenoid 98, and a stop 99. The bases 92 are mounted on the shaft 82 at a preselected distance from each other, and each is affixed to the shaft 82 by a respective mount member 100.

Figure 10:
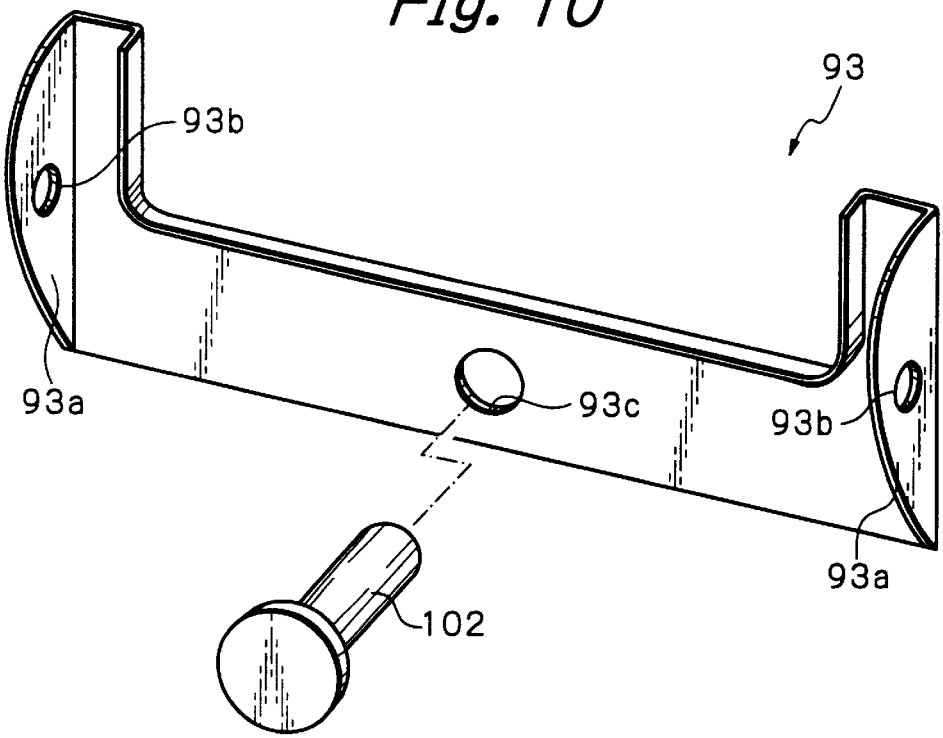
FIG. 10 is a perspective view showing a first support member included in the printing section.

The first support member 93 intervenes between the two bases 92. As shown in FIG. 10, the first support member 93 has ears 93*a* and 93*b* at opposite sides thereof. The ears 93*a* and 93*b* each is formed with a hole 93*b*. A hole 93*c* is formed in the intermediate portion of the support member 93 for receiving a shaft 102. A shaft 101 is passed through the holes 93*b* and allows the support member 93 to rotate thereabout. A tension spring 104 is anchored at one end to one of the bases 92 and at the other end to the support member 93. The tension spring 104 constantly biases the support member 93 in the counterclockwise direction, as viewed in FIG. 9, about the shaft 101. The bias of the tension spring 104 is selected to be greater than the bias of the tension springs 89*c*.

The second support member 94 mainly consists of two side plates 94*a* positioned outside of the bases 92, a reinforcing member 94*b* connecting the side plates 94*a*, and a locking rod 94*c* positioned between the side plates 94*a*. The support member 94 is rotatably mounted on a shaft 102 via a bearing 94*d* positioned at the center of the reinforcing member 94*b*.

The ink roller 95 is positioned between the side plates 94*a* and rotatably supported by the side plates 94*a* via a shaft 95*a*. Drive means, not shown, causes the ink roller 95 to rotate in the same direction as the ink drum 79. Two cam followers 95*b* are mounted on opposite ends of the shaft 95*a* and respectively held in contact with the cam portions 85*c*. When the cam followers 95*b* contact protuberances included in the associated cam portions 85*c*, the circumference of the ink roller 95 is moved away from the inner periphery of the porous support plate 83. As soon as the cam followers 95*b* leave the above protuberances, the circumference of the ink roller 95 protrudes outward from the circumferences of the flanges 85.

The doctor roller 96 is positioned such that its circumference adjoins the circumference of the ink roller 95. The doctor roller 96 is rotatably supported by the side plates 94*a* and caused to rotate in the opposite direction to the ink roller 95 by drive means not shown. Ink fed via the shaft or main pipe 82 and a feed pipe 120, which will be described later, forms a generally wedge-shaped ink well 96*a* in the vicinity of the circumference of the ink roller 95 and that of the doctor roller 96.

As shown in FIG. 7, a sensor or ink sensing means 170 is positioned above the ink well 96*a* in order to determined the amount of ink existing in the ink well 96*a*. The sensor 170 is affixed to the side plate 94*a* via an affixing member not shown.

The support plate 97 is mounted on the shaft 82 between the bases 92 by mount members, not shown, similar to the mount member 100. The solenoid 98 and stop 99 and a sensor 152 are mounted on the support plate 97. The stop 99 has one end 99*a* implemented as an outwardly bent hook engageable with the locking rod 94*c*. The stop 99 has its bent port ion 99*b* rotatably supported by a shaft 103. An elongate slot 99*c* is formed in the stop 99 between the end 99*a* and the bent portion 99*b*. The stop 99 is connected to the plunger 98*a* of the solenoid 98 via the slot 99*c*. Biasing means, not shown, constantly biases the stop 99 in the clockwise direction, as viewed in FIG. 9, about the shaft 103. The sensor 152 determines the position of the ink roller 95 in terms of the position of the locking rod 94*c* and is implemented by a microswitch.

The ink drum 80 is positioned below the ink drum 79. A shaft or main pipe 105 is positioned at the center within the ink drum 80. A porous support plate or second master support plate 106 is wrapped around the ink drum 80. Second ink feeding means 107 and ink roller moving means 108 are arranged in the ink drum 80. The ink drum 80 is positioned such that the circumference of the porous support plate 106 is spaced from the circumference of the porous support plate 83 by a preselected gap of about 2 mm to 3 mm.

Flanges 109 and 110 substantially identical with the flanges 85 are rotatably mounted on opposite end portions of the shaft 105 via bearings and are substantially symmetrical in the right-and-left direction. The flanges 109 and 110, like the flanges 85, have flat portions, not shown, and cam portions 109*b* and 110*b*, respectively. The difference is that, as shown in FIG. 7, the flanges 109 and 110 include bosses 109*a* and 110*a*, respectively. Identical gears 111 and 143 are mounted on the bosses 109*a* and 110*a*, respectively. The flange 109 is rotatably mounted on the shaft 105 via a bearing 112 affixed to the gear 111. The flange 110 is rotatably mounted on the shaft 105 via a bearing 112 affixed to the gear 143 and a bearing 113 affixed to the flange 110.

The flanges 109 and 110, like the flanges 85, are positioned on the shaft 105 such that their flat portions lie in the same plane. A stage, not shown, is mounted on the flat portions of the flanges 109 and 110 and includes hook-like pieces, not shown, and a damper 114. The porous support plate 106 and a mesh screen, not shown, are wrapped around the flanges 109 and 110 in such a manner as to be displaceable radially outward of the circumferences of the flanges 109 and 110.

The ink feeding means 107 and ink roller moving means 108 are disposed in the ink drum 80. The ink feeding means 107 includes a base 115, an ink roller support member 116, a second ink roller 117, and a doctor roller 118. The ink roller moving means 108 includes a support member 119, a solenoid 120, and a stop 121.

Figure 11:
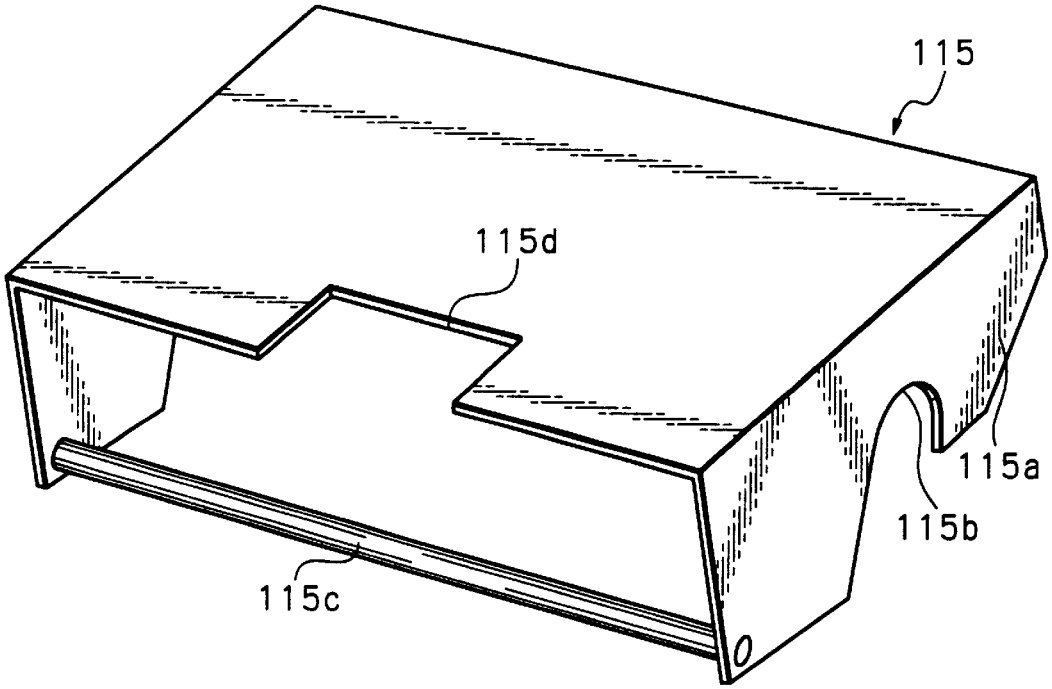
FIG. 11 is a perspective view showing a base included in the printing section.

As shown in FIG. 11, the base 15 has opposite side walls 115*a* each of which is formed with a generally U-shaped notch 115*b* for receiving the shaft 105. A rod 115*c* connects the front portions of the two side walls 115*a* for reinforcement. A notch 115*d* is formed in the intermediate portion of the front end of the base 115. The base 115 is fixed in place by mount members similar to the mount members 100 with the notches 115*b* receiving the shaft 105.

The ink roller support member 116 includes two side plates 116*a* positioned outside of the opposite side walls 115*a* of the base 115, a tie rod 116*b* connecting the side plates 116*a*, and a locking rod 116*c* positioned between the side plates 116*a*. The support member 116 is angularly movably mounted on the base 115 via a shaft 122. A tension spring 123 is anchored at one end to the base 115 and at the other end to the support member 116. The tension spring 123 constantly biases the support member 116 in the clockwise direction, as viewed in FIG. 9, about the shaft 122. The bias of the tension spring 123 is selected to be greater than the bias of the tension springs 104.

The ink roller 117 is positioned between the side plates 116*a* and rotatably supported by the side plates 116*a* via a shaft 117*a*. Drive means, not shown, causes the ink roller 117 to rotate in the same direction as the ink drum 80. Two cam followers 117*b* are mounted on opposite ends of the shaft 117*a* and respectively held in contact with the cam portions 109*b* and 110*b*. When the cam followers 117*b* contact protuberances included in the associated cam portions 109*b* and 110*b*, the circumference of the ink roller 117 is moved away from the inner periphery of the porous support plate 106. As soon as the cam followers 117*b* leave the above protuberances, the circumference of the ink roller 117 protrudes outward from the circumferences of the flanges 109 and 110.

The doctor roller 118 is positioned such that its circumference adjoins the circumference of the ink roller 117. The doctor roller 118 is rotatably supported by the side plates 116*a* and caused to rotate in the opposite direction to the ink roller 117 by drive means not shown. Ink fed via the shaft or main pipe 105 and an ink feed pipe 130, which will be described later, forms a generally wedge-shaped ink well 118*a* in the vicinity of the circumference of the ink roller 117 and that of the doctor roller 118.

As shown in FIG. 7, a sensor or ink sensing means 171 is positioned above the ink well 118*a* in order to determined the amount of ink existing in the ink well 118*a*. The sensor 171 is affixed to the side plate 116*a* via an affixing member not shown.

The support member 119 formed by bending a flat member is affixed to the inner periphery of the base 115 by, e.g., screws. The solenoid 120 is mounted on the support member 119.

Figure 12:
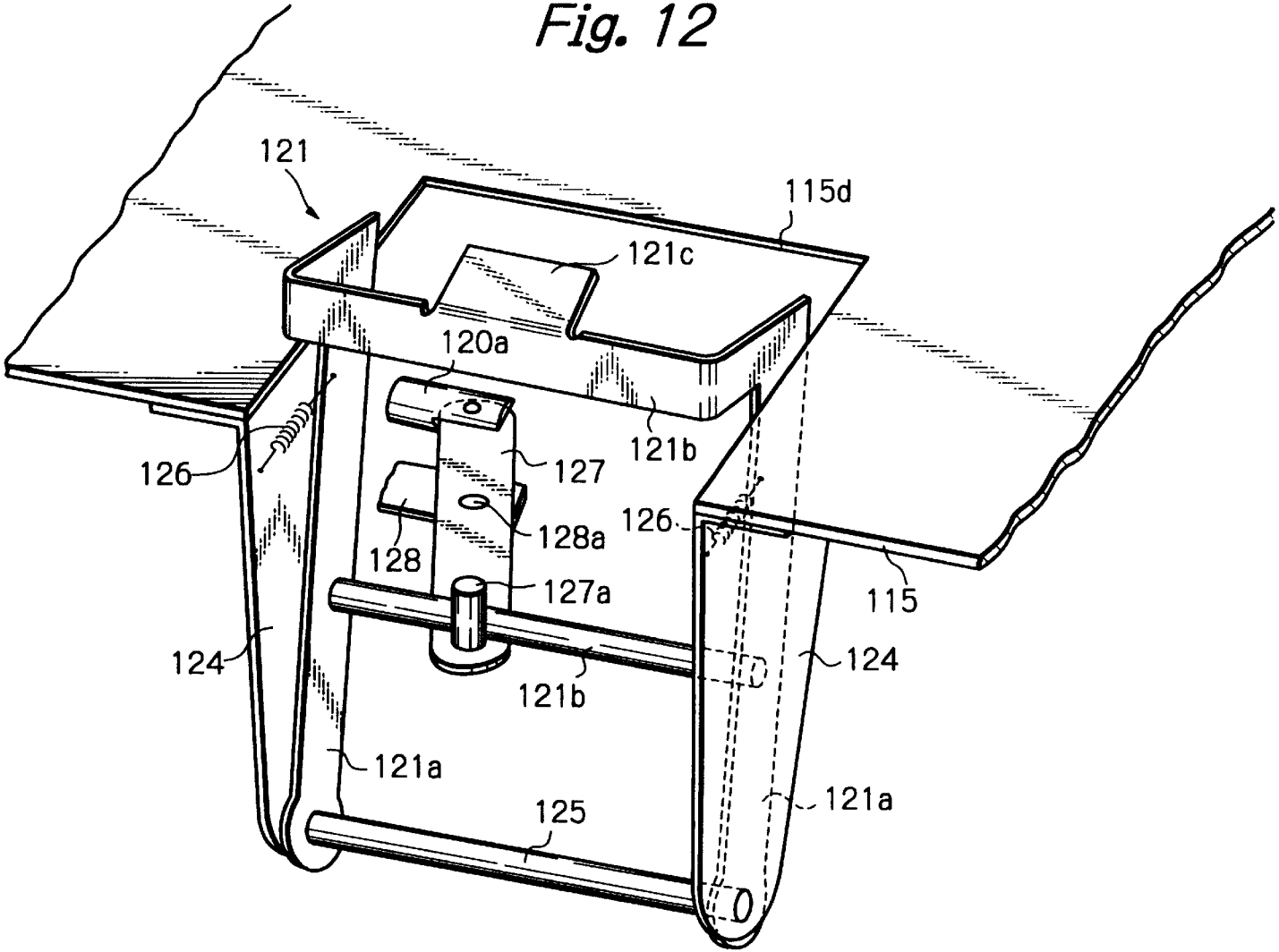
FIG. 12 is a perspective view of a stop included in the printing section.

As shown in FIG. 12, the stop 121 is made up of two legs 121*a*, a projecting portion 121*b*, a tongue 121*c*, and a tie rod 121*d*. The legs 121*a* are rotatably supported by two brackets 124 via a shaft 125. The brackets 124 are affixed to the base 115. Tension springs 126 are respectively anchored to the two legs 121*a* and two brackets 124. The tension springs 126 constantly bias the stop 121 in the counterclockwise direction, as viewed in FIG. 9, about the shaft 125. The projecting portion 121*b* connects the two legs 121*a* and projects from the legs 121*a*. The projecting portion 121*b* is engageable with the locking rod 116*c* at its stepped portions merging into the legs 121*a*. The tongue 121*c* protrudes from the projecting portion 121*b* and is so positioned as to contact the locking rod 116*c* when the ink roller support member 116 rotates. The tie rod 121*d* is affixed to substantially the centers of the legs 121*a* at its opposite ends. An operating piece 127 is angularly movably supported at one end by a plunger 120*a* extending out from the solenoid 120. A pin 127*a* is studded on the other end of the operating piece 127 and engaged with the tie rod 121*d*. The operating piece 127 is angularly movably supported by a shaft 128*a* which is mounted on a mount member 128 affixed to the solenoid 120.

The feed pipe 129 and a feed pipe 130 are respectively disposed in the ink drums 79 and 80 for feeding ink from the shaft or main pipe 82 and a shaft or main pipe 105 to the ink well 96*a* and an ink well 118*a*. The feed pipes 129 and 130 each has a single inlet port and four branched outlet ports. Feed pumps 265 and 266 (see FIG. 15) are respectively assigned to the ink drum 79 and 80 and deliver ink under pressure from an ink pack, not shown, to the feed pipes 129 and 130. The ink is fed from the feed pipes 129 and 130 to the ink wells 96*a* and 118*a*, respectively.

As shown in FIG. 7, the shafts 82 and 105 of the ink drums 79 and 80, respectively, each is affixed at one end to a respective positioning member 134 mounted on a side wall 133 which forms a part of the casing 23. The other end of each of the shafts 82 and 105 is supported by a respective mount member 136 via a side wall 135 removably mounted to the casing 23. In this configuration, the shafts 82 and 105 are positioned relative to the casing 23. Toothed pulleys 137 and 144 are respectively rotatably mounted on one end portions of the shafts 82 and 105 outside of and integrally with the flanges 85 and 109 via bearings 138. A spacer 139 is rotatably mounted on the other end portion of the shaft 82 outside of and integrally with the flange 85 via a bearing 140, forming a gap between the side wall 135 and the flange 85.

Rotation transmitted to the toothed pulley 137 is applied to a transmission member 141 disposed in the ink drum 79. The transmission member 141 transfers the rotation from one flange 85 to the other flange 85 via the gears 87 and 142. The transmission member 141 is made up of a shaft 141*a* rotatably supported by the two bases 92 and gears 141*b* and 141*c* mounted on opposite ends of the shaft 141*a*. The gears 141*b* and 141*c* are held in mesh with the gears 87 and 142, respectively. Rotation transmitted to the other toothed pulley 144 is applied to a transmission member 145 disposed in the ink drum 80. The transmission member 145 transfers the rotation from one flange 109 to the other flange 110 via gears 111 and 143. The transmission member 145 is made up of a shaft 145*a* rotatably supported by the opposite side walls 115*a* and gears 145*b* and 145*c* mounted on opposite ends of the shaft 145*a*. The gears 145*b* and 145*c* are held in mesh with the gears 111 and 143, respectively.

Figure 13:
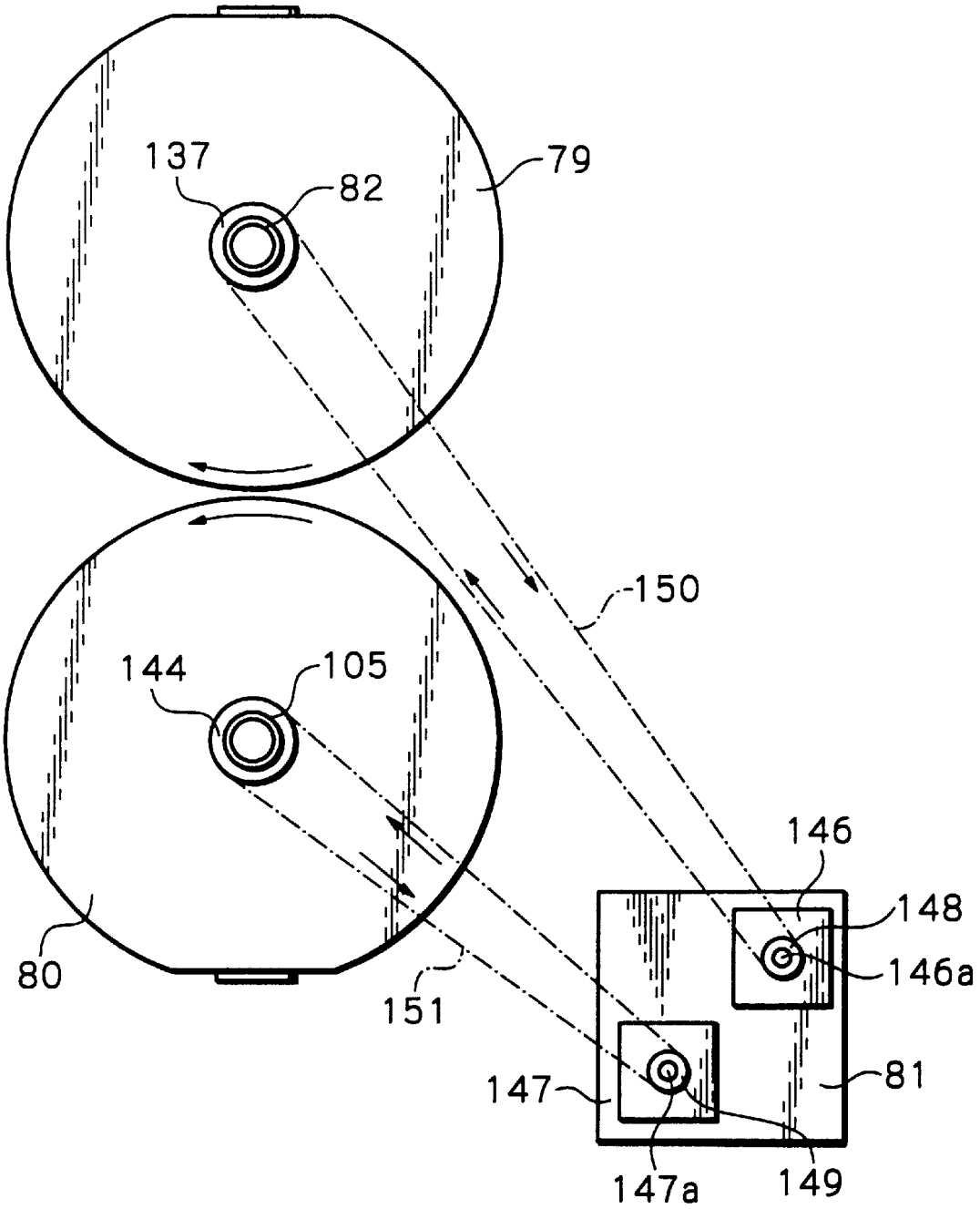
FIG. 13 shows drum drive means included in the first embodiment.

The drum drive means 81 is positioned below and at the right-hand side of the ink drum 80. As shown in FIG. 13, the drum drive means 81 includes two motors 146 and 147 rotatable in opposite directions to each other. Toothed pulleys 148 and 149 are respectively mounted on the output shafts 146*a* and 147*a* of the motors 146 and 147. Timing belts 150 and 151 are respectively passed over the toothed pulleys 148 and 137 and the toothed pulleys 149 and 144. The rotation of the motor and that of the motor 147 are respectively transmitted to the ink drums 79 and 80 via the timing belts 150 and 151, causing them to rotate in opposite directions in synchronism with each other.

Figure 14:
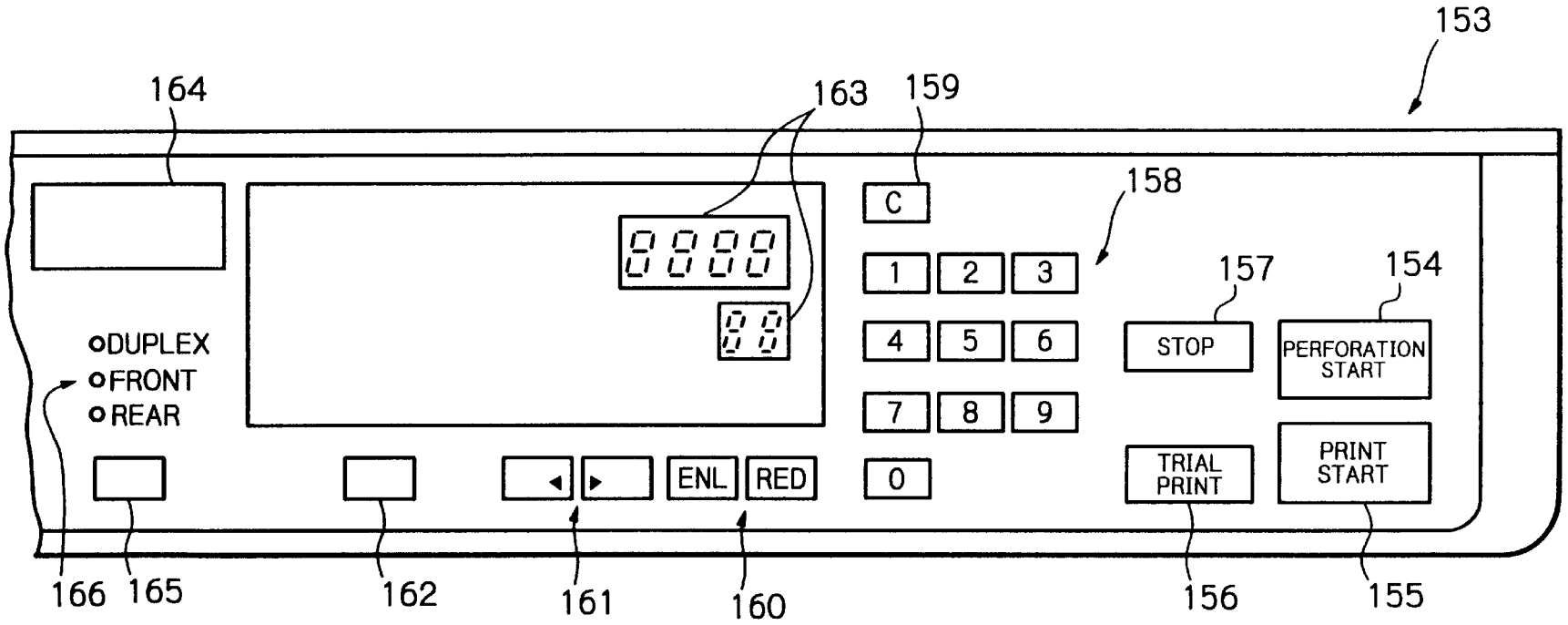
FIG. 14 is a fragmentary enlarged view showing a specific configuration of an operation panel included in the first embodiment.

An operation panel 153 is positioned at the front portion of the top of the casing 23. As shown in FIG. 14 specifically, various conventional keys including a perforation start key 154, a print start key 155, a trial print key 156, a stop key 157, numeral keys 158, a clear key 159, an enlarge (ENL) and a reduce (RED) key 160, a print speed key 161 and a continuous print key 162 are arranged on the operation panel 153. Also arranged on the operation panel 153 are a display 163 implemented by seven-segment LEDs (Light Emitting Diodes) and a display 164 implemented by an LCD (Liquid Crystal Display). In the illustrative embodiment, the operation panel 153 additionally includes a print mode key 165 and print mode display means 166. The print mode key 165 allows the operator to select desired one of a duplex print mode for printing images on both sides of a paper, a front print mode for printing an image on the front of a paper, and a rear print mode for printing an image on the rear of a paper. The print mode display means 166 displays the print mode selected on the print mode key 165 and is implemented by LEDs. A timer, 267 (see FIG. 15) is built in the operation panel 153 for counting a period of time elapsed since the end of the last printing operation to the next operation of the perforation start key 154.

The control section 10 disposed in the casing 23 includes the control means 169 implemented by a conventional microcomputer including a CPU (Central Processing Unit), a ROM (Read Only Memory), a RAM (Random Access Memory), etc. The control section 10 controls the operation of the entire printer 1. The control means 169 serves as a part of the first and second ink collecting means 250 and 270 as well, as stated earlier.

Figure 15:
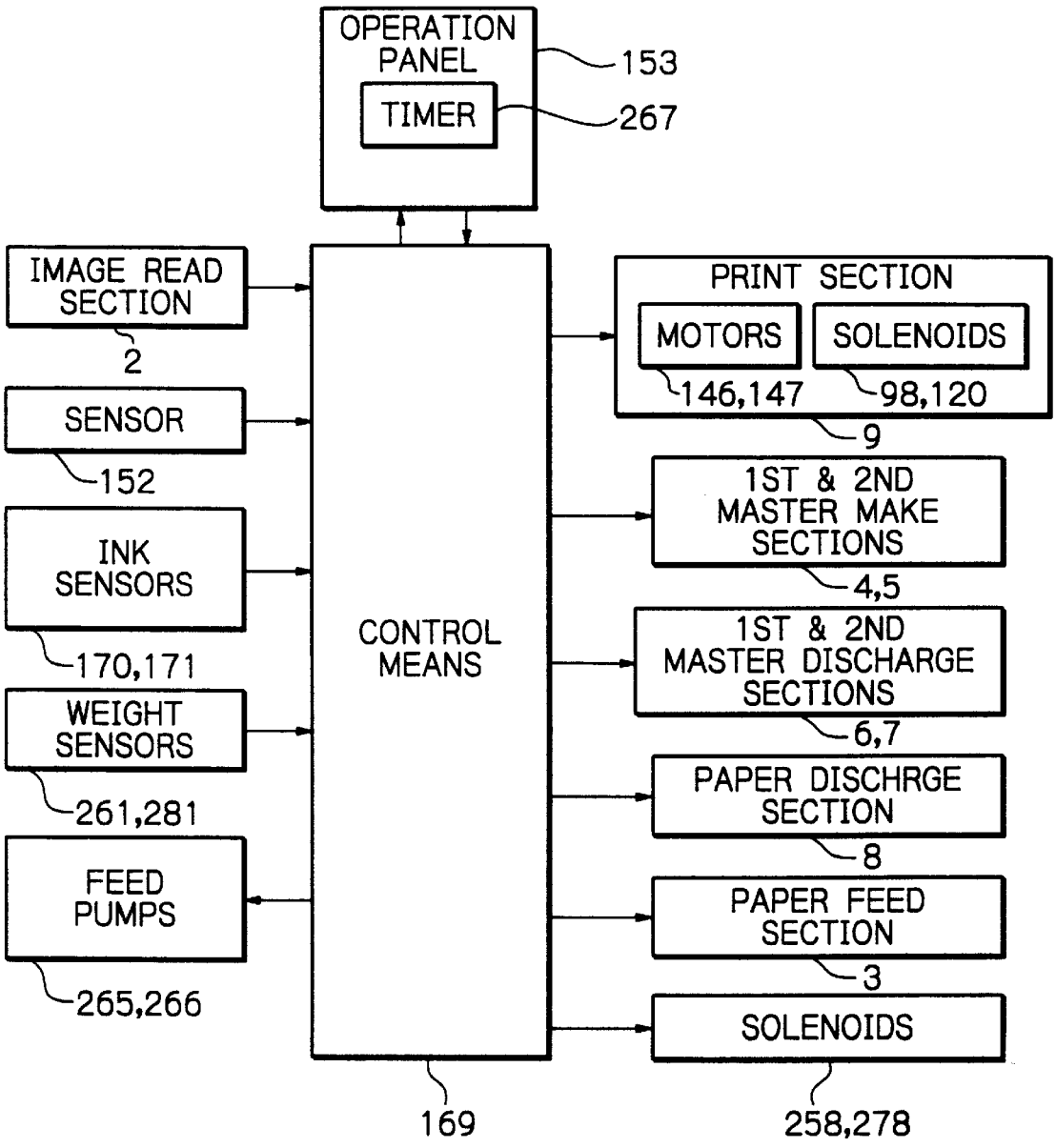
FIG. 15 is a block diagram schematically showing control means included in the first embodiment.

As shown in FIG. 15, the control means 169 receives an image data signal output from the image reading section 2, a signal output from the sensor 152, signals output from the ink sensors 170 and 171, signals output from the weight sensors 261 and 281, and control signals output from the operation panel 153. In response, the control means 169 controls, based on an operation program stored in the above ROM, the paper feeding section 3, first and second master making sections 4 and 5, first and second master discharging sections 6 and 7, paper discharging section 8, feed pumps 265 and 266, solenoids 258 and 278, and printing section 9. As for the printing section 9, the control means 169 controls the drum drive means 81 including the motors 146 and 147, ink roller moving means 91 including the solenoid 98, and ink roller drive means 108 including the solenoid 120.

The operation of the printer 1 will be described hereinafter. The operator stacks two documents on a document tray, not shown, and then presses the perforation start key 154. At this instant, the timer 267 started to operate at the end of the last printing operation stops operating and sends a signal representative of the period of time which it counted to the control means 169. In response, the control means 169 compares the period of time with a threshold value stored in the ROM. If the period of time counted by the timer exceeds the threshold value, the control means 169 determines that the printer 1 has been left unused over a long time, and calls an operation program assigned to such a condition out of the ROM. If the above period of time does not exceed the threshold value, the control means 169 calls an operation program assigned to usual printing out the ROM.

A usual print mode will be descried first. The usual print mode includes a duplex print mode and a simplex print mode which, in turn, is made up of a front print mode and a rear print mode.

In the duplex print mode, the operator presses the print mode key 165 so as to select the duplex print mode and then presses the perforation start key 154. In response, the motor 146 is energized to rotate the ink drum 79 counterclockwise. The upper and lower discharge members 47 and 48, respectively, cooperate to peel off a used master 167 from the outer periphery of the ink drum 79. The used master 167 removed from the ink drum 79 is introduced into the box 49 and then compressed by the compressor 50. The motor 147 starts rotating at the same time as the ink drum 79 and causes the ink drum 80 to rotate clockwise. The upper and lower discharge members 57 and 58, respectively, cooperate to peel off a used master 168 from the outer periphery of the ink drum 80. The used master 168 is introduced into the box 59 and then compressed by the compressor 60. The ink drum 79 and 80 each is brought to a stop on reaching the respective position for waiting for a master.

After the discharge of the used masters 167 and 168, the roller pair 12 included in the image reading section 2 start rotating and feed upper one of the two documents to the glass platen 11. While the document is conveyed along the glass platen 11, the fluorescent lamp 20 illuminates the document. The resulting imagewise reflection from the document is reflected by the mirrors 18 and 19 and then focused by the lens 21 on the image sensor 22. The image sensor 22 outputs an electric image signal by photoelectric conversion. The image signal is input to an analog-to-digital (AD) converter, not shown, disposed in the casing 23. The document scanned by the image reading section 2 is driven out to a tray, not shown, positioned above the belt 16 by the belt 16 and roller 13.

The first master making section 4 perforates the stencil 33 in parallel with the above document reading operation. Specifically, after the discharge of the used masters 167 and 168, the platen roller 36 and roller pairs 38 and 39 start rotating in order to pay out the stencil 33 from the roll 34. The thermal head 35 perforates the stencil 33 being conveyed. That is, a number of heating elements arranged on the head 35 selectively generate heat in accordance with a digital image signal routed through the AD converter and an image processing section not shown. As a result, a thermoplastic resin film forming a part of the stencil 33 is selectively perforated by heat.

Assume that the control means 169 determines, based on the number of steps of a stepping motor, not shown, driving the platen roller 36, that the leading edge of the stencil 33 has reached a preselected position between the stage 86 and the damper 90. Then, the control means 169 sends a signal to the opening and closing means in order to close the damper 90 toward the stage 86. As a result, the leading edge of the stencil 33 is clamped by the stage 86 and damper 90.

The ink drum 79 is rotated clockwise, as viewed in FIG. 1, at a peripheral speed equal to the speed at which the stencil 33 is conveyed, so that the stencil 33 is sequentially wrapped around the ink drum 79. When the control means 169 determines, again based on the number of steps of the stepping motor, that the stencil 33 has been perforated over an area corresponding to a single master, it stops the rotation of the platen roller 39 and roller pairs 38 and 39. At the same time, the control means 169 causes the movable edge 37*a* to rotate and cut off the perforated part of the stencil 33, i.e., a master. The master, also labeled 33, is pulled out by the rotation of the ink drum 79. When the ink drum 79 again reaches its home position, the control means 169 deenergizes the motor 146 and thereby positions the ink drum 79.

Subsequently, the roller pair 12 again starts rotating and conveys the other document along the glass platen 11. The document is read in the same manner as the previous document and then driven out to the tray. To read a single document carrying images on both sides thereof, as distinguished from the above two documents, after one side of the document has been read, the belt 16 and roller 13 start rotating. At the same time, the path selector 17 is angularly moved counterclockwise by a mechanism, not shown, so as to steer the document toward the glass platen 11. As a result, the other side of the document is read.

The second master making section 5 operates in the same manner as the first master making section 4 in parallel with the operation for reading the second document. Specifically, after the discharge of the used master, the platen roller 43 and roller pairs 45 and 46 start rotating in order to pay out the stencil 40 from the roll 41. The stencil 40 is perforated by the thermal head 42 in the same manner as the stencil 33 is perforated by the thermal head 35.

Assume that the control means 169 determines, based on the number of steps of a stepping motor, not shown, driving the platen roller 43, that the leading edge of the stencil 40 has reached a preselected position. Then, the control means 169 sends a signal to the opening and closing means in order to close the damper 114 toward the associated stage. As a result, the leading edge of the stencil 40 is clamped by the stage and damper 114.

The ink drum 80 is rotated clockwise, as viewed in FIG. 1, at a peripheral speed equal to the speed at which the stencil 40 is conveyed, so that the stencil 40 is sequentially wrapped around the ink drum 80. When the control means 169 determines, again based on the number of steps of the stepping motor, that the stencil 40 has been perforated over an area corresponding to a single master, it stops the rotation of the platen roller 43 and roller pairs 45 and 46. At the same time, the control means 169 causes the movable edge 44*a* to rotate and cut off the perforated part of the stencil 40, i.e., a master. The master, also labeled 40, is pulled out by the rotation of the ink drum 80. When the ink drum 80 again reaches its home position, the control means 169 deenergizes the motor 147 and thereby positions the ink drum 80.

When the masters 33 and 40 have been respectively wrapped around the ink drums 79 and 80, the pick-up roller 25 and separator rollers 26 and 27 rotate while the motors 146 and 147 start operating. As a result, a single paper P is fed from the top of the stack loaded on the paper tray 24 toward the registration roller pair 30, and the ink drums 79 and 80 start rotating at a low speed. The registration roller pair 30 nips the leading edge of the paper P and then drives it to a position between the ink drums 79 and 80 at a preselected timing.

The ink rollers 95 and 117 disposed in the ink drums 79 and 80, respectively, are rotated by drive means, not shown, and then caused to angularly move in accordance with the rotation of the associated drums 79 and 80. Specifically, while the solenoid 98 is energized, the ink drum 79 (flanges 85) is rotated. When the protuberances of the two cam portions 85*c* contact the associated cam followers 95*b*, the ink roller 95 is moved upward, as viewed in FIG. 9, forming a clearance between one end 99*a* of the stop 99 and the locking rod 94*c*. Then, the plunger 98*a* is pulled into the solenoid 98 in order to cause the stop 99 to rotate counterclockwise, as viewed in FIG. 9, about the shaft 103. When the cam followers 95*b* move away from the protuberances of the associated cam portions 85*c*, the first and second support members 93 and 94 rotate counterclockwise, as viewed in FIG. 9, about the shaft 101 due to the act ion of the tension spring 104. Consequently, the circumference of the ink roller 95 contacts the porous support plate 83 and causes the support plate 83 and mesh screen 89 to bulge out downward, as viewed in FIG. 9. The control means 169 recognizes the above movement of the ink roller 95 in response to the output of the sensor 152.

Also, while the solenoid 120 is energized, the ink drum 80 (flanges 109) is rotated. When the protuberances of the two cam portions 109*b* and 110*b* contact the associated cam followers 117*b*, the ink roller 117 is moved downward, as viewed in FIG. 9, forming a clearance between the projecting portion 121*b* of the stop 121 and the A locking rod 116*c*. Then, the plunger 120*a* is pulled into the solenoid 120 in order to cause the stop 121 to rotate clockwise, as viewed in FIG. 9, about the shaft 125. When the cam followers 117*b* move away from the protuberances of the associated cam portions 109*b* and 110*b*, the ink roller support member 116 rotates clockwise, as viewed in FIG. 9, about the shaft 122 due to the action of the tension spring 123. Consequently, the circumference of the ink roller 117 contacts the porous support plate 106 and causes the support plate 106 and mesh screen, not shown, to bulge out upward, as viewed in FIG. 9.

The registration roller pair 30 feeds the paper P to the position between the ink drums 79 and 90 slightly later than the angular movement of the ink rollers 95 and 117. As a result, the ink rollers 95 and 117 contact each other with the intermediary of the porous support plates 83 and 106, mesh screen 89, mesh screen, not shown, masters 33 and 40, and paper P, transferring images to both sides of the paper P. At this instant, the second support member 94 pivots about the shaft 102, allowing the ink roller 95 to evenly contact the ink roller 117 in the axial direction. This condition is illustrated in FIGS. 7 and 16.

The paper with the images, i.e., a printing P is peeled off from the ink drum 79 or 80 by the peeler 67 or 68, guided by the guides 69 and 70, and conveyed by the paper conveyor 71 to the tray 72.

The ink drums 79 and 80 are continuously rotated even after the printing operation. After the angular movement of the ink rollers 95 and 117, the control means 169 deenergizes the solenoids 98 and 120. As a result, the stops 99 and 121 are respectively brought to positions where they abut against the locking rods 94*c* and 116*c*, as indicated by dash-and-dots lines in FIG. 16, due to the action of the associated biasing means.

Figure 16:
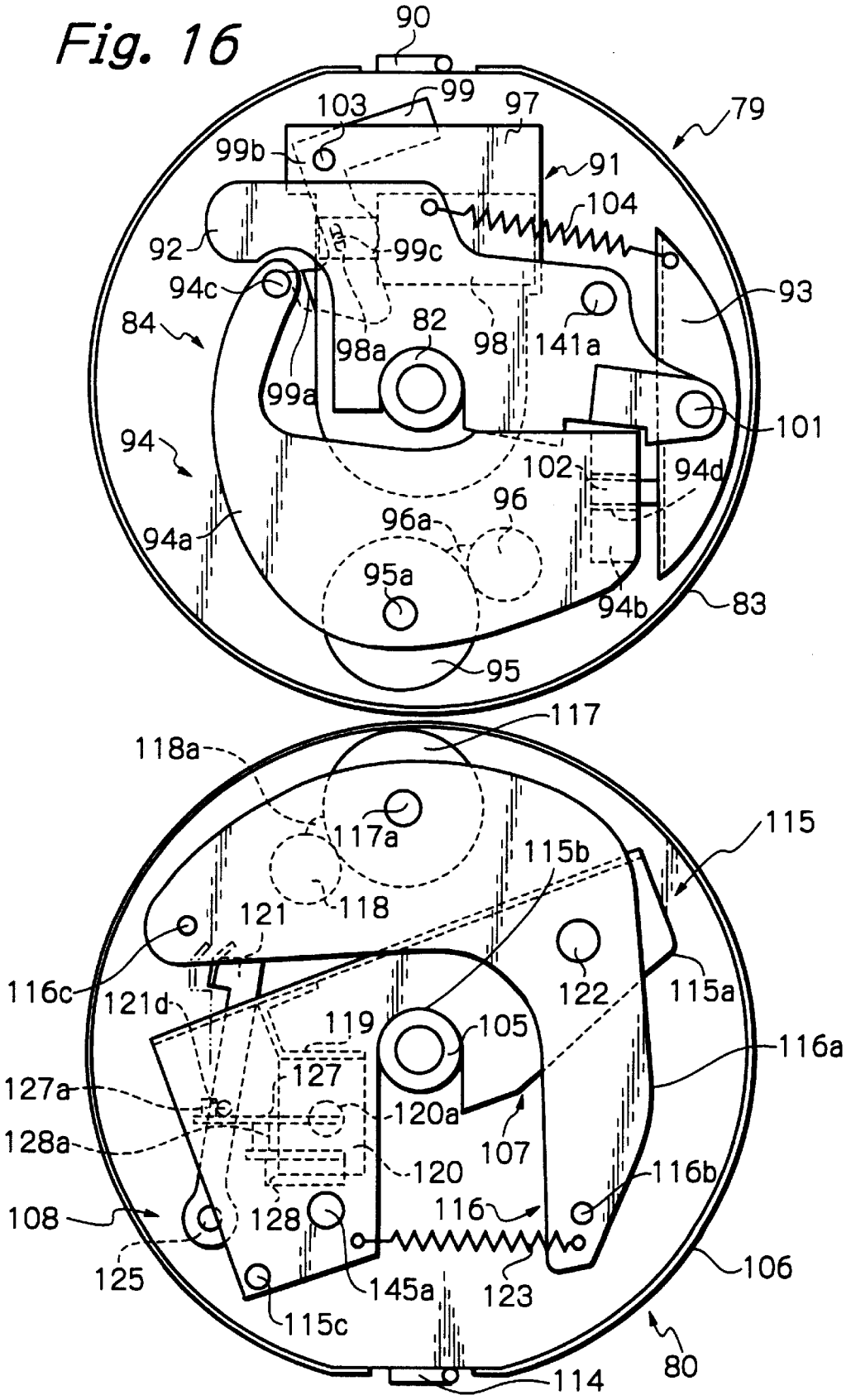
FIG. 16 is a fragmentary side elevation showing the printing section in an operative condition.

When the cam followers 95*b* again contacts the protuberances of the associated cam portions 85*c* due to the rotation of the ink drum 79, the first and second support members 93 and 94 rotate clockwise, as viewed in FIG. 16, about the shaft 101. As soon as the locking rod 94*c* and one end 99*a* of the stop 99 are released from each other, the stop 99 is caused to angularly move by biasing means, not shown, and return to the position shown in FIG. 9.

Likewise, when the cam followers 117*b* again contact the protuberances of the associated cam portions 109*b* and 110*b* due to the rotation of the ink drum 80, the ink roller support member 116 rotates counterclockwise, as viewed in FIG. 16, about the shaft 122. As soon as the locking rod 116*c* and the tongue 121*c* of the stop 121 are released from each other, the stop 121 is caused to angularly move by the tension springs 126 and return to the position shown in FIG. 9.

The ink drums 79 and 80 each is brought to a stop on reaching the respective home position, completing the master wrapping operation. While the printer 1 is held in a stand-by state, the operator presses the trial print key 156. In response, the pickup roller 25 and separator rollers 26 and 27 feed another paper P form the top of the stack on the paper tray 24. As soon as the registration roller pair 30 nips the leading edge of the paper P, the control means 169 energizes the motors 146 and 147 and thereby causes the ink drums 79 and 80 to rotate at a high speed. The registration roller pair 30 drives the paper P to the position between in the ink drums 79 and 80 at the same timing as during master wrapping operation. After black images have been transferred to both sides of the paper P, the paper or printing P is removed from the ink drum 79 or 80 by the peeler 67 or 68. The paper conveyor 71 conveys the paper P to the tray 72. The drums 79 and 80 are again returned to their home positions and stopped there. This is the end of the trial printing operation.

The operator checks the trial printing P as to the density and position of the images and may adjust such factors on the operation panel 153 and produce another trial printing. Thereafter, the operator inputs a desired number of printings on the numeral keys 158; the number of printings appears on the display 163. Subsequently, the operator sets a desired printing speed on the print speed key 161 and then presses the print start key 155. As a result, papers P are sequentially fed from the paper feeding section 3 in order to produce the desired number of printings.

When the amount of ink in the ink well 96*a* or 118*a* decreases during the above printing operation, the sensor 170 or 171, respectively, sends a signal representative of short ink to the control means 169. In response, the control means 169 energizes the feed pump 265 or 266 for replenishing fresh ink from the ink pack to the ink well 96*a* or 118*a* via the main pipe 82 or 105 and feed pipe 129 or 130.

The front print mode belonging to the simplex print mode is as follows. The operator selects the front print mode on the print mode key 165, sets a single document on the document tray, and then presses the perforation start key 154. In response, the first and second master making sections 6 and 7 each discharges the used master 167 or 168 from the ink drum 79 or 80 in the same manner as in the duplex print mode. The image reading section 2 reads an image out of the document.

Perforation is executed in parallel with the document reading operation. Specifically, the first master making section 4 perforates the stencil 33 in the same manner as in the duplex print mode. The resulting master 33 is wrapped around the ink drum 79. However, the second master making section 5 does not perforate the stencil 40, so that the resulting master 40 not perforated at all is simply wrapped around the ink drum 80.

After the masters 33 and 40 have been respectively wrapped around the ink drums 79 and 80, a single paper P is fed from the paper feeding section 3 while the ink drums 79 and 80 are caused to rotate at the low speed. The registration roller pair 30 drives the paper toward the ink drums 79 and 80 at the preselected timing stated earlier.

The ink rollers 95 and 117 are caused to angularly move in accordance with the rotation of the ink drums 79 and 80, respectively. The ink rollers 95 and 117 respectively cause the porous support plates 83 and 106 to bulge out and nip the paper P therebetween. In this condition, an image formed in the master 33 is transferred to the front or upper surface of the paper P because the master 40 is not perforated at all. The paper P carrying the image on its front is removed from the ink drum 79 by the peeler 67 and then conveyed by the conveyor 71 to the tray 72.

After the ink drums 79 and 80 have been brought to their home positions and stopped there, the operator presses the trial print key 156 in order to produce a trial printing. Subsequently, the operator may press the print start key 155.

In the rear print mode also belonging to the simplex print mode, the operator selects the rear print mode on the print mode key 165, sets a single document on the document tray, and then presses the perforation start key 154. In response, the first and second master discharging sections 6 and 7 remove the used masters 167 and 168, respectively. On the other hand, the image reading section 2 reads an image out of the document.

Perforation is executed in parallel with the document reading operation. Specifically, the second master making section 5 perforates the stencil 40 in the same manner as in the duplex print mode. The resulting master 40 is wrapped around the ink drum 80. In this case, the first master making section 4 does not perforate the stencil 33, so that the resulting master 40 not perforated at all is simply wrapped around the ink drum 80.

After the masters 33 and 40 have been respectively wrapped around the ink drums 79 and 80, a single paper P is fed from the paper feeding section 3 while the ink drums 79 and 80 are caused to rotate at the low speed. The registration roller pair 30 drives the paper P toward the ink drums 79 and 80 at the preselected timing stated earlier.

The ink rollers 95 and 117 are caused to angularly move in accordance with the rotation of the ink drums 79 and 80, respectively. The ink rollers 95 and 117 respectively cause the porous support plates 83 and 106 to bulge out and nip the paper P therebetween. In this condition, an image formed in the master 40 is transferred to the rear or lower surface of the paper P because the master 33 is not perforated at all. The paper P carrying the image on its rear is removed from the ink drum 80 by the peeler 68 and then conveyed by the conveyor 71 to the tray 72.

After the ink drums 79 and 80 have been brought to their home positions and stopped there, the operator presses the trial print key 156 in order to produce a trial printing. Subsequently, the operator may press the print start key 155.

How the printer 1 operates when the perforation start key 154 is pressed after a long time of suspension of the printer 1 will be described hereinafter. Generally, the viscosity of ink decreases when the ink is left unused over a long period of time. In light of this, after a long time of suspension, the ink lowered in viscosity is collected from the outer peripheries of the ink drums 79 and 80 in order to reduce the number of waste papers ascribable to such undesirable ink. While both the first and second ink collecting means 250 and 270 are used for this purpose, the following description will concentrate on the operation of the first ink collecting means 250 because the two collecting means 250 and 270 are identical in operation.

Figure 17:
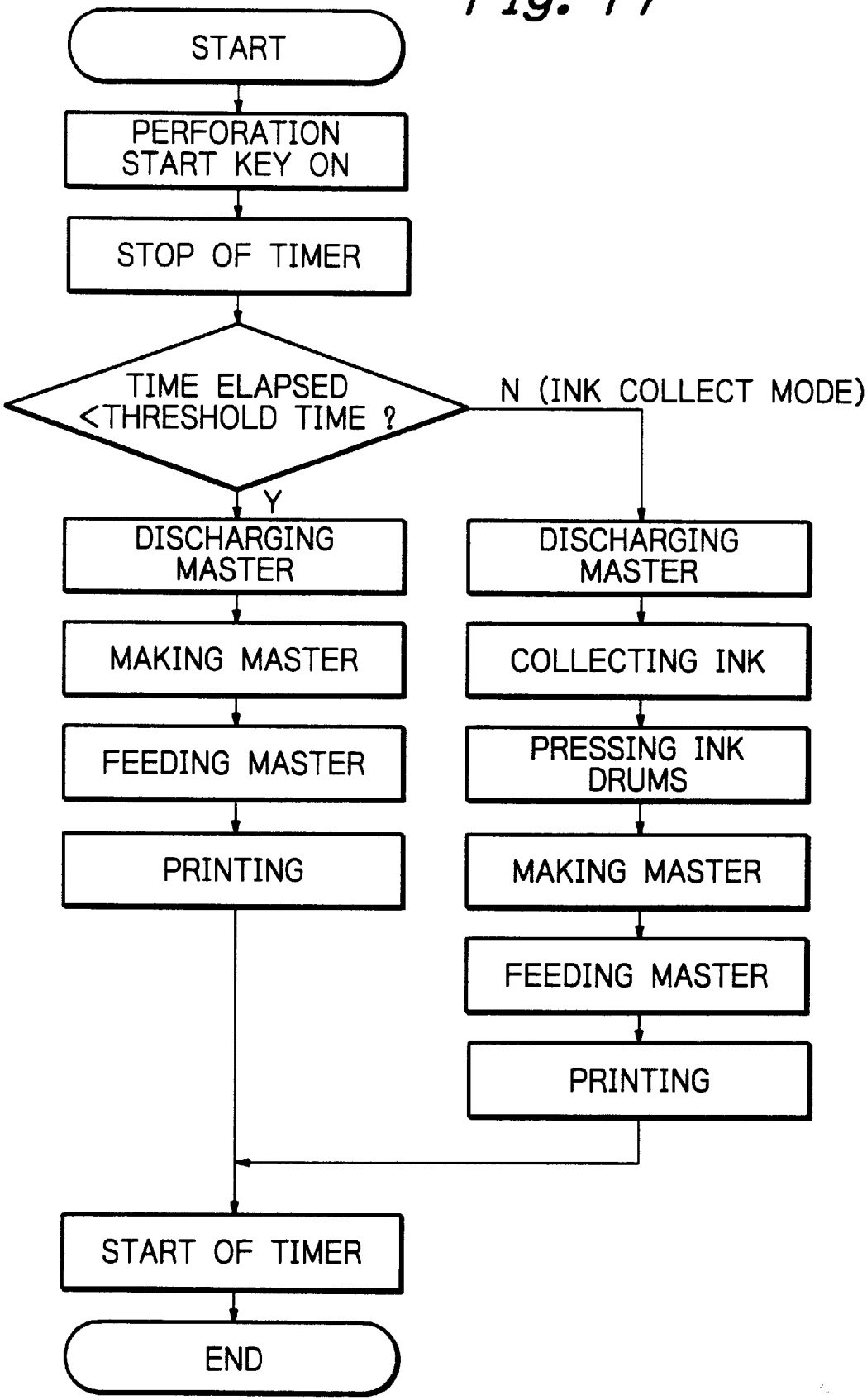
FIG. 17 is a flowchart demonstrating a specific operation of the first embodiment.

As shown in FIG. 17, when the operator presses the perforation start key 154, the control means 169 determines, based on the output of the timer 267, a period of time elapsed since the end of the last printing operation. If the above period of time is longer than a preselected period of time (threshold value), then the control means 169 causes an ink collect mode operation to start. In the ink collect mode, the used masters 167 and 168 are respectively removed from the ink drums 79 and 80 as in the usual print mode, and the ink drums 70 and 80 are stopped at their master waiting positions.

Subsequently, the ink drums 79 and 80 each is caused to start making a preselected number of rotations at the low speed with its outer periphery (mesh screen) exposed to the outside. At this instant, the solenoids 98 and 120 disposed in the ink drums 79 and 80 are not energized. Therefore, the locking rods 94*c* and 116*c* are respectively stopped by the stops 99 and 121, maintaining the ink rollers 95 and 117 spaced from the inner peripheries of the ink drums 79 and 80, respectively. When the edge of the porous portion of the porous support plate 83 arrives at a position where it faces the roller 251 of the first ink collecting means 250, the control means 169 energizes the solenoid 258 and thereby causes the arms 256 to angularly move about the shaft 257. As a result, the roller 251 is moved to a position indicated by a solid line in FIG. 3. At this position, the roller 251 is pressed against the portion of the outer periphery of the ink drum 79 corresponding to the inner periphery of the same which the backup roller 252 contacts. When the damper 90 approaches the roller 251, the roller 251 is temporarily retracted away from the ink drum 79 to a position indicated by a dash-and-dots line in FIG. 3 so as not to contact the damper 90.

In the above condition, the roller 251 and backup roller 252 are respectively rotated in directions Al and A2, FIG. 3, in accordance with the rotation of the ink drum 79. At the position where the roller 251 and backup roller 252 are pressed against each other, the ink lowered in viscosity and deposited on the inner periphery of the ink drum 79 is forced out to the outer periphery of the drum 79 and transferred to the circumference of the roller 251. The blade 253 scrapes off the ink deposited on the roller 251. The ink drops from the blade 253 into the waste ink box 254 due to its own weight. In FIG. 3, an arrow B indicates such transfer of the ink from the ink drum 79 to the waste ink box 254. On the elapse of a preselected period of time, the control means 169 deenergizes the solenoid 258 so as to move the roller 251 away from the ink drum 79 to the position indicated by the dash-and-dots line in FIG. 3.

As stated above, the first and second ink collecting means 250 and 270 respectively collect the ink lowered in viscosity from the ink drums 79 and 80 at the above preselected timing. This frees printings from blurring and offset during printing and thereby reduces the number of waste papers as far as possible so as to reduce the printing cost.

Even after the collection of the ink, the ink drums 79 and 80 are continuously rotated in pressing contact with each other. This successfully feeds fresh ink to the ink drums 79 and 80 from which the undesirable ink has been collected. Specifically, the control means 169 energizes the solenoids 98 and 120. As a result, the ink rollers 95 and 117 being rotated by drive means, not shown, are caused to angularly move within the ink drums 79 and 80, respectively.

The ink rollers 95 and 117 brought into contact with the porous support plates 83 and 106, respectively, cause the support plates 83 and 106 to bulge out. Consequently, the ink rollers 95 and 117 are pressed against each other with the intermediary of the support plates 83 and 106, mesh screen 89, and mesh screen not shown. While the ink drums 79 and 80 are rotated in the above condition, the control means 169 energize the feed pumps 265 and 266 in order to feed fresh ink from the ink pack to the inner peripheries of the ink drums 79 and 80 via the ink wells 96*a* and 118*a*, respectively.

More specifically, when the undesirable ink is collected from the outer peripheries of the ink drums 79 and 80, the outer peripheries are short of ink. Fresh ink is supplemented to the ink drums 79 and 80 pressed against each other in order to make up for the shortage. Therefore, the amount of ink to be fed to each of the ink drum 79 and 80 is great enough to fill the circumference of the ink drum.

The ink drums 79 and 80 pressed against each other level the ink left on the surface of the mesh screen 89 and that of the mesh screen, not shown, due to the perforations of the masters 167 and 168 removed from the ink drums 79 and 80. This is successful to substantially uniform the ink density on the ink drums 79 and 80. Further, the adequate amount of fresh ink fed to the circumferences of the ink drums 79 and 80 fills them, i.e., the mesh screens.

On completing the predetermined number of rotations, the ink drums 79 and 80 are brought to a stop at their home positions. Before the stop of rotation of the ink drums 79 and 80, the control means 169 deenergizes the solenoids 98 and 120. As a result, the stops 99 and 121 return to the positions shown in FIG. 9 and retain the ink rollers 95 and 117, respectively.

After the above procedure, the master making operation, master feeding operation and printing operation are sequentially executed. At the end of the printing operation, the timer 267 again starts counting time. Such a sequence of steps are shown in FIG. 17.

Because the ink density on the ink drums 78 and 80 is substantially uniform and because the mesh screens are filled with fresh ink, it is possible to start feeding ink smoothly just after the start of a duplex print mode operation. In addition, there can be obviated irregularity in density just after the start of printing that would increase the number of waste papers and therefore the printing cost.

On the other hand, the ink dropped from the blade 253 into the waste ink box 254 infiltrates into the porous block 260. To promote the infiltration of the ink into the block 260, the compressor 262 is repeatedly lowered at preselected intervals so as to compress the block 260.

When the ink infiltrates into the block 260 by more than a preselected amount, e.g., when the amount of ink absorbed by the block 260 substantially reaches an allowable limit, the weight sensor 261 responsive to the weight of the block 260 sends a signal to the control means 169. In response, the control means 169 determines that the block 260 should be replaced, and displays a message for urging the operator to replace the block 260 on the display 164.

The operator watching the above message on the display 164 removes the waste ink box 254 from the casing 23, discards the block 260, sets a new block 260 in the box 254, and again mounts the box 254 to the casing 23. Because the ink has infiltrated into and retained by the block 260, the block 260 can be easily replaced without the ink dropping or smearing the surrounding.

The weight sensors 261 and 281 are omissible if the time for replacing the blocks 260 and 280 is determined on the basis of the number of times of ink collection repeated by the ink collecting means 250 and 270. In such a case, the number of times of ink collection will be stored in a memory, not shown, included in the control means 169, and the message for urging the operator to replace the blocks 260 and 280 will be displayed on the display 164 when the above number of times coincides with a preselected number of times.

While the illustrative embodiment presses the ink drums 79 and 80 against each other after the collection of the ink, the collection of ink may be effected at the same time as the pressing of the ink drums 79 and 80.

Further, in the above embodiment, the control means 169 forms a part of the ink collecting means 250 and a part of the ink collecting means 270. If desired, an exclusive key, not shown, for ink collection may be added to the operation panel 153, so that the operator can cause the ink collecting means 250 and 270 to operate without the intermediary of the control means 169 by pressing the key.

Second Embodiment

A second embodiment of the present invention will be described with reference to FIGS. 18–22. Because this embodiment is essentially similar to the first embodiment, the following description will concentrate only on differences. Briefly, this embodiment differs from the first embodiment in that it increases, at the time of ink collection, the amounts of ink to be fed from the ink wells to the peripheries of the ink drums, temporarily stores the I collected ink, and deposits the collected in on used masters.

Figure 18:
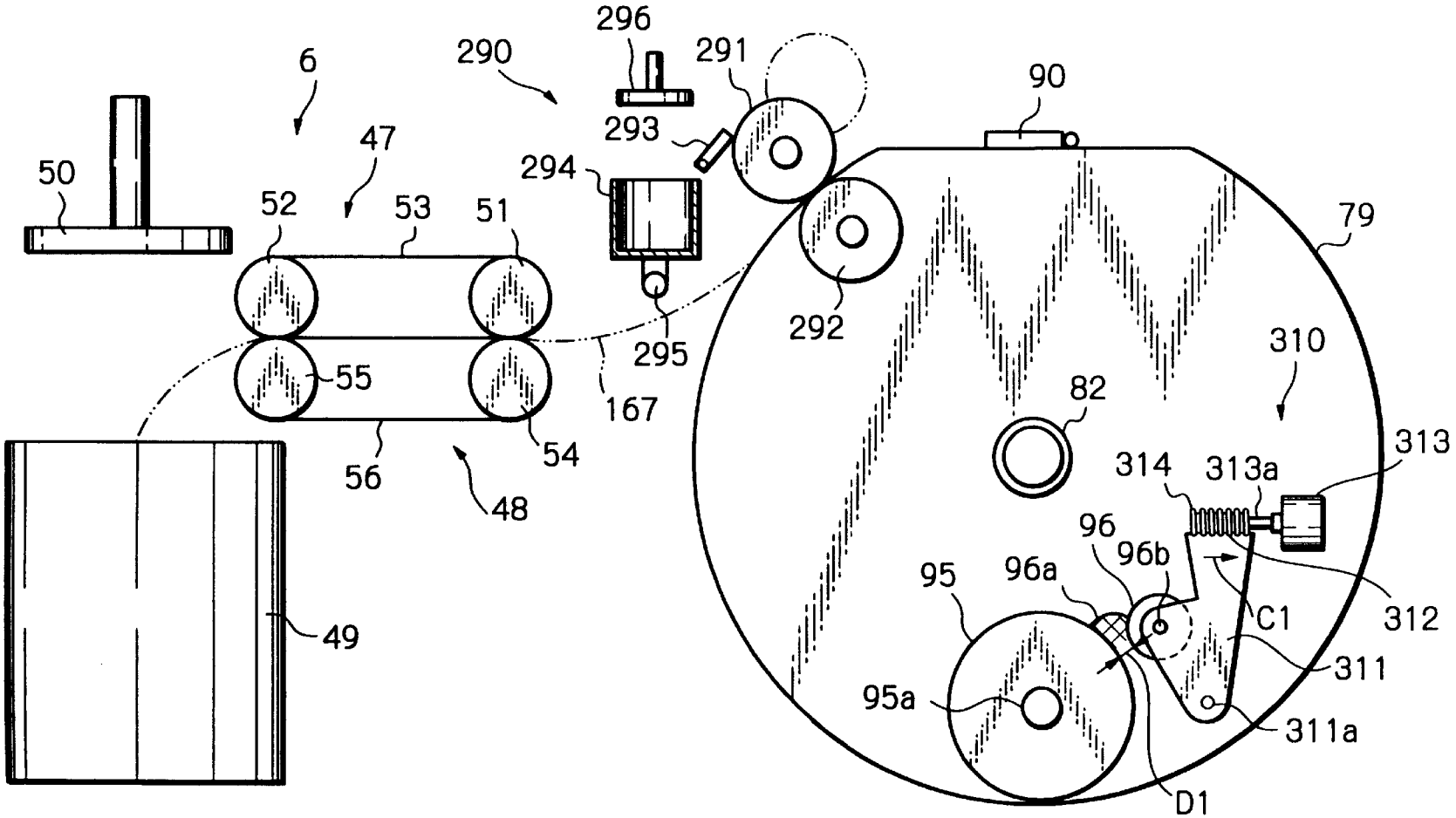
FIG. 18 shows first ink collecting means included in a second embodiment of the present invention.
Figure 21:
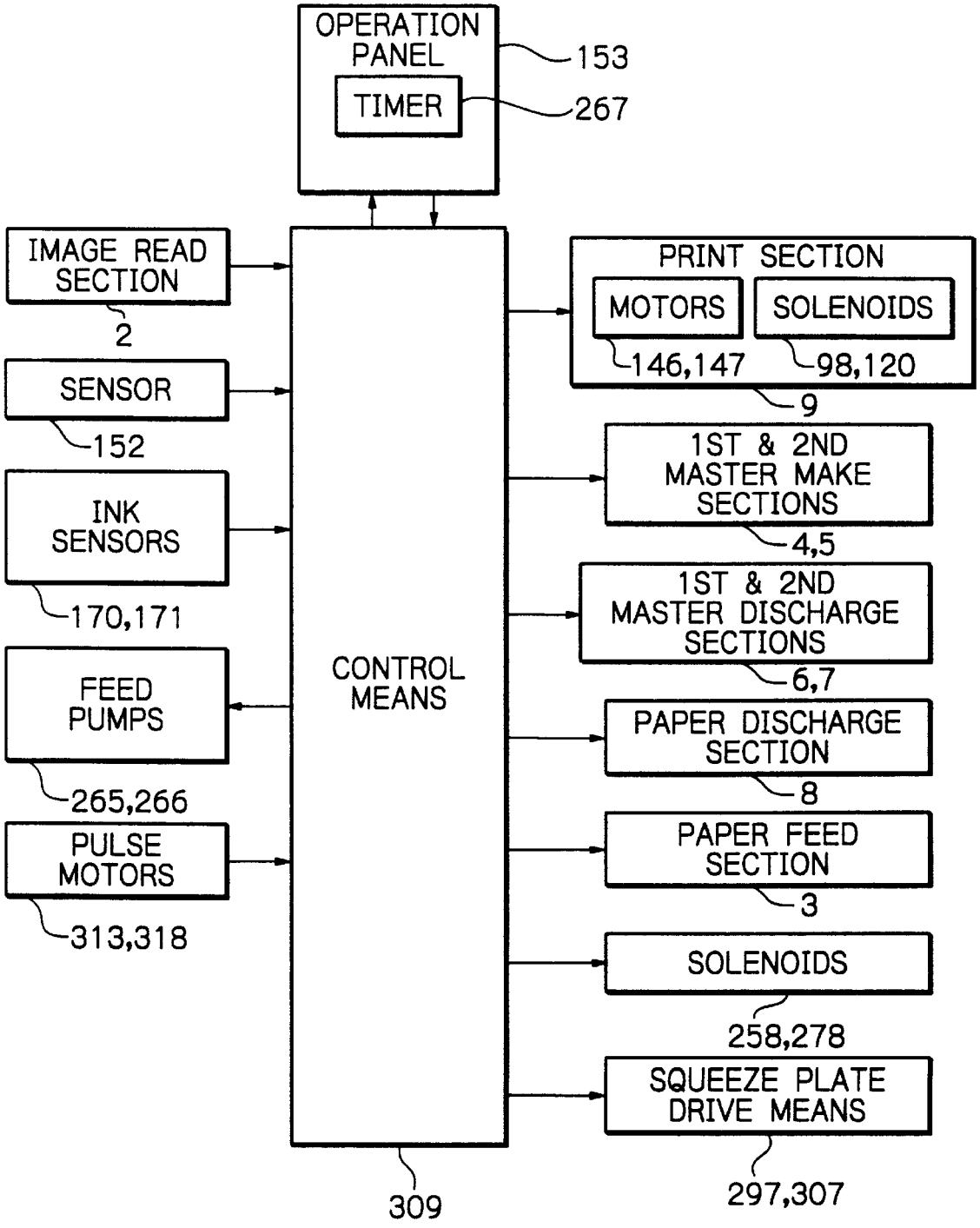
FIG. 21 is a block diagram schematically showing control means included in the second embodiment.

As shown in FIG. 18, first ink collecting means 290 is similar to the first ink collecting means 250 of the first embodiment and includes a roller or ink collecting member 291, a backup roller 292, a blade 293, moving means, not shown, for moving the roller 291, and control means 309 (see FIG. 21). The ink collected by the blade 293 is temporarily stored in a receptacle or ink storing means 294.

The roller moving means selectively moves the roller 291 to a position where it contacts the ink drum 79 (solid line) or a position where it is spaced from the ink drum 79 (dash-and-dots line). The backup roller 292 lightly contacts the inner periphery of the ink drum 79 while facing the roller 291. The roller 291, backup roller 292 and blade 293 are formed of rubber or similar elastic material.

The receptacle 294 is positioned below the blade 293 between the first master discharging section 6 and the ink drum 79. The receptacle 294 resembles a box open at its portion facing blade 293.

Figure 19:
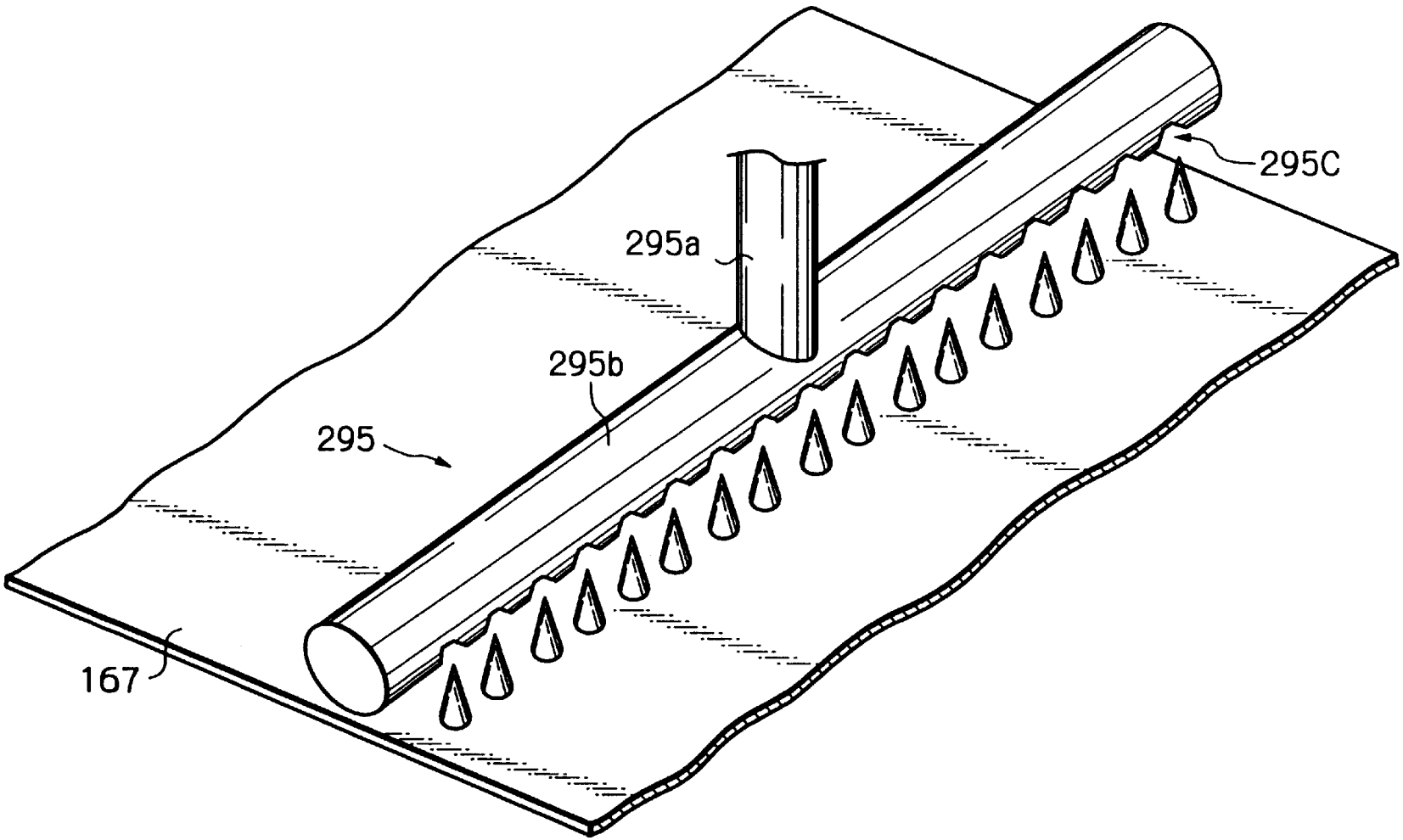
FIG. 19 is an enlarged perspective view showing an outlet portion forming a part of a discharge pipe included in the first ink collecting means of FIG. 18.

A discharge pipe 295 is connected to the bottom of the receptacle 294 for depositing the ink collected in the receptacle 294 on the used master 167. In this sense, the discharge pipe 295 serves as ink depositing means. As shown in FIG. 19, the discharge pipe 295 is configured in the form of a letter T and made up of an inlet portion 295*a* and an outlet portion 295*b*. The outlet portion 295*b* extends in substantially parallel to the axis of the ink drum 79 and is formed with a plurality of holes 295*c*. The dimension of the outlet portion 295*b* in the axial direction of the ink drum 79 is substantially the same as the width of the used master 167.

A squeeze plate 296 is positioned above the receptacle 294 in order to force the ink collected in the receptacle 294 into the discharge pipe 295. Squeeze plate drive means 297 (see FIG. 21) moves the squeeze plate 296 up and down.

Figure 20:
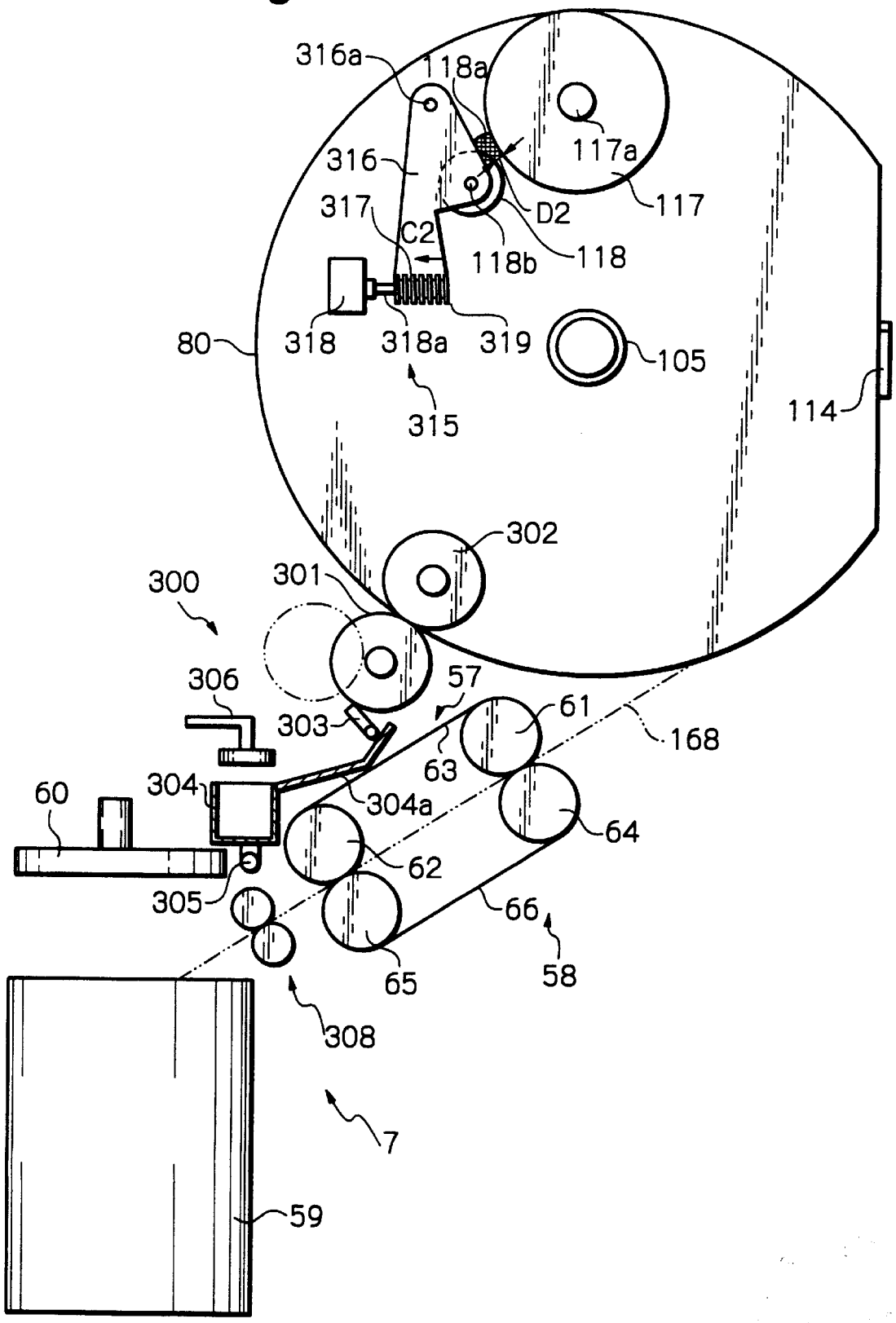
FIG. 20 shows second ink collecting means included in the second embodiment.

As shown in FIG. 20, second ink collecting means 300 is positioned between the ink drum 80 and the second master discharging section 7 in order to collect ink from the outer periphery of the drum 80. The second ink collecting means 300 is identical with the first ink collecting means 290 except for the following. It is to be noted that the control means 309 forms a part of the second ink collecting means 300 as well.

The second ink collecting means 300 includes a receptacle 304. A guide plate 304*a* extends out from the edge of the open top of the receptacle 304 adjoining a blade 303. The guide plate 304*a* covers the lower portion of the blade 303 and guides the ink scraped off by the blade 303 into the receptacle 304. A squeeze plate 306 is positioned above the receptacle 304 and moved up and down by squeeze plate drive means 307 (see FIG. 21).

An applicator roller pair or ink depositing means 308 is positioned below a discharge pipe 305 between the upper and lower discharge members 57 and 58. The applicator roller pair 308 deposits the collected ink on the used master 168.

As shown in FIGS. 18 and 20, the doctor rollers 96 and 118 are provided with ink increasing means 310 and 315, respectively. The ink increasing means 310 and 315 respectively increase the amounts of ink to be fed from the ink wells 96*a* and 118*a* to the circumferences of the ink drums 79 and 80 at the time of ink collection. Because the ink increasing means 310 and 315 are substantially identical in configuration, the following description wilt concentrate on the ink increasing means 310 by way of example. The structural elements of the ink increasing means 315 will be simply distinguished from the structural elements of the ink increasing means 310 by reference numerals.

The doctor roller 96 has a shaft 96*b* supported by a roller arm 311 angularly movable about a shaft 311*a*. An arcuate gear portion 312 is formed at the top edge of the roller arm 311 and held in mesh with a worm gear 314 mounted on the output shaft 313*a* of a reversible pulse motor 313. The pulse motor 313 is connected to the control means 309, FIG. 21. With this configuration, it is possible to adjust a so-called doctor gap between the ink roller 95 and the doctor roller 96.

The operation of the illustrative embodiment will be described hereinafter. In the usual print mode, the embodiment operates in the same manner as the previous embodiment. The following description will therefore concentrate on the operation to occur after a long time of suspension of the printer 1. In the first embodiment, the ink is collected from the circumferences of the ink drums 79 and 80. However, even the ink in the ink well 96*a* and 118*a* decrease in viscosity when left unused over a long period of time and would bring about waste papers like the ink deposited on the ink drums 79 and 80. To solve this problem, when the printer 1 is left unused over a long period of time, the illustrative embodiment collects the ink not only from the circumferences of the ink drums 79 and 80 but also from the ink wells 96*a* and 118*a* and thereby obviates waste papers more positively.

First, the collection of ink by the first ink collecting means 290 will be described. When the operator presses the perforation start key 154, the control means 309 determines, based on the output of the timer 267, how long the printer has been left unused since the end of the last printing operation. If the period of time counted by the timer is longer than a preselected period of time (threshold value), the control means 290 sets up an ink collect mode. In the ink collection mode, used masters are discharged as in the usual print mode. After the discharge of the used masters, the control means 309 rotates the pulse motor 313 in a preselected direction and thereby rotates the worm gear 314. The worm gear 314 causes the roller arm 311 to move about the shaft 311*a* in a direction C1 shown in FIG. 18, increasing a distance D1 between the ink roller 95 and the doctor roller 96. As a result, the ink layer on the ink roller 95 increases in thickness and is therefore fed in a greater amount from the ink well 96*a* to the circumference of the ink drum 79.

Subsequently, the ink drum 79 is caused to start making a preselected number of rotations at a low speed. As a result, the ink in the ink well 96*a* is transferred to the circumference of the ink drum 79 and then collected by the roller 291. The ink collected by the roller 291 is temporarily stored in the receptacle 294.

The operation of the second ink collecting means 300 essentially similar to the operation of the first ink collecting means 290 will be briefly described. After the discharge of the used master, the control means 309 drives a pulse motor 318 in a preselected direction and thereby causes a roller arm 316 to move about a shaft 316*a* in a direction C2 shown in FIG. 20. As a result, a distance D2 between the ink roller 117 and the doctor roller 118 and therefore the thickness of the ink layer on the ink roller 117 increases, increasing the amount of ink to be fed from the ink well 118*a* to the circumference of the ink drum 80.

Thereafter, the ink drum 80 is caused to start making a preselected number of rotations at a low speed. As a result, the ink on the ink drum 80 is collected by the roller 301 and then scraped off from the roller 301. The ink dropped from the roller 301 onto the guide plate 304*a* is introduced into the receptacle 304 along the guide plate 304*a* and stored therein. At the time of collection, the control means 309 energizes the solenoids 98 and 120 disposed in the ink drums 79 and 80, respectively, so that the ink rollers 95 and 117 respectively contact the inner peripheries of the ink drums 79 and 80; the ink drums 79 and 80 rotate in pressing contact with each other.

By increasing the distances D1 and D2, as stated above, it is possible to rapidly collect even the ink existing in the ink wells 96*a* and 118*a* and lowered in viscosity due to a long time of suspension, i.e., to collect most of such undesirable ink. This renders the printing operation to follow desirable.

After the ink collection performed by the first and second ink collecting means 290 and 300, the master making operation, master feeding operation and printing operation are sequentially executed. At the time of master discharging executed for the next printing operation, the two ink depositing means respectively deposit the collected ink on the used masters 167 and 168. That is, the ink left in the ink drums 79 and 80 after the end of printing is collected and temporarily stored and then deposited on used masters to be discarded at the time of the next printing. The ink is therefore discarded together with the used masters.

Specifically, the upper and lower discharge members 48 remove the used master 167 indicated by a dash-and-dots line in FIG. 18 from the outer periphery of the ink drum 79. At this time, the squeeze plate 296 is lowered to force out the ink from the receptacle 294 into the discharge pipe 295. This ink is routed through the discharge pipe 295 and inlet portion 295*a* to the outlet portion 295*b* and deposited on the film surface (front) of the used master 167 via the holes 295*c*. The used master 167 is conveyed into the box 49 together with the collected ink, compressed by the compressor 50, and then discarded.

On the other hand, the upper and lower discharge members 57 and 58 remove the used master 168 indicated by a dash-and-dots line in FIG. 20 from the outer circumference of the ink drum 80. When the used master 168 is conveyed via the applicator roller pair 308, the squeeze plate 306 is lowered to force out the collected ink from the receptacle 304 into the discharge pipe 305. This ink flows out via holes, not shown, and deposits on the applicator roller pair 308. The applicator roller pair 308 applies the ink to the rear of the used master 168. Finally, the used master 168 carrying the collected ink therewith is introduced into the box 59, compressed by the compressor 60, and then discarded.

It is to be noted that during the discharge of the used masters 167 and 168, the rollers 291 and 301 are respectively spaced from the ink drums 79 and 80, as indicated by dash-and-dots lines.

The applicator roller pair 308 is significant for the following reason. The used master 167 being removed from the ink drum 79 is subjected to a preselected tension by the cooperative discharge members 47 and 48 and is therefore prevented from hanging down despite the deposition of the collected ink. However, the deposition of the collected ink on the other used master 168 occurs between the discharge members 57 and 58 and the box 59, so that the used master 168 is apt to hang down due to the collected ink. The applicator roller pair 308 is used to apply the collected ink to the used master 168 between the discharge members 57 and 58 and the box 59, thereby preventing the used master 168 from handing down.

As stated above, when a printing operation is to start with the used masters existing on the ink drums 78 and 80 on the elapse of a preselected period of time as counted by the timer 267, the ink collecting means 290 and 300 collect the undesirable ink from the drums 79 and 80, respectively. This successfully obviates blurring and offset during printing and thereby reduces the number of waste papers as far as possible so as to lower the printing cost.

Moreover, the collected ink is deposited on the used masters 167 and 168 and discarded together with the used masters 167 and 168. The collected ink and used masters 167 and 168 can therefore be discarded by a single originally expected step, enhancing efficiency to a significant degree. In addition, the illustrative embodiment does not need the porous blocks 260 and 280 and other disposable members of the previous embodiment and further reduces the cost.

After the above ink collection, the ink drums 79 and 80 are pressed against each other such that their circumferences are filled with fresh ink. At this instant, the ink increasing means 310 and 315 may be operated in order to increase the distances D1 and D2, respectively, so as to increase the amounts of ink to be fed to the ink drums 79 and 80. This allows the circumferences of the ink drums 79 and 80 to be filled with the fresh ink in a short period of time. That is, the fresh ink can fill the mesh screens and can be smoothly fed at the time of the next printing operation.

The ink increasing means 310 and 315 are capable of adjusting the distances D1 and D2, respectively, in a stepless manner. Alternatively, considering the fact that the distances D1 and D2 should only be varied for the usual print mode and the ink collect mode, the ink increasing means 310 and 315 may simply be implemented by, e.g., solenoids.

In the illustrative embodiment, the ink increasing means 310 and 315 are used to feed greater amounts of ink from the ink wells 96*a* and 118*a* to the ink drums 79 and 80, respectively. Alternatively, if stepless adjustment is available for the distances D1 and D2, the means 310 and 315 may be used to adjust image density, as taught in Japanese Patent Laid-open Publication No. 7-257005.

In the first and second embodiments, the rollers 251, 271, 291 and 301 for ink collection and backup rollers 252, 272, 292 and 302 may be formed of metal with or without an elastic material covering the metal.

Figure 22:
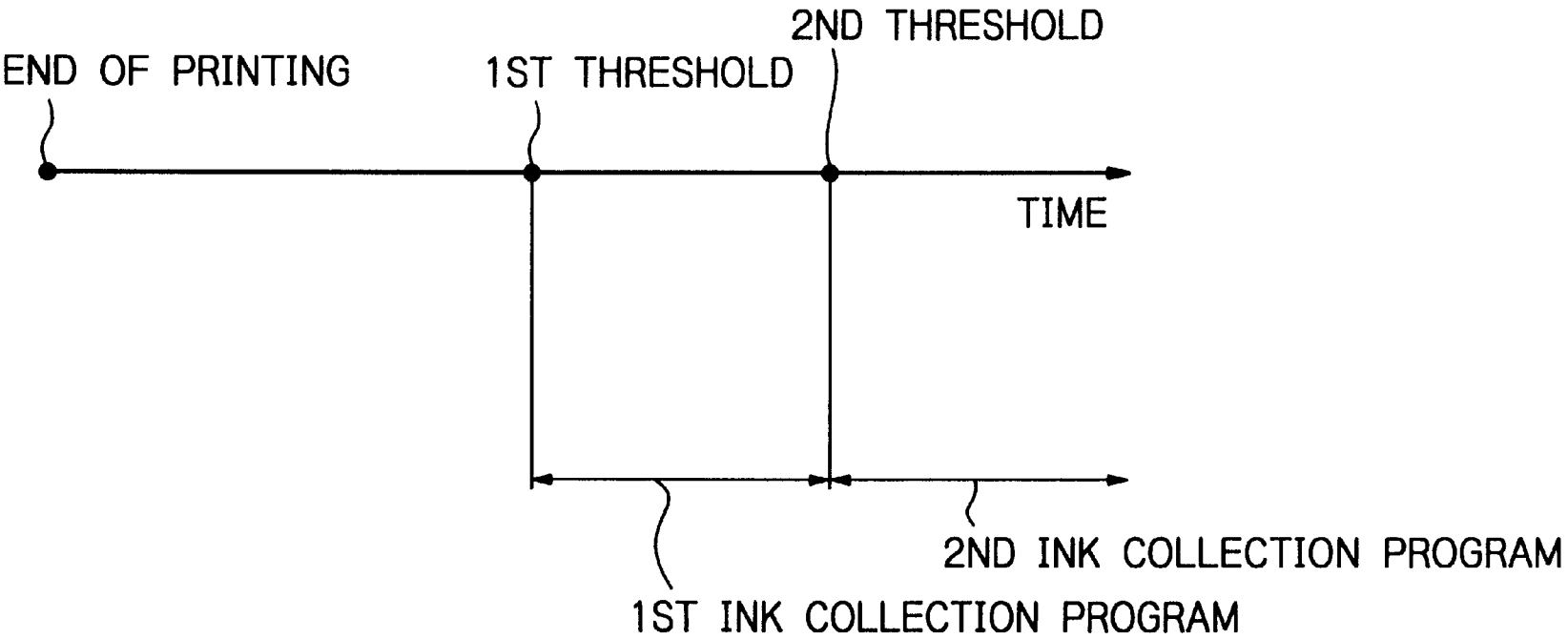
FIG. 22 shows specific threshold values applicable to a case wherein two different ink collection programs are selectively used.

If desired, there may be prepared a first ink collection program for collecting the ink without operating the ink increasing means 310 and 315 and a second ink collection program for collecting the ink by operating them. In such a case, the two different programs will be selectively used in accordance with the period of time elapsed since the end of the last printing operation. For example, as shown in FIG. 22, the first program and second program may be respectively executed when the above period of time is between a first and a second threshold and when it is greater than the second threshold.

While in the illustrated embodiment, the collected ink is deposited on the used masters 167 and 168 being removed from the ink drums 79 and 80, it may be dropped onto the used masters 167 and 168 respectively discharged into the boxes 49 and 59. The crux is that the collected ink be deposited on the used masters 167 and 168.

Third Embodiment

Figure 23:
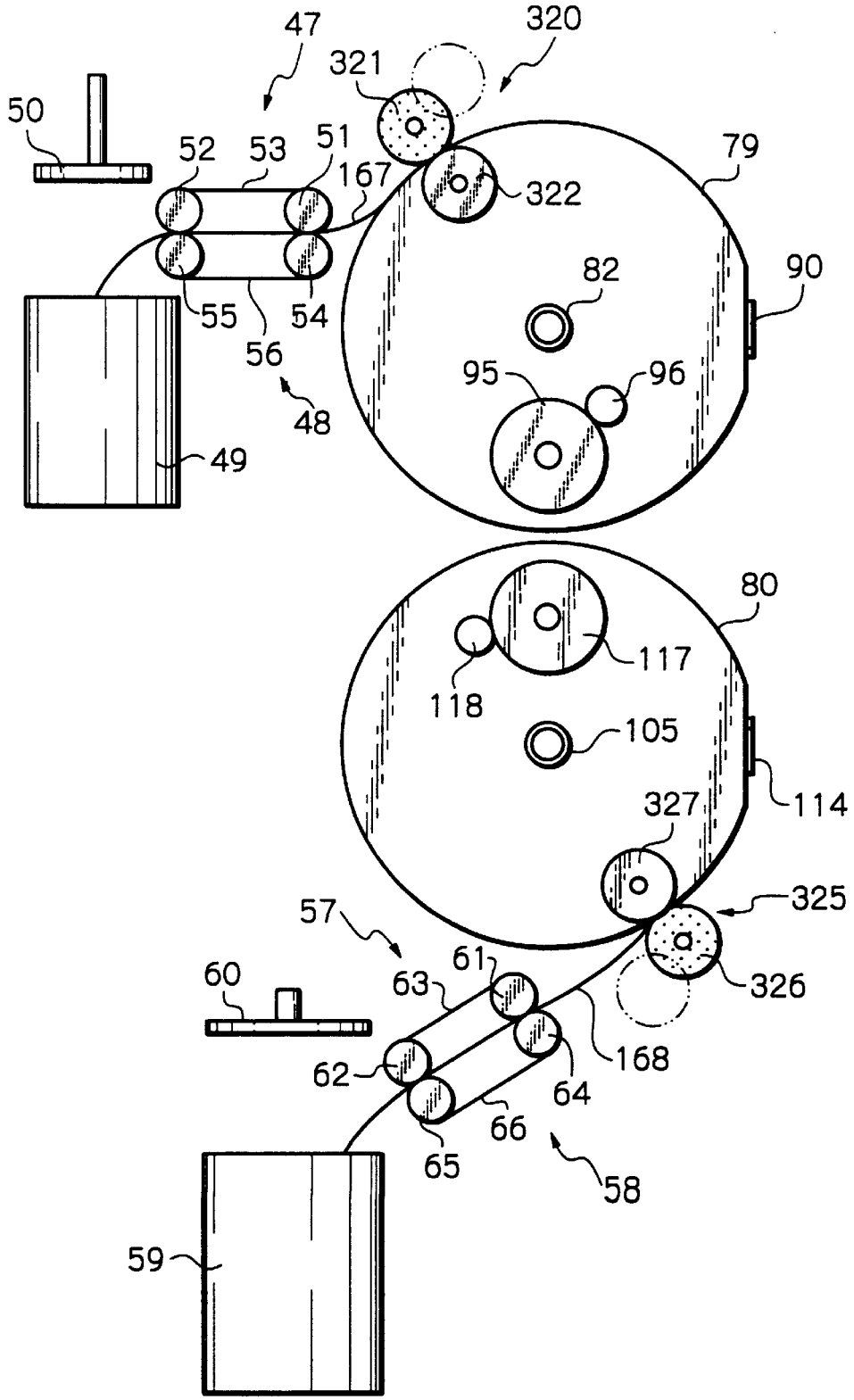
FIG. 23 shows first and second ink collecting means included in a third embodiment of the present invention.

Reference will be made to FIGS. 23 and 24 for describing a third embodiment of the present invention. Because this embodiment is also essentially similar to the first embodiment, the following description will concentrate on an arrangement unique to this embodiment. Briefly, this embodiment is characterized in that it executes the collection, storage and deposition of the ink with a single roller.

As shown in FIG. 23, first ink collecting means 320 is located at a position where the upper and lower discharge members 47 and 48 remove the used master 167 from the ink drum 79. The ink collecting means 320 includes a roller or ink collecting member 321, a backup roller 322, roller moving means for moving the roller 321 into and out of contact with the outer periphery of the ink drum 79, and control means not shown.

The roller 321 is formed of sponge-like polyurethane or similar highly ink-absorptive porous material. The backup roller 322, like the backup roller 252, is formed of rubber or similar elastic material and lightly contacts the inner periphery of the ink drum 79 while facing the roller 321. The backup roller 322 is rotatably supported at opposite ends by a pair of brackets, not shown, affixed to the shaft 82.

The roller moving means, like the roller moving means 255, includes a pair of pivotable arms rotatably supporting opposite ends of the roller 321, and a solenoid causing the arms to angularly move, as needed. The moving means moves the roller 321 between a position where the roller 321 contacts the ink drum 79 (solid line) and a position where it is spaced from the ink drum 79 (dash-and-dots line).

As shown in FIG. 23, second ink collecting means 325 is located at a position where the upper and lower discharge members 57 and 58 remove the used master 168 from the ink drum 80. The ink collecting means 325 includes a roller or ink collecting member 326, a backup roller 327, roller moving means for moving the roller 326 into and out of contact with the outer periphery of the ink drum 80, and the control means. These members and means are identical with the members and means of the first ink collecting means 320 and will not be described specifically in order to avoid redundancy.

How the roller 321 collects ink will be described first. Assume that the perforation start key 154 is pressed after a long time of suspension of the printer 1 since the end of the last printing operation. Then, the control means, not shown, determines a period of time elapsed since the end of the last printing operation on the basis of the output of the timer 267. If the period of time determined is longer than a preselected period of time (threshold value), then the control means sets up an ink collect mode. In the ink collect mode, used masters are discharged in the same manner as in the usual print mode. After the discharge of the used masters, the ink drum 79 is caused to start making a preselected number of rotations at a low speed.

Figure 24A:
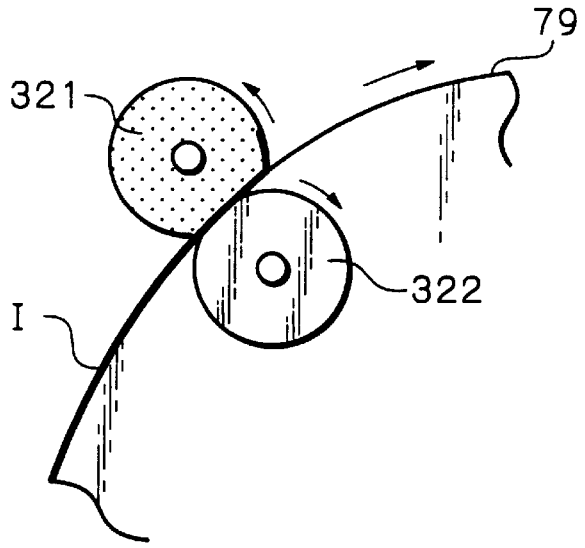
FIGS. 24A–24C each shows the first ink collecting means of the third embodiment in a particular condition.

On the rotation of the ink drum 79, the roller 321 is moved from a position indicated by a dash-and-dots line in FIG. 23 to a position indicated by a solid line. The roller 321 is therefore pressed against the part of the outer periphery of the ink drum 49 corresponding to the part of the inner periphery which the backup roller 322 contacts. In this condition, as shown in FIG. 24A, the roller 321 absorbs ink I deposited on the circumference of the ink drum 79 and lowered in viscosity.

Figure 24B:
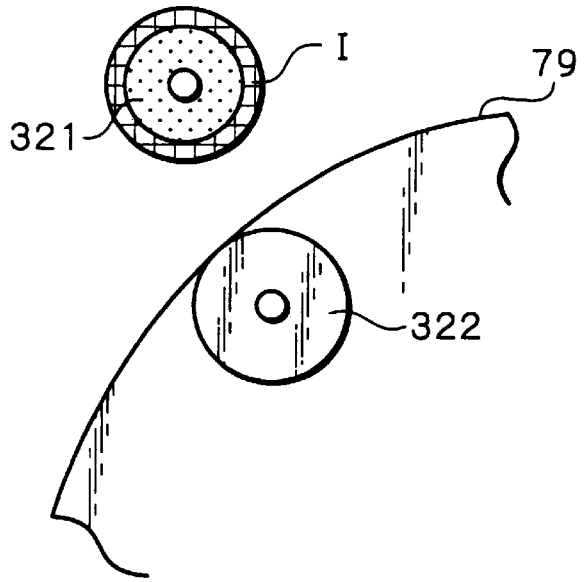

As shown in FIG. 24B, as soon as the ink drum 79 completes the preselected number of rotations, the roller 321 is released form the outer periphery of the ink drum 79. The ink I has infiltrated into the circumference of the roller 321, as indicated by double hatching in FIG. 24B, and is temporarily stored in the roller 321.

Figure 24C:
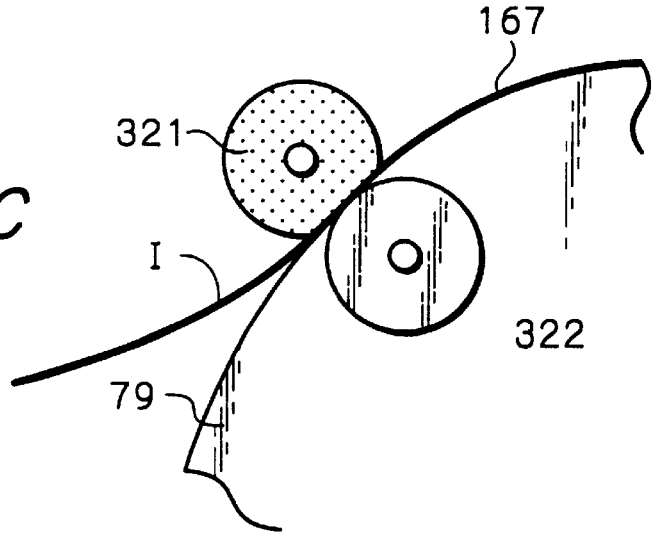

After the collection and storage of the ink I by the roller 321, the master making operation, master feeding operation and printing operation are sequentially executed in the same manner as in the usual print mode. In the illustrative embodiment, the operation for causing the ink drums to press against each other is omitted. As shown in FIG. 24C, when the master discharging operation is executed at the time of the next printing, the roller 321 is again pressed against the ink drum 79 with the intermediary of the used master 167. As a result, the ink I is squeezed out of the roller 321 and transferred to the film surface of the used master 167. The used master 167 carrying the ink I therewith is collected in the box 49, compressed by the compressor 50, and then discarded.

As stated above, the rollers 321 and 326 capable of absorbing and retaining the ink each plays the role of ink storing means and ink depositing means at the same time. The illustrative embodiment therefore renders the device for collecting, storing and depositing ink simple and miniature and thereby reduces the cost.

Fourth Embodiment

Referring to FIGS. 25–31, a fourth embodiment of the present invention will be described. This embodiment is essentially similar to the first embodiment except that it collects the ink from the inner periphery of each ink drum.

Figure 25:
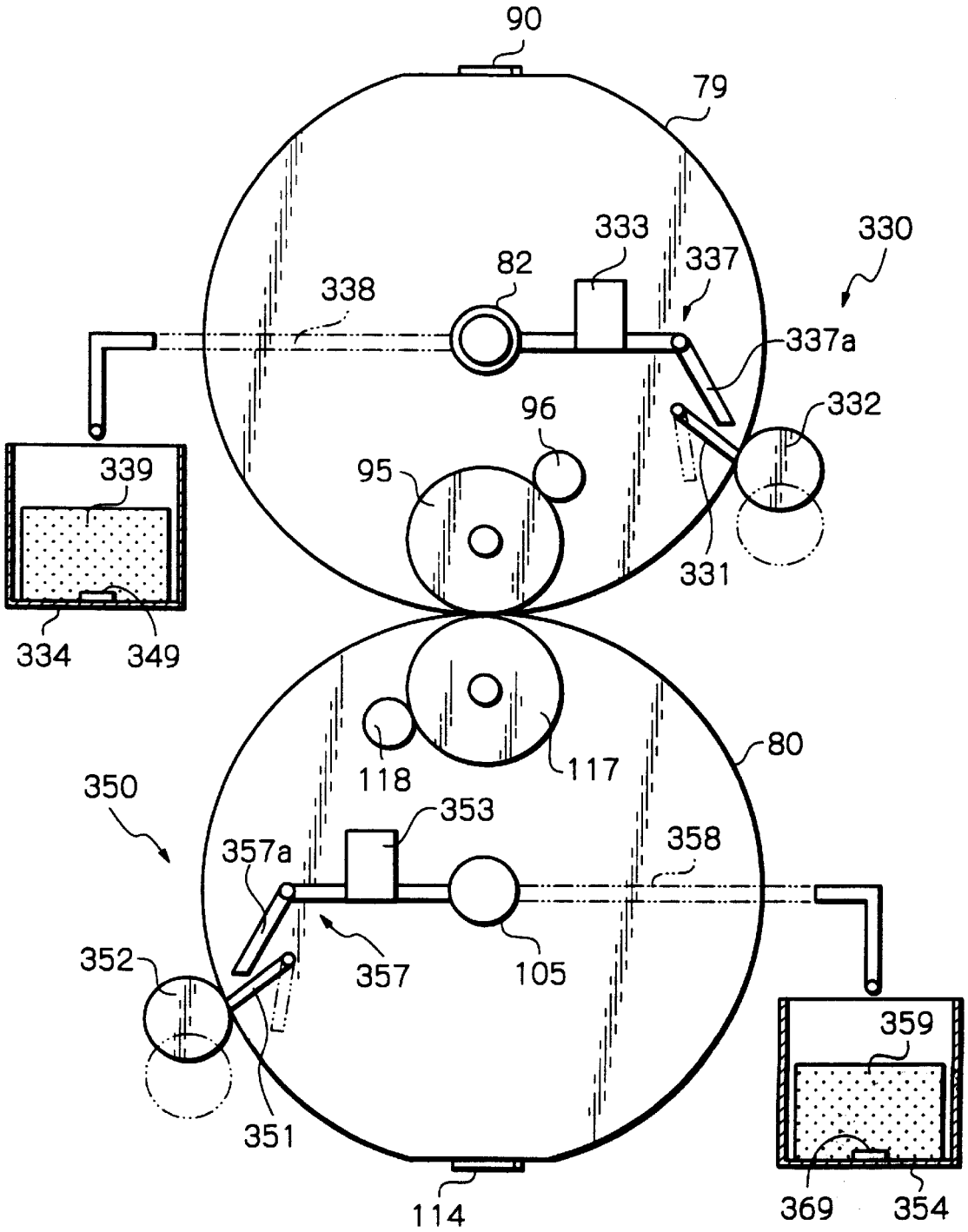
FIG. 25 shows first and second ink collecting means included in a fourth embodiment of the present invention.
Figure 26:
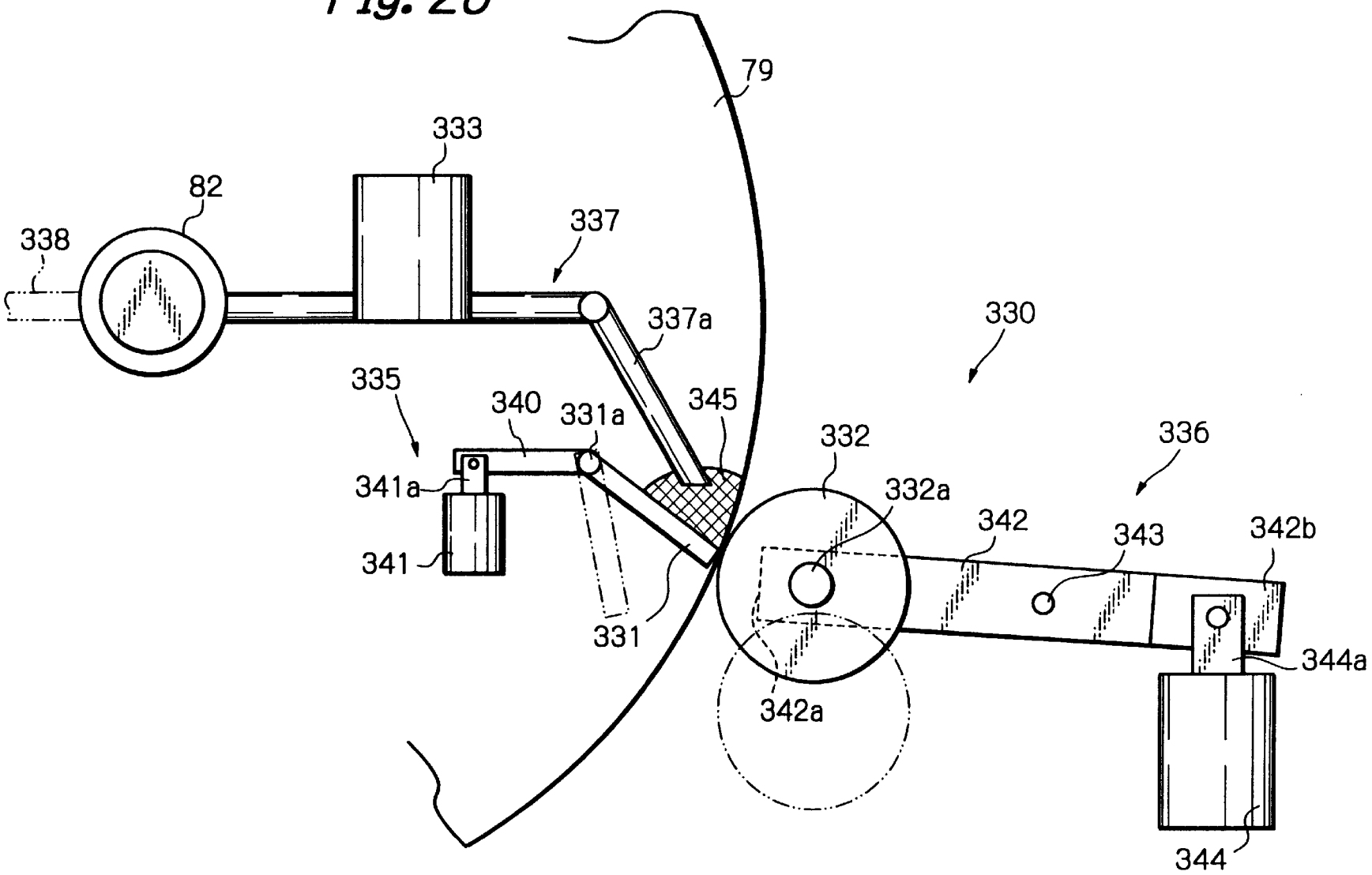
FIG. 26 is an enlarged view of the first ink collecting means shown in FIG. 25.

As shown in FIGS. 25 and 26, first ink collecting means 330 for collecting the ink from the circumference of the ink drum 79 includes a blade or ink collecting member 331. The blade 331 scrapes off the ink deposited on the inner periphery of the ink drum 79. A backup roller 332 is positioned to face the blade 331 with the intermediary of the circumference of the ink 79. A suction pump 333 sucks the ink removed by the blade 331. Blade moving means 335 moves the blade 331 into and out of contact with the inner periphery of the ink drum 79. Roller moving means 336 moves the backup roller 332 into and out of contact with the outer periphery of the ink drum 79. Control means 329 (see FIG. 31) controls the operation of the entire printer 1. A waste ink box or ink storing means 334 is positioned outside of the ink drum 79 for storing the ink sucked by the suction pump 333.

The blade 331 disposed in the ink drum 79 is pivotable about a shaft 331*a* supported by brackets, not shown, which are affixed to the shaft 82. The blade 331 is a flat member formed of rubber or similar elastic material and having a length substantially equal to the axial length of the ink drum 79.

An arm 340 is affixed at one end to the shaft 331*a* and connected at the other end to the plunger 341*a* of a solenoid 341. When the control means 329 does not energize the solenoid 341, the blade 331 is spaced from the inner periphery of the ink drum 79, as indicated by a dash-and-dots line. On the energization of the solenoid 341, the blade 331 is pressed against the inner periphery of the ink drum 79, as indicated by a solid line. The arm 340 and solenoid 341 constitute the blade moving means 335.

The backup roller 332 is formed of rubber or similar elastic material and has a shaft 332*a* rotatably supported by one end 342*a* of an arm 342. The arm 342 is rotatably supported by the casing 23 via a shaft 343 at its substantially intermediate portion. The other end 342*b* of the arm 342 is connected the plunger 344*a* of a solenoid 344. When the control means 329 does not energize the solenoid 344, the backup roller 332 is spaced from the outer periphery of the ink drum 79, as indicated by a dash-and-dots line in FIG. 26. On the energization of the solenoid 344, the backup roller 332 is lightly pressed against the outer periphery of the ink drum 79, as indicated by a solid line in FIG. 26. The arm 342 and solenoid 344 constitute the roller moving means 336.

While the blade 331 is pressed against the inner periphery of the ink drum 79, the ink present on the circumference of the ink drum 79 is collected between the blade 331 and the inner periphery of the ink drum 79 in the form of a pool 345.

Figure 27:
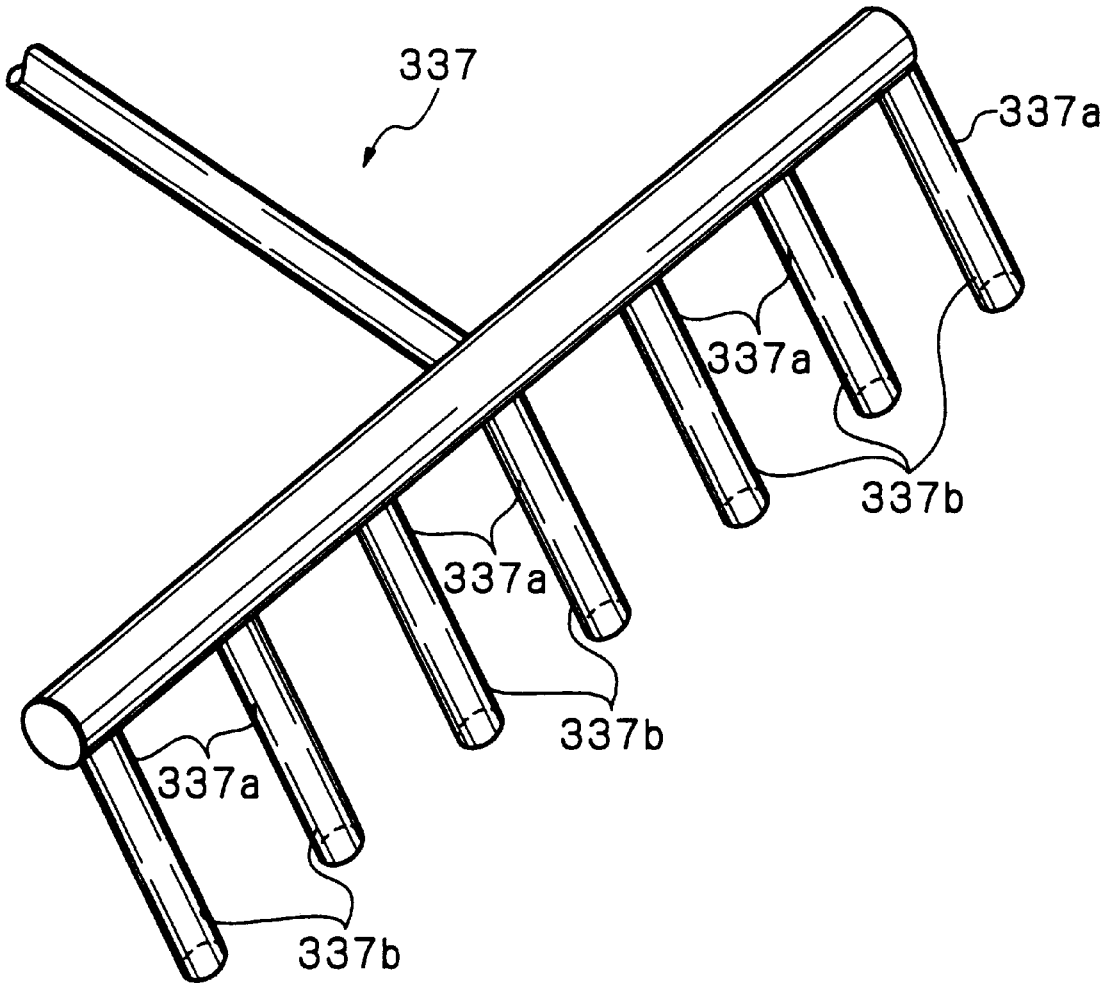
FIG. 27 is an enlarged perspective view of a suction pipe included in the first ink collecting means of FIG. 26.

The shaft 82 has a main pipe 82*a* (see FIG. 28) therein. A suction pipe 337 is communicated to the main pipe 82*a* for sucking the ink from the pool 345. The suction pump 333 is mounted on the suction pipe 337 for sucking the ink from the pool 345. As shown in FIG. 27, the suction pipe 337 has a generally T-shaped end portion. To suck the ink from the pool 345 efficiently, the portion of the suction pipe 337 extending in substantially parallel to the axis of the ink drum 79 includes a plurality of sucking portions 337*a*, as illustrated. Each sucking portion 337*a* is formed with a hole 337*b* for suction at its end.

Figure 28:
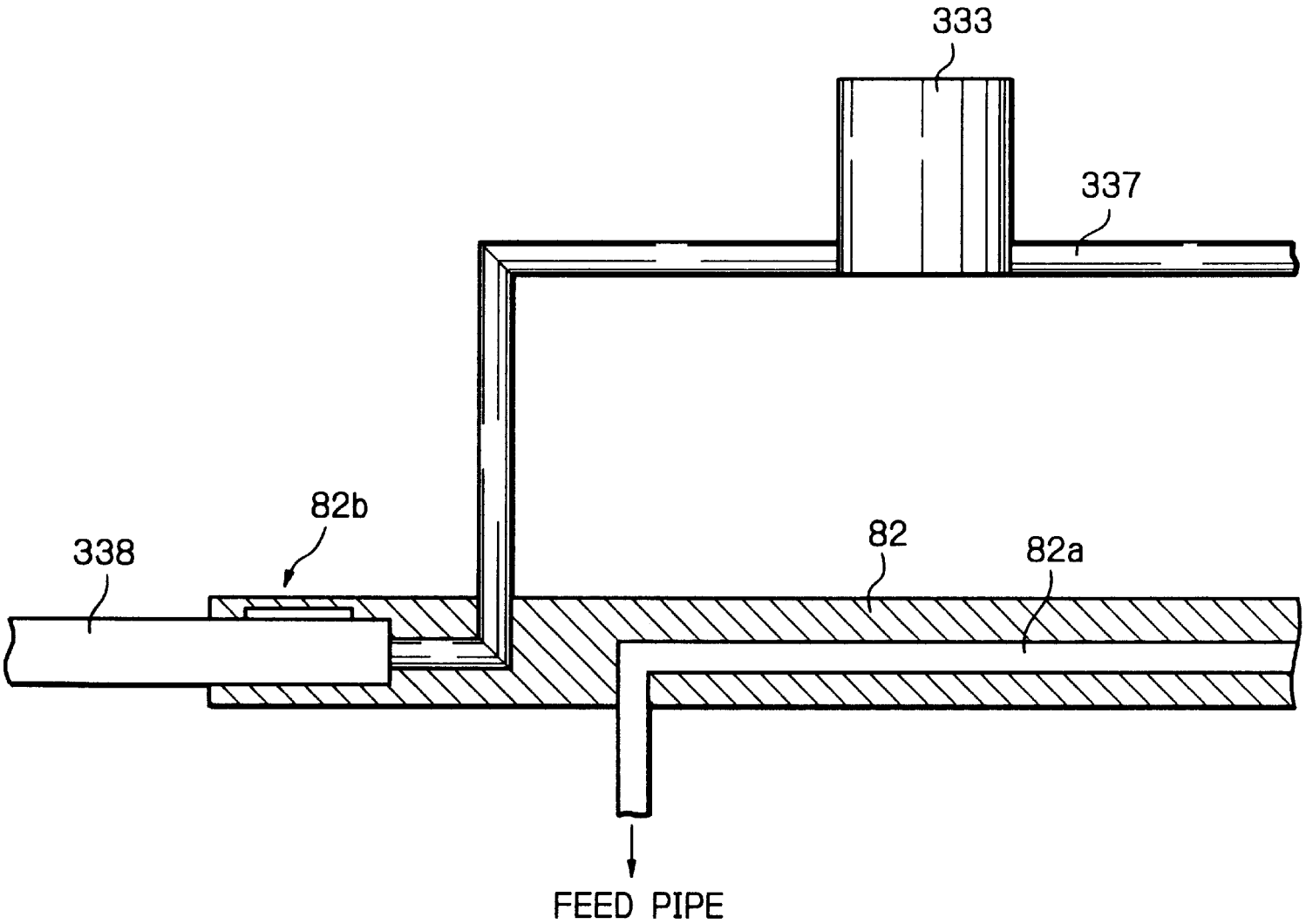
FIG. 28 is a fragmentary view of the ink collecting means of the fourth embodiment.
Figure 29A:
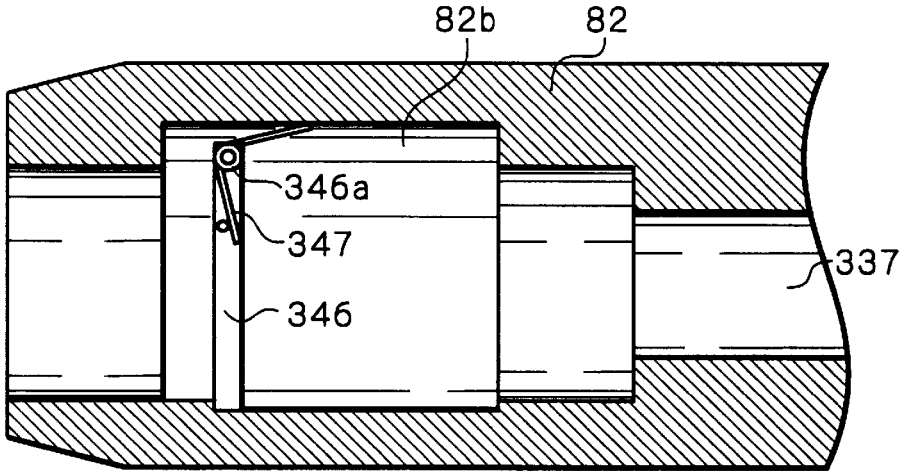
FIG. 29A shows the ink collecting means of the fourth embodiment without a collection pipe.

As shown in FIG. 28, the suction pipe 337 extends into the shaft 82 and terminates at the end portion of the shaft 82 opposite to the end portion where the ink inlet port is present. A collection pipe 338 is communicated to the suction pipe 337 via a connecting portion 82*b* formed in the above end portion of the shaft 82. As shown in FIG. 29A, the connecting portion 82*b* includes a valve 346 for selectively blocking the ink. The valve 346 is pivotally supported by the shaft 82 via a shaft 346*a*. A spring 347 is mounted on the shaft 346*a* and constantly biases the valve 346 in the closing direction.

Figure 30:
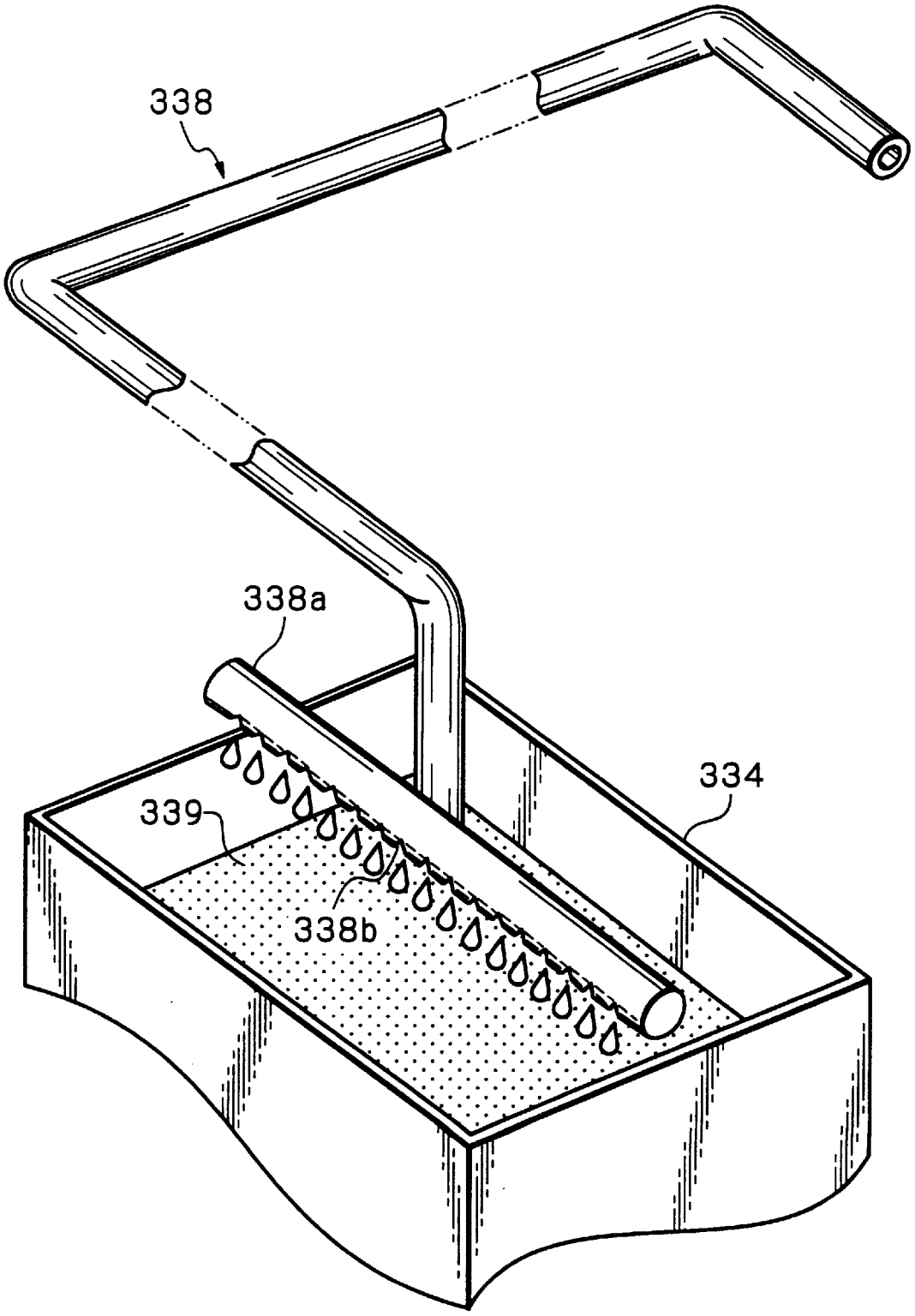
FIG. 30 is a perspective view of the collection pipe together with a waste ink box.

As shown in FIG. 30, the collection pipe 338 is bent at a plurality of portions thereof and has an outlet portion 338*a* positioned above the waste ink box 334. The outlet portion 338*a* has a configuration similar to the configuration of the outlet portion 295*b* of the second embodiment and is formed with a plurality of holes 338*b*.

Figure 29B:
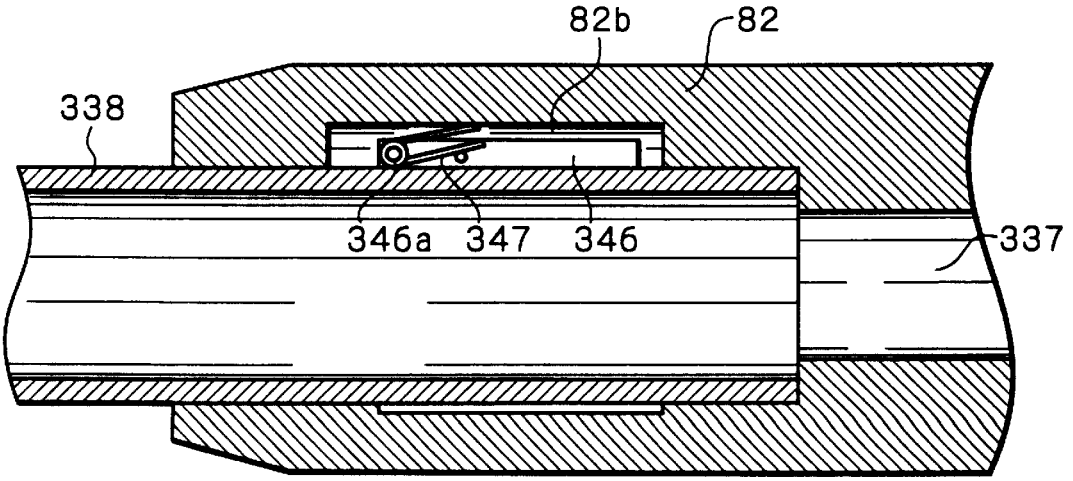
FIG. 29B shows the ink collecting means with the collection pipe.

The connection of the collection pipe 338 to the suction pipe 337 is as follows. When the ink drum 79 is mounted to the printer 1, the collection pipe 338 is inserted into the connecting portion 82*b* until its end abuts against the valve 346. As shown in FIG. 29B, when the collection pipe 338 is inserted deeper into the connecting portion 82*b*, it causes the valve 346 to pivot about the shaft 346*a* and open. As the collection pipe 338 is inserted further deeper into the connecting portion 82*b*, its end abuts against the end of the suction pipe 337. As a result, the two pipes 338 and 338 are fully connected to each other.

To remove the collection pipe 338, it is released from the connecting portion 82*b*. Consequently, the valve 346 closes due to the action of the spring 347 and thereby stops the connecting portion 82*b*.

The waste ink box 334 is removably mounted to the casing. A block of highly ink-absorptive porous material 339 is disposed in the waste ink box 334 for preventing the collected ink from dropping when it is discarded. The block 339 is sponge-like and may be formed of polyurethane by way of example. A weight sensor 349 responsive to the weight of the block 339 is positioned on the bottom of the waste ink box 334. When the weight of the block 334 absorbed the collected ink exceeds a preselected weight, the weight sensor 349 sends a signal to the control means 329 for informing it of such an occurrence.

Figure 31:
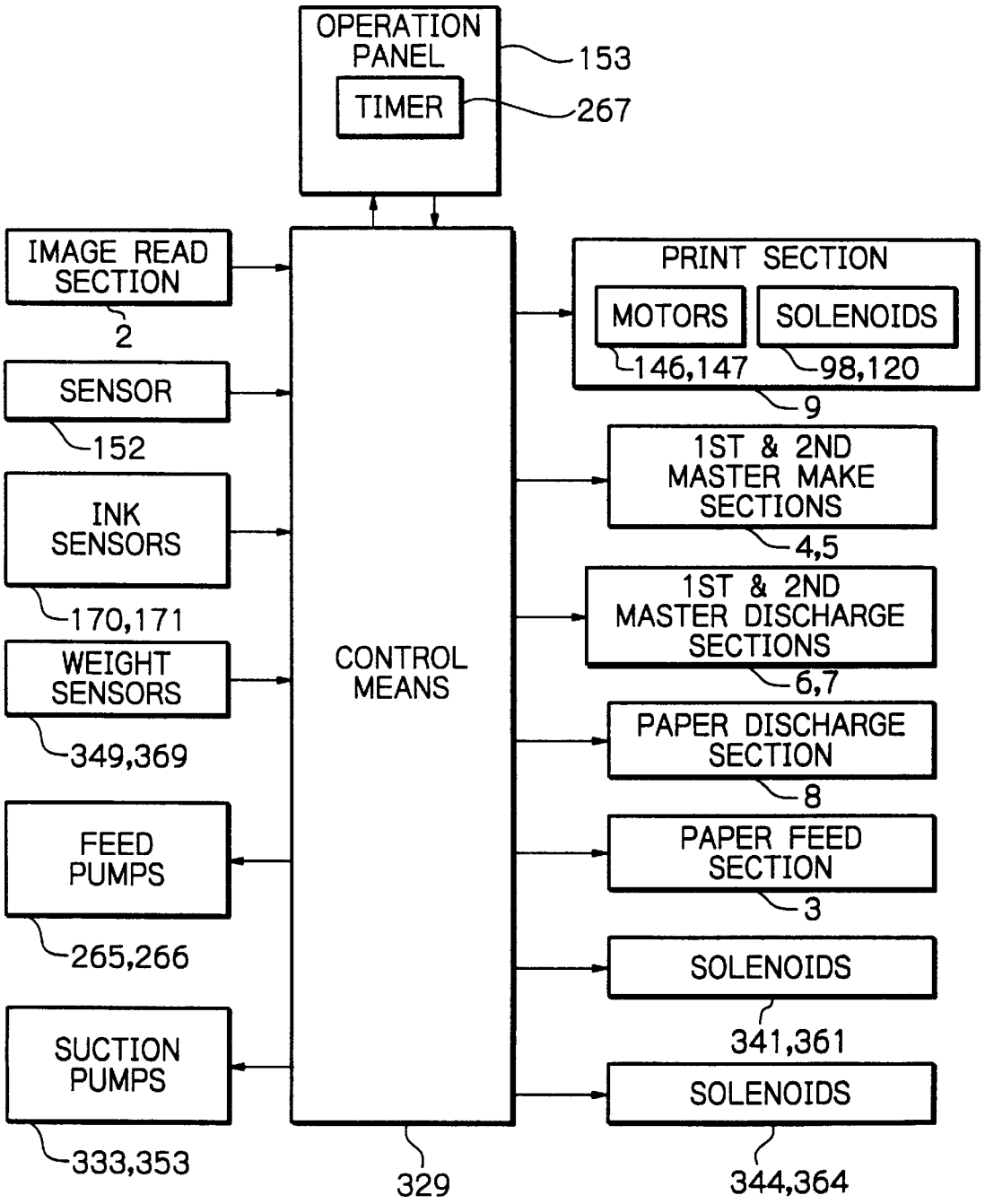
FIG. 31 is a schematic block diagram showing control means included in the fourth embodiment.

As shown in FIG. 25, second ink collecting means 350 is associated with the ink drum 80. The second ink collecting means 350 is essentially similar to the first ink collecting means 330 and will not be described specifically in order to avoid redundancy. The structural elements of the second means 350 identical with the structural elements of the first means 330 are simply distinguished by reference numerals. The control means 329 forms a part of the second in collecting means 350 as well. As shown in FIG. 31, the second ink collecting means 350 includes a blade 351, a backup roller 352, a solenoid 361 for moving the blade 351, and a solenoid 364 for moving the backup roller 352.

As shown in FIG. 31, the control means 329 controls the various sections of the printer 1 in response to the output signals of the various sections and various sensors by using the operation programs stored in a ROM.

The operation of the above embodiment will be described hereinafter. Because this embodiment is identical with the first embodiment as to the usual print mode operation, the following description will concentrate on the operation to occur after a long time of suspension of the printer 1. Assume that the operator presses the perforation start key 154 after the printer 1 has been left unused over a long period of time. Then, the first and second ink collecting means 330 and 350, respectively, are operated to collect the ink. Because the two ink collecting means 330 and 350 operate in exactly the same manner, only the operation of the first ink collecting means 330 will be described by way of example.

Specifically, when the perforation start key 154 is pressed, the control means 329 determines a period of time elapsed since the end of the last printing operation on the basis of the output of the timer 267. If the period of time elapsed is longer than a preselected period of time (threshold value), then the controller 329 sets up the ink collect mode. In the ink collect mode, used masters are discharged as in the usual print mode. After the discharge of the waste masters, the ink drum 79 is caused to start making a preselected number of rotations at a low speed. When the edge of the porous part of the porous support plate 83 reaches a position where it faces the blade 331, the control means 329 energizes the solenoids 341 and 344. As a result, the blade 331 and backup roller 332 each is moved from the dash-and-dots line position to the solid line position shown in FIG. 26, nipping the circumference of the ink drum 79. Stated another way, the blade 331 and backup roller 332 are pressed against each other via the circumference of the ink drum 79.

At the position where the blade 331 and backup roller 332 are pressed against each other, the ink present on the circumference of the ink drum 79 and lowered in viscosity is squeezed out to the inner periphery of the ink drum 79 by the backup roller 332. The blade 331 scrapes off this ink from the inner periphery of the ink drum 79. The ink removed by the blade 331 forms the pool 345 between the blade 331 and the inner periphery of the ink drum 79.

The control means 329 turns on the suction pump 333 at the same time as it energizes the solenoids 341 and 344. The suction pump 333 sucks the ink from the pool 345 via the suction pipe 337 and delivers it to the collection pipe 338 via the shaft 82. As the pump 333 further sucks the ink, the ink in the collection pipe 338 is discharged into the waste ink box 334.

Specifically, the ink drops from the holes 338*b* of the collection pipe 338 onto the porous block 339 existing in the waste ink box 334 and infiltrates into the block 339. It is noteworthy that the plurality of holes 338*b* allow the ink to efficiently infiltrate into the block 339.

When the ink drum 79 completes the preselected number of rotations, the control means 329 turns off the suction pump 333 and then deenergizes the solenoids 341 and 344. Consequently, the blade 331 and backup roller 332 each returns to the dash-and-dots line position away from the ink drum 79.

After the collection of the ink, the master making operation, master feeding operation and printing operation are sequentially executed in the same manner as in the usual print mode. In the illustrative embodiment, the operation for collecting the ink and the operation for pressing the ink drums 79 and 80 are executed at the same time.

When the weight of the porous block 339 absorbed the collected ink exceeds a preselected amount, e.g., when the amount of ink absorbed by the block 339 substantially reaches an allowable limit, the weight sensor 349 responsive to the weight of the block 339 sends a signal to the control means 329. In response, the control means 329 determines that the block 339 should be replaced, and displays a message for urging the operator to replace the block 339 on the display 164.

The operator watching the above message on the display 164 removes the waste ink box 334 from the casing 23, discards the block 339, sets a new block 339 in the box 334, and then mounts the box 334 to the casing 23. Because the ink has infiltrated into and retained by the block 339, the block 339 can be easily replaced without the ink dropping or smearing the surrounding.

With the above construction and operation, this embodiment also obviates blurring and offset during printing and thereby reduces the number of waste papers as far as possible so as to reduce the printing cost.

In the illustrative embodiment, the backup rollers 332 and 352 are located to face the blades 331 and 351, respectively. Alternatively, to omit the backup rollers 332 and 352, the blades 331 and 351 may be formed of a flexible material so as to collect (scrape off) the ink alone. This is because the flexibility of the blades 331 and 351 can replace the pressure to be exerted by the backup rollers 332 and 352. When the blades 331 and 351 collect the ink alone, the ink may be collected at any suitable time other than the time for discharging the used masters. For example, the ink collection may be automatically effected when the timer 267 counts more than a preselected period of time or may be manually effected on an exclusive key, not shown, provided on the operation panel 153.

Fifth Embodiment

Figure 32:
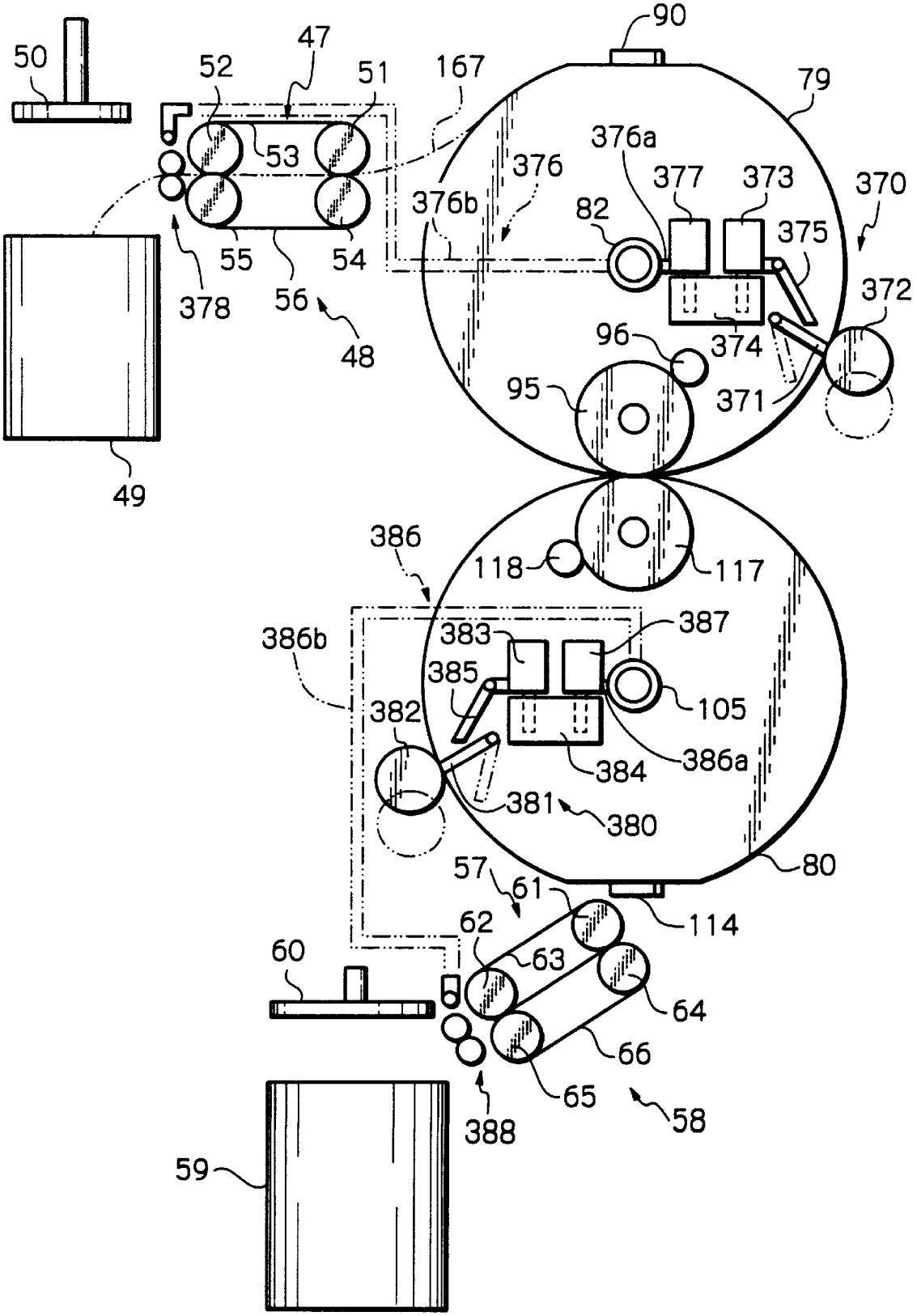
FIG. 32 shows first and second ink collecting means included in a fifth embodiment of the present invention.
Figure 33:
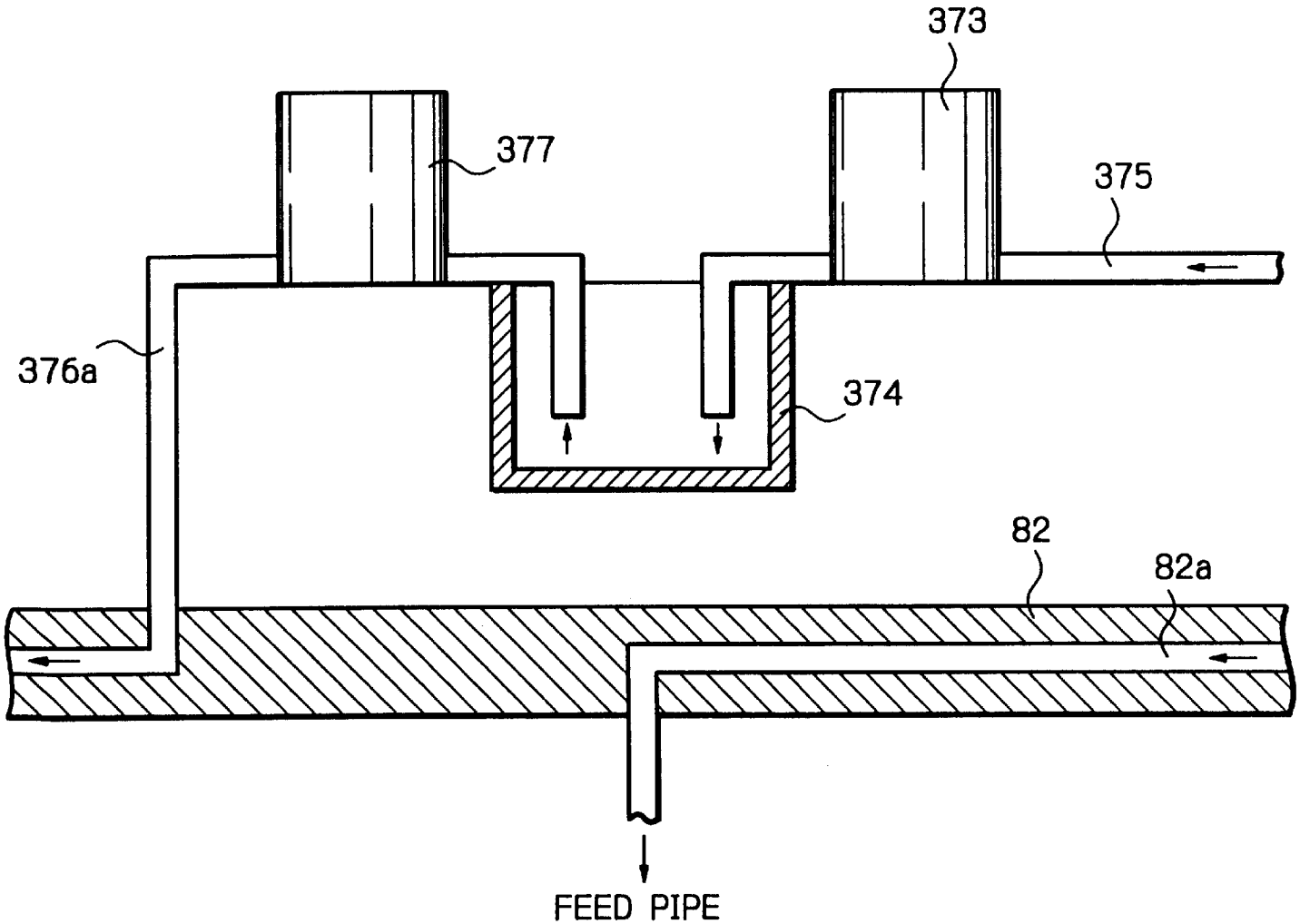
FIG. 33 is a fragmentary view of the first ink collecting means shown in FIG. 32.
Figure 34:
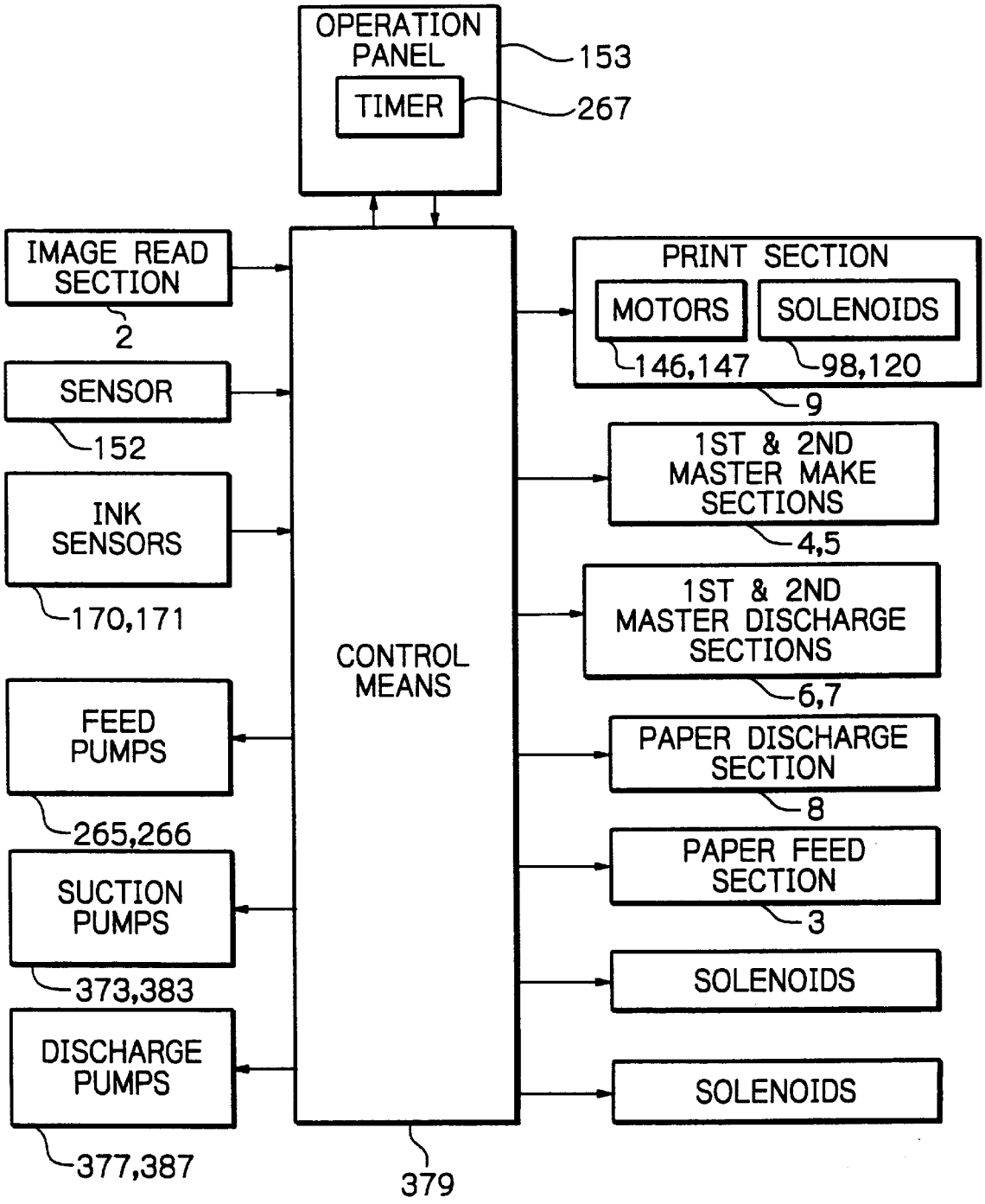
FIG. 34 is a schematic block diagram showing control means included in the fifth embodiment.

Reference will be made to FIGS. 32–34 for describing a fifth embodiment of the present invention. This embodiment is essentially similar to the fourth embodiment except that it temporarily stores the collected ink and deposits it on the used master. The structural elements of this embodiment identical with those of the fourth embodiment will not be described specifically in order to avoid redundancy.

As shown in FIG. 32, first ink collecting means 370 and second ink collecting means 380 are associated with the ink drums 79 and 80, respectively. Because the first and second ink collecting means 370 and 380 are essentially similar in construction to each other, the following description will concentrate on the first ink collecting means 370 by way of example. The structural elements of the second ink collecting means 380 are simply distinguished from those of the i first ink collecting means 370 by reference numerals. The operation of the second ink collecting means 380 for collecting, storing and applying the ink is identical with the operation of the first ink collecting means 380 and will not be described specifically.

As shown in FIG. 32, the first ink collecting means 370, like the first ink collecting means of the fourth embodiment, includes a blade or ink collecting member 371 for scraping off the ink from the inner periphery of the ink drum 79. A backup roller 372 is positioned to face the blade 371 with the intermediary of the circumference of the ink drum 79. A suction pump 373 sucks the ink removed by the blade 371. Blade moving means, not shown, moves the blade 371 into and out of contact with the inner periphery of the ink drum 79. Roller moving means, not shown, moves the backup roller 372 into and out of contact with the outer periphery of the ink drum 79. Control means 379 (see FIG. 34) controls the operation of the entire printer 1. A box-like receptacle or ink storing means 374 is positioned in the vicinity of the ink collecting means 370 for storing the ink sucked by the suction pump 373. The control means 379 forms a part of the second ink collecting means 380 as well.

The receptacle 374 is disposed in the ink drum 79 and supported by brackets, not shown, affixed to the shaft 82. A suction pipe 375 is communicated to the receptacle 374 for transferring the ink collected by the blade 371 to the receptacle 374. The suction pump 373 is mounted on the suction pipe 375, as illustrated.

A discharge pipe 376 is also communicated to the receptacle 374 for delivering the collected ink to an applicator roller pair 378 which will be described later. A discharge pump 377 is mounted on the discharge pipe 376 for delivering the ink from the receptacle 374 to the applicator roller pair 378. The applicator roller pair or ink depositing means 378 is positioned between the upper and lower discharge members 47 and 48 for depositing the collected ink on the used master 167.

The discharge pipe 376 is made up of a first pipe 376*a* and a second pipe 376*b*. The first pipe 376*a* is partly disposed in the shaft 82 and extends from the receptacle 374 to the end portion of the shaft 82 remote from the end portion where the ink inlet port is present. The second pipe 376*b* extends from the above end portion of the shaft to the applicator roller pair 378.

The shaft 82 has the connecting portion 82*b*, FIG. 29, where the first and second pipes 376*a* and 376*b* are connected together. In the illustrative embodiment, the first and second pipes 376*a* and 376*b* are respectively substituted for the suction pipe 337 and collection pipe 338 shown in FIG. 29.

The second pipe 376*b* has an outlet portion, not shown, similar to the outlet portion 295*b* of the pipe 295 of the second embodiment for discharging the collected ink. Control means 379 shown in FIG. 34 controls the two pumps 373 and 377.

The operation of the above embodiment will be described hereinafter. Because this embodiment is identical with the first embodiment as to the usual print mode operation, the following description will concentrate on the operation to occur after a long time of suspension of the printer 1. Assume that the operator presses the perforation start key 154 after the printer 1 has been left unused over a long period of time. Then, the first and second ink collecting means 370 and 380, respectively, are operated to collect the ink. Because the two ink collecting means 370 and 380 operate in exactly the same manner, only the operation of the first ink collecting means 370 will be described by way of example. Even the operation of the first ink collecting means 370 will be only briefly described because it is similar to the operation performed in the fourth embodiment.

Specifically, when the perforation start key 154 is pressed, the control means 379 causes used masters to be discharged and then causes the ink drum 79 to start rotating. At this instant, the control means 379 causes the blade 371 and backup roller 372 to press themselves against the circumference of the ink drum 79. In this condition, the blade 371 scrapes off the ink lowered in viscosity from the circumference of the ink drum 79. The ink removed by the blade 371 is sucked by the suction pump 373 and delivered to the receptacle 374 via the suction pipe 375.

The second ink collecting means 380 collects the ink from the ink drum 80. After the collection of the ink by the ink collecting means 370 and 380, the master making operation, master feeding operation and printing operation are sequentially executed in the same manner as in the usual print mode. In the illustrative embodiment, the operation for collecting ink and the operation for pressing the ink drums 79 and 80 are effected at the same time. At the time of the next discharge of used masters following the above procedure, the ink depositing means deposits the collected ink on the used master 167.

Specifically, the cooperative discharge members 47 and 48 peel off the used master 167 indicated by a dash-and-dots line in FIG. 32 from the outer periphery of the ink drum 79. When the master 167 removed from the ink drum 79 is conveyed toward the box 49, the control means 379 turns on the discharge pump 377. The discharge pump 377 delivers the collected ink from the receptacle 374 to the applicator roller 378 via the first and second pipes 376*a* and 376*b*.

As the used masters 167 is conveyed via the applicator roller pair 378, the roller pair 378 applies the collected ink to the film surface of the master 167. The used master 167 carrying the ink therewith is introduced into the box 49, compressed by the compressor 50, and then discarded.

This embodiment, like the previous embodiments, successfully obviates blurring and offset during printing and thereby reduces the number of waste papers and therefore the printing cost as far as possible. Further, the collected ink is deposited on the used masters 167 and 168 and discarded together with the masters 167 and 168, enhancing the efficiency of the printer 1. In addition, this embodiment reduces the number of disposable members including the porous blocks 260, 280, 339 and 359 and therefore the cost, compared to the first and fourth embodiments.

In the illustrative embodiment, the backup rollers 372 and 382 are also located to face the blades 371 and 381, respectively. Alternatively, to omit the backup rollers 372 and 382, the blades 371 and 381 may be formed of a flexible material so as to collect the ink alone. Again, when the blades 371 and 381 collect the ink alone, the ink may be collected at any suitable time other than the time for discharging the used masters. For example, the ink collection may be automatically effected when the timer 267 counts more than a preselected period of time or may be manually effected on an exclusive key, not shown, provided on the operation panel 153, as stated earlier.

Sixth Embodiment

A sixth embodiment of the present invention will be described with reference to FIGS. 35 and 36. This embodiment is essentially similar to the fifth embodiment except that it refeeds the collected ink into the main pipe and includes unique control means. The following description will concentrate on arrangements unique to the sixth embodiment.

Figure 35:
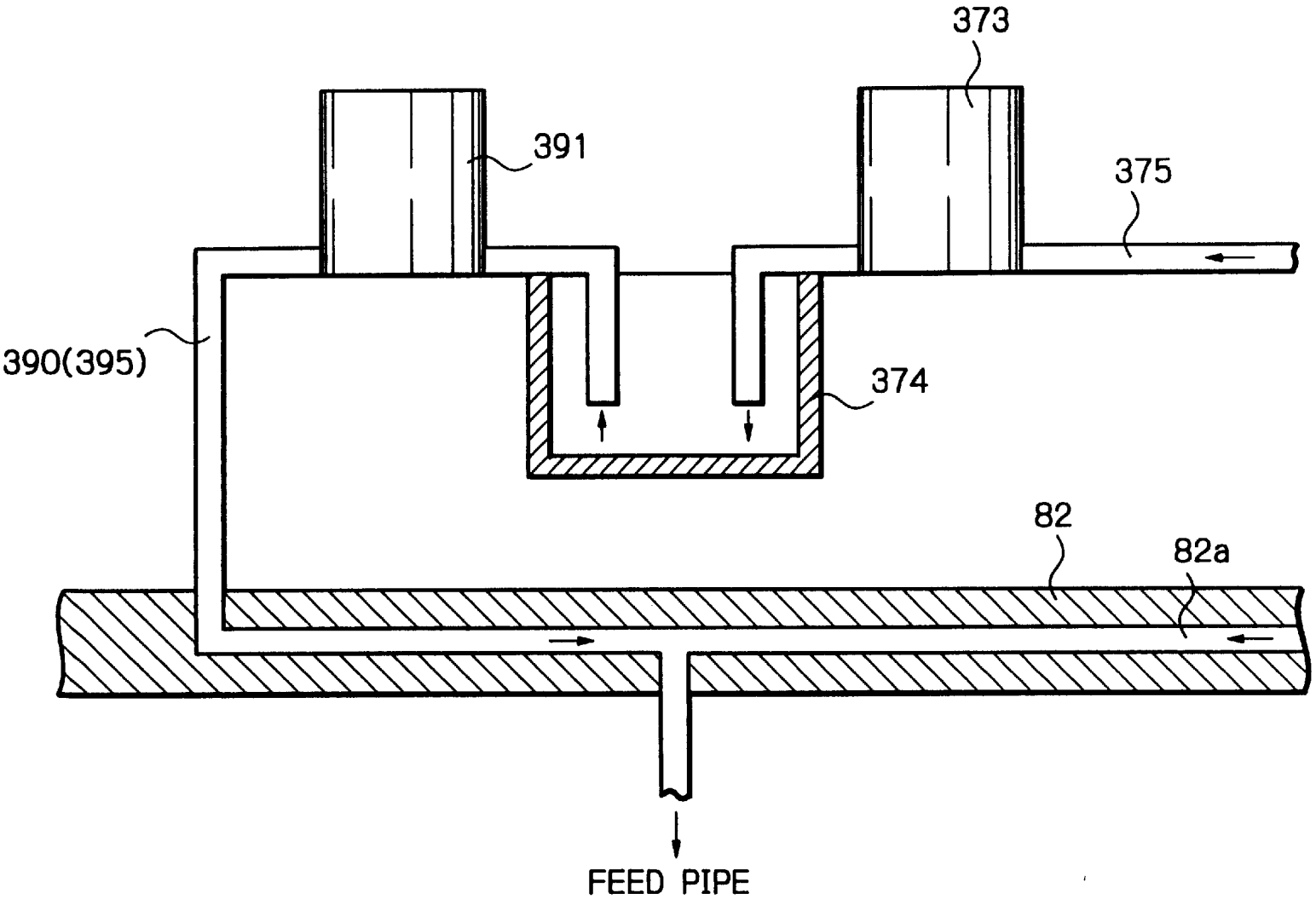
FIG. 35 is a fragmentary view showing ink collecting means included in a sixth embodiment.

As shown in FIG. 35, a refeed pipe 390 is connected to the receptacle 374 for refeeding the collected ink to the main pipe 82*a* of the shaft 82. The refeed pipe 390 is partly disposed in the shaft 82 and connected to the main pipe 82*a* within the shaft 82. A refeed pump 391 is mounted on the refeed pipe 390 for delivering the collected ink from the receptacle 374 into the main pipe 82*a*.

Figure 36:
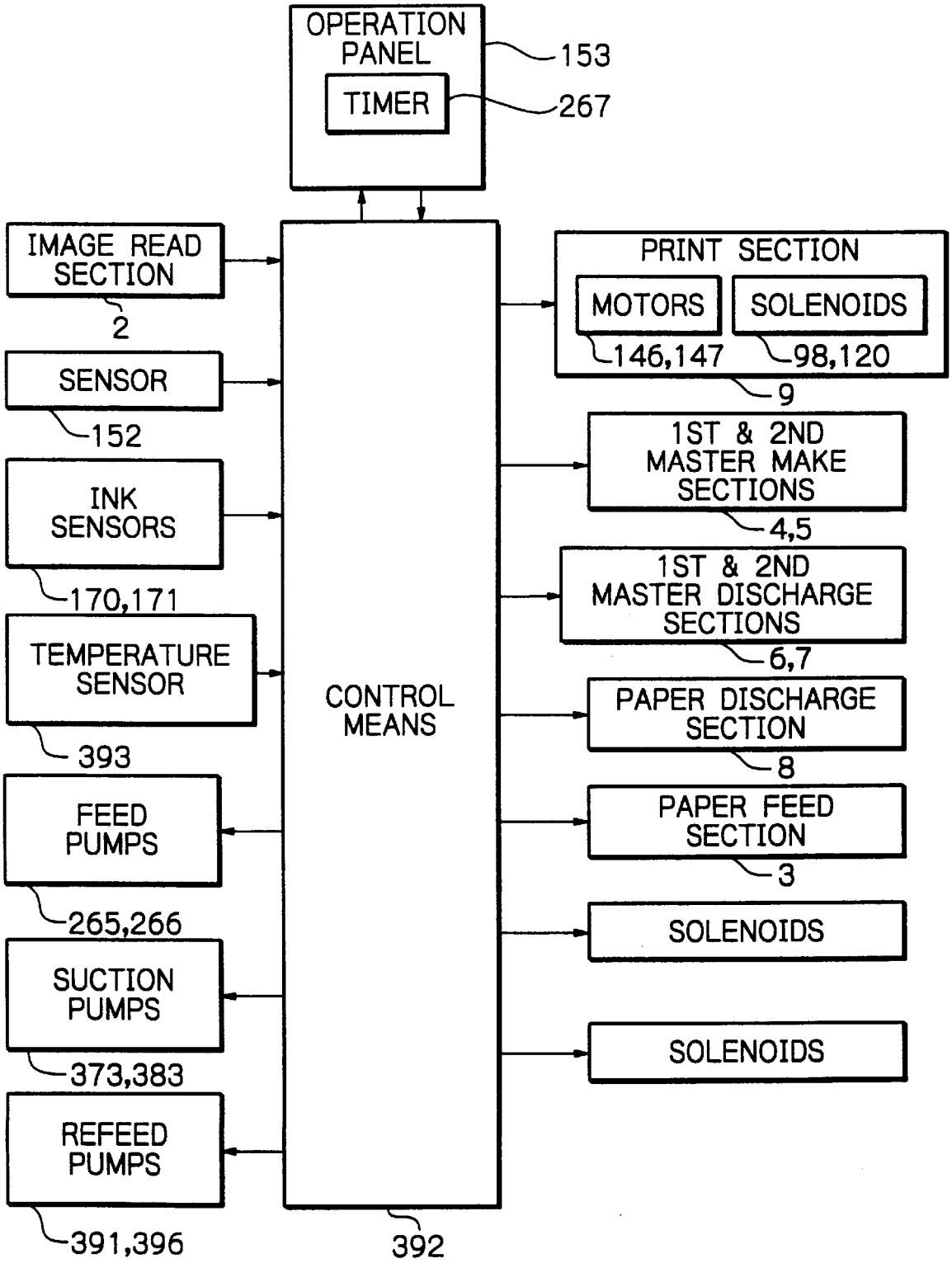
FIG. 36 is a schematic block diagram showing control means included in the sixth embodiment.

The refeed pump 391 has the same performance and capacity as the feed pump 265 and is controlled by control means 392 shown in FIG. 36. The refeed pipe 390 and refeed pump 391 constitute ink refeeding means. A refeed pipe 395 and a refeed pump 396 for refeeding collected ink are also disposed in the ink drum 80.

A temperature sensor or temperature sensing means 393 (see FIG. 36) is disposed in the printer 1 for sensing temperature inside the printer 1. As shown in FIG. 36, the temperature sensor 393 sends its output representative of temperature to the control means 392.

The operation of the illustrative embodiment will be described hereinafter. Because this embodiment is identical with the first embodiment as to the usual print mode operation, the following description will concentrate on the operation to occur after a long time of suspension of the printer 1, i.e., the refeed of the collected ink. The ink collecting operation of this embodiment is similar to the operation of the fifth embodiment and will not be described specifically. Further, because the operations to occur within the ink drums 79 and 80 are identical, only the operation to occur in the ink drum 79 will be described.

After the discharge of used masters, ink is collected from the circumference of the ink drum 79 and stored in the receptacle 374. This is followed by the master making operation, master feeding operation and printing operation as in the usual print mode. In the illustrative embodiment, the operation for collecting ink and the operation for pressing the ink drums 79 and 80 are effected at the same time. When the amount of ink in the ink well 96*a* decreases during printing, the sensor 170 sends its output to the control means 392. In response, the control means 392 turns on the two pumps 265 and 391.

The feed pump 265 delivers fresh ink from the ink pack to the ink well 96*a* via the main pipe 82*a* of the shaft 82. At the same time, the refeed pump 391 refeeds the collected ink from the receptacle 374 to the main pipe 82*a* via the refeed pipe 390. The fresh ink and collected ink are mixed together at the position where the main pipe 82*a* and refeed pipe 390 join each other. The mixed ink is fed to the ink well 96*a* via the feed pipe 129. In this manner, the collected ink is fed to the ink well 96*a* and again used for printing. This promotes the efficient use of the ink other than the ink discarded together with the used master 167 and reduces ink consumption and therefore cost.

The fresh ink from the ink pack and the collected ink from the receptacle 374 are mixed together in a particular ration, as follows. Generally, the viscosity of ink is dependent on temperature. When temperature is low, the viscosity of ink increases and makes it difficult for the ink to penetrate the perforations of a master, rendering image density low. When temperature is high, the viscosity decreases and allows ink to easily penetrate the perforations, rendering image density high. In light of this, this embodiment adjusts the mixture ratio of the fresh ink and collected ink whose viscosity is low, and thereby adjusts the viscosity of the mixed ink.

Specifically, when ink should be fed to the ink well 96*a*, the controller 392 reads temperature represented by the output of the temperature sensor 393. If temperature inside the printer 1 is medium, e.g., between 15° C. and 30° C., then the control means 392 mixes the fresh ink and collected ink in a ratio of 10:2. Although the resulting mixture is slightly lower in viscosity than the fresh ink, such a decrease in density does not render image density excessively high or aggravate blurring or offset.

When temperature inside the printer 1 is low, the control means 392 increases the ratio of the collected ink to the total mixture. For example, when temperature inside the printer 1 is lower than 15° C., the control means 392 mixes the fresh ink and collected ink in a ratio of 10:3. By so increasing the amount of the collected ink, it is possible to lower the viscosity of the mixture and prevent image density from decreasing.

When temperature inside the printer 1 is high, the control means 392 reduces the ratio of the collected ink to the total mixture. For example, when temperature inside the printer 1 is higher than 30° C., the control means 392 mixes the fresh ink and collected ink in a ratio of 10:1. By so reducing the amount of the collected ink, it is possible to raise the viscosity of the mixture and prevent image density from increasing. In addition, the collected ink can be reused.

When the mixture ratio between the fresh ink and the collected ink is adjusted in accordance with temperature, the ink in the ink well can maintain substantially constant viscosity without regard to the ambient temperature, insuring stable image density at all times.

In the illustrative embodiment, the backup rollers are also located to face the associated blades. Alternatively, to omit the backup rollers, the blades may be formed of a flexible material so as to collect the ink alone. Again, when the blades collect the ink alone, the ink may be collected at any suitable time other than the time for discharging the used masters. For example, the ink collection may be automatically effected when the timer 267 counts more than a preselected period of time or may be manually effected on an exclusive key, not shown, provided on the operation panel 153, as stated earlier.

Seventh Embodiment

A seventh embodiment of the present invention will be described with reference to FIGS. 37–39. This embodiment is essentially similar to the fifth embodiment except that it combines the deposition of the collected ink on the used master 167 of the fifth embodiment and the refeed of the collected ink to the main pipe 82*a* of the sixth embodiment.

Figure 37:
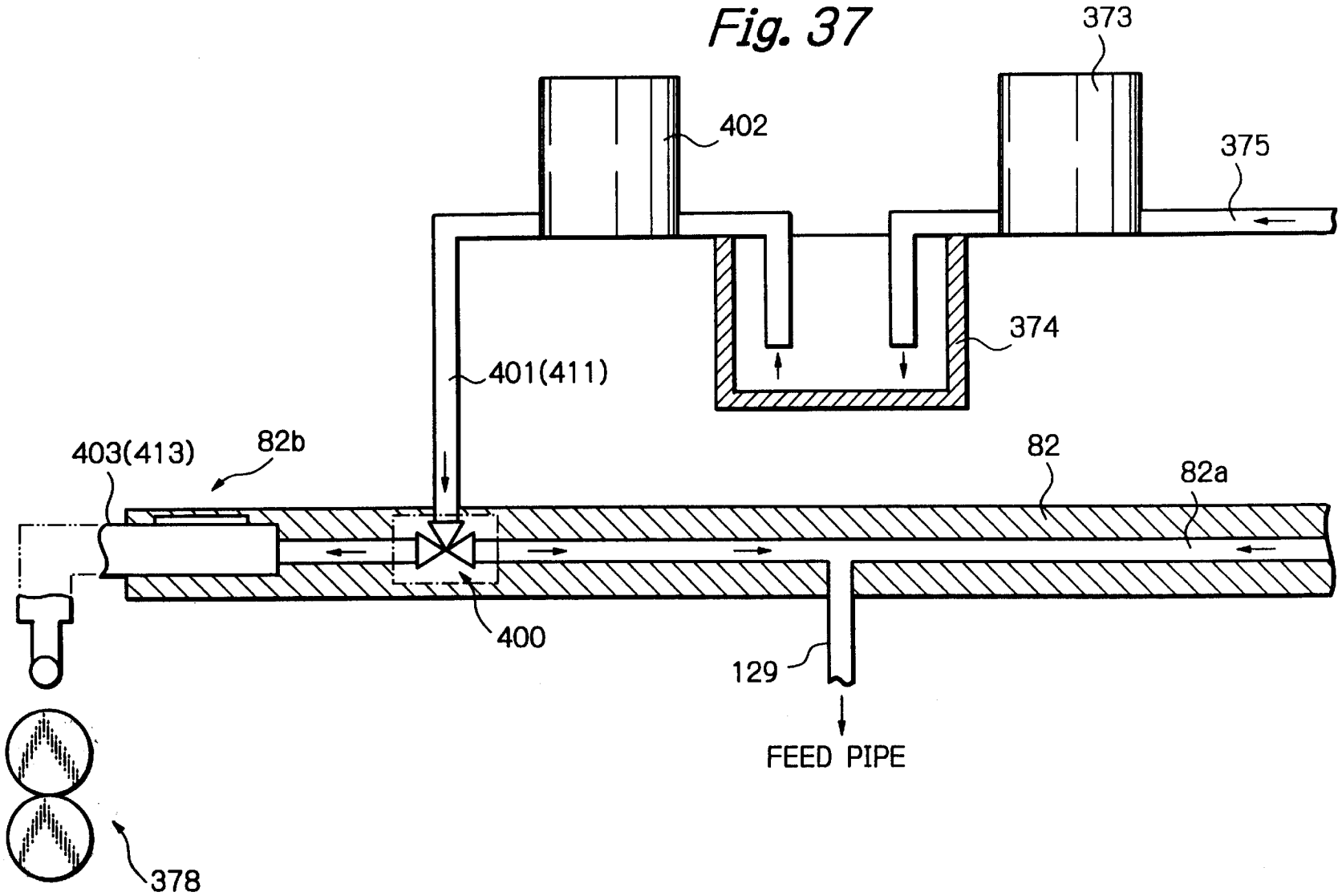
FIG. 37 is a fragmentary view of ink collecting means included in a seventh embodiment of the present invention.

As shown in FIG. 37, the main pipe 82 of the shaft 82 is connected to the connecting port ion 82*b*. A directional control valve or selector 400 is positioned between the connecting portion 82*b* of the main pipe 82*a* and the feed pipe 129. A first discharge pipe 401 is connected to the valve 400 and communicated to the receptacle 374. A discharge pump 402 is mounted on the first discharge pipe 401 for de delivering the collected ink from the receptacle 374 to the valve 400. The second pipe 403 for delivering the collected ink to the applicator roller pair 378, as stated in relation to the fifth embodiment, is connected to the connecting portion 82*b*. Controller 404 (see FIG. 39) causes the directional control valve 400 to selectively feed the collected ink from the receptacle 374 to the main pipe 82*a* or the applicator roller pair 378.

Figure 38:
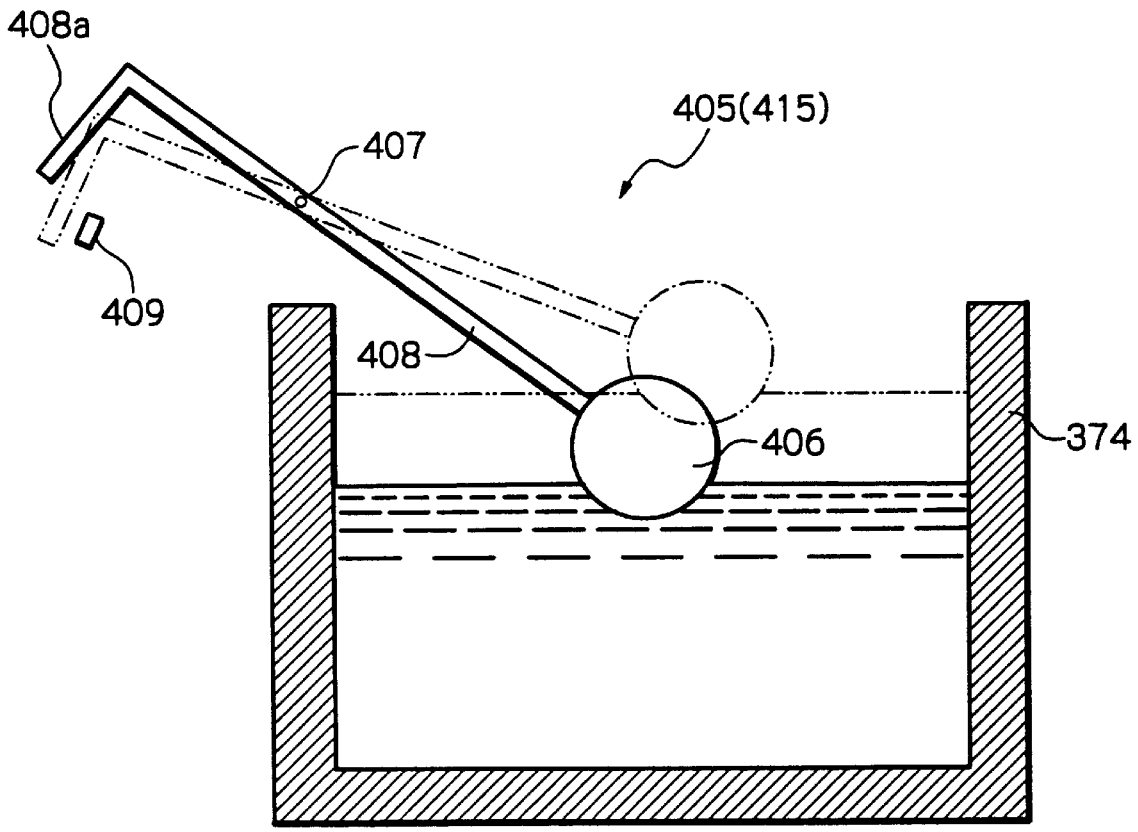
FIG. 38 is an enlarged view of a receptacle included in the seventh embodiment.
Figure 39:
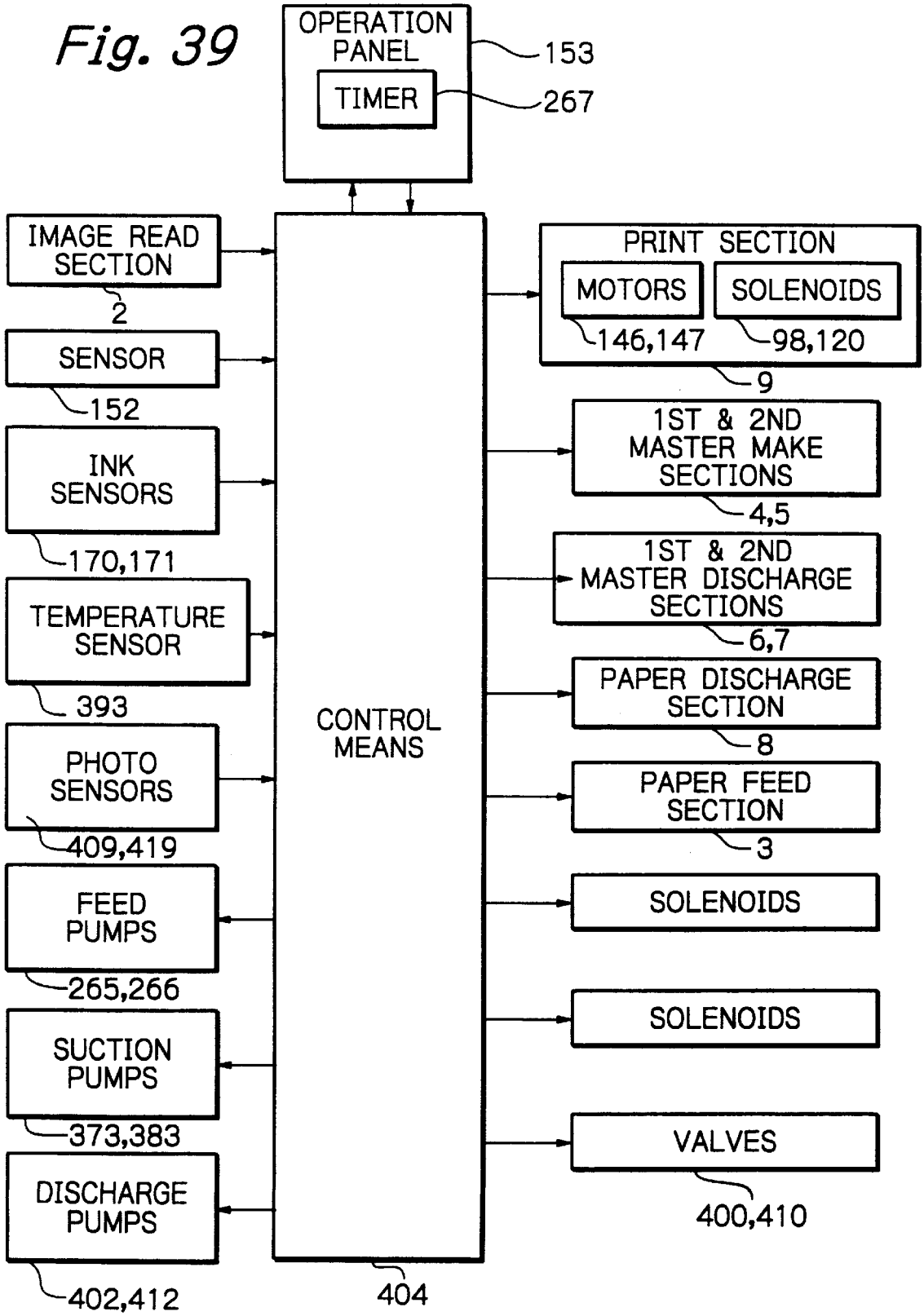
FIG. 39 is a schematic block diagram showing control means included in the seventh embodiment.

As shown in FIG. 38, collected ink sensing means 405 is associated with the receptacle 374 for determining whether or not the receptacle 374 has been filled up with the collected ink. The collected ink sensing means 405 mainly consists of a float 406 floating on the surface of the collected ink, a support arm 408 supporting the float 406 and rotatable about the shaft 407, and a photosensor 408 for sensing the end of the support arm 408*a*. When the ink collected in the receptacle 374 rises to a preselected level and causes the support arm 408 to angularly move, the photosensor 409 senses the end 408*a* of the support arm 408 and sends its output to the control means 404.

A first discharge pipe 411, a second discharge pipe 413, a d discharge pump 412 and collected ink sensing means 415 are also disposed in the ink drum 80. A directional control valve 410 identical with the valve 400 is disposed in the shaft 105.

As for the usual print mode operation, this embodiment is similar to the first embodiment. The following description will concentrate on the operation to occur after a long time of suspension. While this embodiment first collects ink, the collection of ink will not be described because it is identical with the collection of ink executed in the fifth embodiment. Further, only the operation to occur within the ink drum 79 will be described by way of example.

After the discharge of used masters, the ink is collected from the circumference of the ink drum 79 and stored in the receptacle 374. This is followed by the master making operation, master feeding operation and printing operation as in the usual print mode. In the illustrative embodiment, the operation for collecting the ink and the operation for pressing the ink drums 79 and 80 are effected at the same time. When the controller 404 determines, based on the output of the sensor 170, that the amount of ink in the ink well 96*a* is short, it operates the directional control valve 400 so as to communicate the first discharge pipe 401 to the main pipe 82*a*. Subsequently, the control means 404 turns on the feed pumps 265 and discharge pump 402.

The feed pump 265 delivers fresh ink from the ink pack to the ink well 96*a* via the main pipe 82*a* of the shaft 82. At the same time, the discharge pump 402 delivers the collected ink from the receptacle 374 to the main pipe 82*a* via the discharge pipe 401. The fresh ink and collected ink are mixed together at the position where the main pipe 82*a* and discharge pipe 401 join each other. The mixed ink is fed to the ink well 96*a* via the feed pipe 129. In this manner, the co collected ink is again fed to the ink well 96*a* and used for printing. This promotes the efficient use of the ink other than the ink discarded together with the used master 167 and reduces ink consumption and therefore cost.

However when temperature inside the printer 1 is high and the amount of collected ink refed to the ink well 96*a* is short or when the ink collection is frequency repeated within a short period of time, the amount of ink collected in the receptacle 374 increases. It follows that when the ink is collected more than it is refed, the amount of ink in the receptacle 374 increases and is apt to fill up the receptacle 374.

In light of the above, the collected ink sensing means 405 senses the ink level in the receptacle 374. If the receptacle 374 is full at the time of discharge of used masters, the control means 404 operates the valve 400 so as to communicate the first discharge pipe 401 to the second discharge pipe 403. Then, the control means 404 turns on the discharge pump 402. The discharge pump 402 delivers the collected ink from the receptacle 374 to the applicator roller pair 378 via the first and second discharge pipes 401 and 402. The applicator roller pair 378 deposits the collected ink on the used master 167. As a result, the collected ink is discarded together with the used master 167.

As stated above, the illustrative embodiment monitors the amount of ink collected in the receptacle 374. When the ink is collected more than it is refed and increases the ink level in the receptacle 374, the ink in the receptacle 374 is discarded. Therefore, even when the space available in the receptacle 374 for the collected ink decreases, the embodiment successfully operates and effectively uses the collected ink.

In the first to seventh embodiments shown and described, both of the ink feeding means 84 and 107 are constructed to be movable. Alternatively. an arrangement may be made such that one of the two ink feeding means 84 and 107 is fixed in place with its ink roller adjoining the inner periphery of the porous support plate while the other ink feeding means is movable. This is also successful to press the porous support plates of the ink drums 79 and 80 against each other. In such a case, the movable ink feeding means 84 or 107, like the ink feeding means 84, will be allowed to angularly move about the shaft 82 or 105.

Further, the ink collecting means of the present invention achieves the above various advantages even when applied to a stencil printer of the type moving one ink drum relative to the other or stationary ink drum for producing duplex printings, as taught in, e. g., Japanese Patent Laid-Open Publication No. 6-71996 or 6-135111 mentioned earlier. Of course, the ink collecting means of the present invention is applicable to a stencil printer having only a simplex printing capability as distinguished form the duplex printing capability shown and described.

In summary, it will be seen that the present invention provides a stencil printer having various unprecedented advantages, as enumerated below.

(1) Ink collecting means collects ink from the circumference of an ink drum and thereby maintains the circumference in a desirable condition.

(2) When a period of time counted by time counting means exceeds a preselected period of time, the ink collecting means collects ink deposited on the circumference of the ink drum and lowered in viscosity due to a long time of suspension of the printer. This obviates blurring and offset during printing and thereby reduces the number of waste papers as far as possible so as to reduce the printing cost.

(3) Ink collected in ink storing means is applied to a used master. The collected ink is therefore absorbed by the used master and discarded together with the used master, enhancing operation efficiency.

(4) Ink stored in the ink storing means is refed to an ink well formed in the ink drum and again used for printing. This promotes the efficient use of ink and reduces ink consumption and therefore cost.

(5) Ink collected in the ink storing means is selectively refed to the ink well or deposited on the used master, depending on the amount of ink collected in the ink storing means. The collected ink can therefore be reused. Further, the collected ink can be discarded together with the used master. In addition, when the ink is collected more than it is reused and raises the ink level in the ink storing means, the collected ink is discarded in order to guarantee a space in the ink storing means for storing the ink.

(6) The amount of collected ink to be refed to the ink well is adjusted in accordance with temperature inside the printer, so that a mixture ratio between the collected ink and fresh ink is adequately adjusted. Ink in the ink well can therefore maintain substantially constant viscosity without regard to the ambient temperature, insuring stable image density at all times.

(7) At the time of ink collection, the amount of ink to be fed from the ink well to the circumference of the ink drum is increased. This allows the ink in the ink well and lowered in viscosity to be rapidly collected. As a result, most of the ink existing in the printer and lowered in viscosity is collected, so that desirable printings can be produced thereafter. In addition, the number of waste papers and therefore cost can be reduced more positively.

(8) Two ink drums are caused to make a preselected number of rotations in pressing contact with each other. This is successful to level the ink left on the outer peripheries of the ink drums due to the perforations of used masters. As a result, the ink on each drum is uniformed in density and fills the outer periphery of the drum. Therefore, the ink can be smoothly fed at the beginning of printing in a duplex print mode. In addition, there can be obviated irregularity in density just after the beginning of printing. Consequently, the number of waste papers and therefore printing cost can be reduced.

(9) Ink can be surely collected at a preselected timing matching with the movement of the ink drum.

(10) A blade is capable of scraping off ink from the periphery of the ink drum alone, using its own property. The arrangement is therefore simpler and lower in cost than the arrangement using a backup roller in combination with a blade for ink collection.

(11) The ink collecting means playing the role of ink storing means and ink depositing means at the same time further simplifies the arrangement and reduces the production cost.

Various modifications will become possible for those skilled in the art after receiving the teachings of the present disclosure without departing from the scope thereof.

What is claimed is:

1. A stencil printer for printing an image on a recording medium by wrapping a perforated master around an ink drum, feeding ink to said ink drum, and causing said ink to ooze out via said ink drum and said perforated master, said stencil printer comprising:

an ink collector positioned and configured to collect the ink deposited on a circumference of said ink drum while rotating in an opposite direction to rotation of said ink drum;

a backup device positioned and configured to press said circumference of said ink drum against said ink collector; and an ink storing device positioned and configured to store the ink collected by said ink collector.

2. A stencil printer as claimed in claim 1, further comprising an ink depositing device positioned and configured to deposit the ink stored in said ink storing device on a used master.

3. A stencil printer as claimed in claim 2, wherein said ink collector includes a roller capable of absorbing and retaining the ink and constitutes said ink storing device and said ink depositing device at the same time.

4. A stencil printer as claimed in claim 1, further comprising an ink refeeding device positioned and configured to refeed the ink from said ink storing device to an ink well formed in said ink drum.

5. A stencil printer as claimed in claim 4, further comprising a temperature sensor positioned and configured to sense temperature inside of a body of said stencil printer, wherein when temperature inside said body varies, as determined by said temperature sensor, said ink refeeding device adjusts an amount of the ink to be reused in accordance with the temperature such that the ink in said ink well maintains substantially constant density.

6. A stencil printer as claimed in claim 1, further comprising:

a collected ink sensor positioned and configured to sense an amount of the ink stored in said ink storing device;

an ink refeeding device positioned and configured to refeed, when said collected ink sensor determines that the amount of the ink is smaller than a preselected amount, the ink from said ink storing device to an ink well formed in said ink drum; and an ink depositing device positioned and configured to deposit, when said collected ink sensor determines that the amount of the ink is greater than the preselected amount, the ink from said ink storing device to a used master.

7. A stencil printer as claimed in claim 1, further comprising ink increasing means for increasing, when said ink collector collects the ink, an amount of the ink to be fed from an ink well formed in said ink drum to the circumference of said ink drum.

8. A stencil printer as claimed in claim 1, wherein said ink drum comprises a first ink drum member and a second ink drum member positioned and configured to produce a duplex printing in a single step.

9. A stencil printer as claimed in claim 8, further comprising:

first and second drum moving means for moving an outer periphery of said first ink drum member and an outer periphery of said second ink drum member, respectively, into and out of contact with each other; and control means for controlling said first and second drum moving means, wherein said control means causes, after said ink collector has collected the ink, the outer periphery of said first ink drum member and the outer periphery of said second ink drum member to contact each other and causes each of said first ink drum member and said second ink drum member to make a preselected number of rotations.

10. A stencil printer as claimed in claim 1, wherein said ink collector comprises:

an ink collecting member;

moving means for moving said ink collecting member into and out of contact with the circumference of said ink drum; and control means for causing said ink collecting member to contact the circumference of said ink drum at a preselected timing.

11. A stencil printer as claimed in claim 1, wherein said backup device comprises a backup roller disposed inside said ink drum and being in contact with an inner periphery of said ink drum.

12. A stencil printer for printing an image on a recording medium by wrapping a perforated master around an ink drum, feeding ink to said ink drum, and causing said ink to ooze out via said ink drum and said perforated master, said stencil printer comprising:

time counting means for counting a period of time elapsed since an end of a last printing;

an ink collector positioned and configured to collect, when the period of time counted by said time counting means is longer than a preselected period of time, the ink from a circumference of said ink drum;

a backup device positioned and configured to press said circumference of said ink drum against said ink collector; and an ink storing device positioned and configured to store the ink collected by said ink collector.

13. A stencil printer as claimed in claim 12, further comprising an ink depositing device positioned and configured to deposit the ink stored in said ink storing device on a used master.

14. A stencil printer as claimed in claim 13, wherein said ink collector includes a roller capable of absorbing and retaining the ink and constitutes said ink storing device and said ink depositing device at the same time.

15. A stencil printer as claimed in claim 12, further comprising an ink refeeding device positioned and configured to refeed the ink from said ink storing device to an ink well formed in said ink drum.

16. A stencil printer as claimed in claim 15, further comprising a temperature sensor positioned and configured to sense temperature inside of a body of said stencil printer, wherein when temperature inside said body varies, as determined by said temperature sensor, said ink refeeding device adjusts an amount of the ink to be reused in accordance with the temperature such that the ink in said ink well maintains substantially constant density.

17. A stencil printer as claimed in claim 12, further comprising:

a collected ink sensor positioned and configured to sense an amount of the ink stored in said ink storing device;

an ink refeeding device positioned and configured to refeed, when said collected ink sensor determines that the amount of the ink is smaller than a preselected amount, the ink from said ink storing device to an ink well formed in said ink drum; and an ink depositing device positioned and configured to deposit, when said collected ink sensor determines that the amount of the ink is greater than the preselected amount, the ink from said ink storing device to a used master.

18. A stencil printer as claimed in claim 12, further comprising ink increasing means for increasing, when said ink collector collects the ink, an amount of the ink to be fed from an ink well formed in said ink drum to the circumference of said ink drum.

19. A stencil printer as claimed in claim 12, wherein said ink drum comprises a first ink drum member and a second ink drum member positioned and configured to produce a duplex printing in a single step.

20. A stencil printer as claimed in claim 19, further comprising:

first and second drum moving means for moving an outer periphery of said first ink drum member and an outer periphery of said second ink drum member, respectively, into and out of contact with each other; and control means for controlling said first and second drum moving means, wherein said control means causes, after said ink collector has collected the ink, the outer periphery of said first ink drum member and the outer periphery of said second ink drum member to contact each other and causes each of said first ink drum member and said second ink drum member to make a preselected number of rotations.

21. A stencil printer as claimed in claim 12, wherein said ink collector comprises:

an ink collecting member;

moving means for moving said ink collecting member into and out of contact with the circumference of said ink drum; and control means for causing said ink collecting member to contact the circumference of said ink drum at a preselected timing.

22. A stencil printer as claimed in claim 12, wherein said ink collector comprises a flexible blade configured to remove the ink from an inner periphery of said ink drum by pressing against said inner periphery.

23. A stencil printer for printing an image on a recording medium by wrapping a perforated master around an ink drum, feeding ink to said ink drum, and causing said ink to ooze out via said ink drum and said perforated master, said stencil printer comprising:

ink collecting means for collecting the ink deposited on a circumference of said ink drum while rotating in an opposite direction to rotation of said ink drum;

backup means for pressing said circumference of said ink drum against said ink collecting means; and ink storing means for storing the ink collected by said ink collecting means.

24. A stencil printer as claimed in claim 23, further comprising ink increasing means for increasing, when said ink collecting means collects the ink, an amount of the ink to be fed from an ink well formed in said ink drum to the circumference of said ink drum.

25. A stencil printer for printing an image on a recording medium by wrapping a perforated master around an ink drum, feeding ink to said ink drum, and causing said ink to ooze out via said ink drum and said perforated master, said stencil printer comprising:

an ink collector positioned and configured to collect the ink deposited on a circumference of said ink drum;

a backup device positioned and configured to press said circumference of said ink drum against said ink collector; and an ink storing device positioned and configured to store the ink collected by said ink collector, wherein said ink collector contacts said ink drum after a discharge of the perforated master from said ink drum to thereby remove the ink.

26. A stencil printer as claimed in claim 25, wherein said ink collector comprises a flexible blade configured to remove the ink from an inner periphery of said ink drum by pressing against said inner periphery.

27. A stencil printer for printing an image on a recording medium by wrapping a perforated master around an ink drum, feeding ink to said ink drum, and causing said ink to ooze out via said ink drum and said perforated master, said stencil printer comprising:

an ink collector positioned and configured to collect the ink deposited on a circumference of said ink drum while rotating in an opposite direction to rotation of said ink drum, wherein said ink collector rotates by following rotation of said ink drum;

a backup device positioned and configured to press said circumference of said ink drum against said ink collector; and an ink storing device positioned and configured to store the ink collected by said ink collector.

* * * * *

UNITED STATES PATENT AND TRADEMARK OFFICE

CERTIFICATE OF CORRECTION

PATENT NO. : 6,263,791 B1
DATED : July 24, 2001
INVENTOR(S) : Makoto Sato

It is certified that error appears in the above-identified patent and that said Letters Patent is hereby corrected as shown below:

Column 4,
Line 10, delete "4".

Column 5,
Line 14, after "252" insert -- is --.

Column 7,
Line 33, change "damper" to -- clamper --;
Line 36, (second occurrence) change "damper" to -- clamper --;
Line 38, change "damper" to -- clamper --.

Column 8,
Line 27, change "determined" to -- determine --;
Line 37, change "port ion" to -- portion --.

Column 9,
Line 7, change "damper" to -- clamper --;
Line 18, change "15" to -- 115 --;
Line 60, change "determined" to -- determine --.

Column 12,
Line 5, change "descried" to -- described --;
Lines 57, 59, and 60, change "damper" to -- clamper --.

Column 14,
Line 8, change "act ion" to -- action --.

Column 19,
Line 14, delete "I";
Line 15, change "in" to -- ink --.

Column 20,
Line 11, change "wilt" to -- will --;
Line 32, change "ink well" to -- ink wells --.

Column 24,
Line 6, change "form" to -- from --.

Column 27,
Line 67, delete "i".

UNITED STATES PATENT AND TRADEMARK OFFICE

CERTIFICATE OF CORRECTION

PATENT NO. : 6,263,791 B1
DATED : July 24, 2001
INVENTOR(S) : Makoto Sato

It is certified that error appears in the above-identified patent and that said Letters Patent is hereby corrected as shown below:

Column 31,
Line 32, change "port ion" to -- portion --;
Line 57, delete "de".

Column 32,
Line 12, delete "d";
Line 46, delete "co".

Signed and Sealed this

Fifth Day of March, 2002

*Attest:*

*Attesting Officer*

JAMES E. ROGAN
*Director of the United States Patent and Trademark Office*